US008794118B2

(12) United States Patent
Dow et al.

(10) Patent No.: US 8,794,118 B2
(45) Date of Patent: Aug. 5, 2014

(54) MACHINE FOR ALTERNATING TUBULAR AND FLAT BRAID SECTIONS AND METHOD OF USING THE MACHINE

(71) Applicant: Triaxial Structures, Inc., Warminster, PA (US)

(72) Inventors: Richard M. Dow, Philadelphia, PA (US); Stephen J. Kryven, Langhorne, PA (US)

(73) Assignee: Triaxial Structures, Inc., Warminster, PA (US)

( * ) Notice: Subject to any disclaimer, the term of this patent is extended or adjusted under 35 U.S.C. 154(b) by 0 days.

(21) Appl. No.: 13/718,641

(22) Filed: Dec. 18, 2012

(65) Prior Publication Data

US 2013/0167710 A1 Jul. 4, 2013

Related U.S. Application Data

(63) Continuation-in-part of application No. 13/034,053, filed on Feb. 24, 2011, now Pat. No. 8,347,772, which is a continuation-in-part of application No. 12/348,601, filed on Jan. 5, 2009, now Pat. No. 7,908,956.

(60) Provisional application No. 61/019,694, filed on Jan. 8, 2008, provisional application No. 61/368,417, filed on Jul. 28, 2010, provisional application No. 61/413,034, filed on Nov. 12, 2010.

(51) Int. Cl.
*D04C 3/00* (2006.01)

(52) U.S. Cl.
USPC ..... 87/41; 87/62

(58) Field of Classification Search
USPC ..... 87/7, 16, 41, 62
See application file for complete search history.

(56) References Cited

U.S. PATENT DOCUMENTS

| | | | |
|---|---|---|---|
| 1,032,870 | A | 7/1912 | Wardell |
| 1,423,587 | A | 7/1922 | Wardell |
| 2,148,164 | A | 3/1938 | Krippendorf |
| 2,879,687 | A | 3/1959 | Leimbach et al. |
| 3,714,861 | A | 2/1973 | Strangfeld |
| 4,084,479 | A | 4/1978 | Ratera |
| 4,275,638 | A | 6/1981 | DeYoung |
| 4,700,054 | A | 10/1987 | Triplett et al. |
| 4,774,871 | A | 10/1988 | Jones et al. |
| 4,943,334 | A | 7/1990 | Medney et al. |
| 5,287,790 | A | 2/1994 | Akiyama et al. |
| 5,361,674 | A | 11/1994 | Akiyama et al. |
| 6,360,644 | B1 | 3/2002 | Bettger et al. |

(Continued)

*Primary Examiner* — Shaun R Hurley
(74) *Attorney, Agent, or Firm* — Duane Morris LLP; Steven E. Koffs

(57) ABSTRACT

A braider comprises a plurality of horngears. The horngears can be arranged for forming at least two closed paths for braiding. Each horngear has a driving gear and a hornplate. Each horngear can be selectably operated in a first mode, to rotate with the driving gear, and in a second mode, in which the driving gear rotates, but the hornplate does not. Bobbin carriers are positioned on some of the horngears. A track is configurable in: a first flat braiding mode with the carriers arranged on the horngears, so that there is one or more separate closed path for forming a first flat braid configuration; and a second flat braiding mode for forming a second flat braid configuration different from the first flat braid configuration. A switch is provided for changing a configuration of the track between the first and second flat braiding modes.

23 Claims, 47 Drawing Sheets

(56) References Cited

U.S. PATENT DOCUMENTS

| | | | | |
|---|---|---|---|---|
| 6,599,561 | B2 | 7/2003 | Dow et al. | |
| 6,907,810 | B2 | 6/2005 | Kim | |
| 6,942,693 | B2 | 9/2005 | Chouinard et al. | |
| 7,004,967 | B2 | 2/2006 | Chouinard et al. | |
| 7,105,019 | B2 | 9/2006 | Hojeibane | |
| 7,237,466 | B2 | 7/2007 | Chen | |
| 7,270,043 | B2 | 9/2007 | Presz, Jr. et al. | |
| 7,908,956 | B2 | 3/2011 | Dow et al. | |
| 8,347,772 | B2 * | 1/2013 | Dow et al. | 87/41 |
| 2002/0055313 | A1 | 5/2002 | Velpari et al. | |
| 2004/0012937 | A1 | 1/2004 | DeGrappo et al. | |
| 2006/0225564 | A1 | 10/2006 | Presz, Jr. et al. | |
| 2007/0051232 | A1 | 3/2007 | Chen | |
| 2008/0216887 | A1 | 9/2008 | Hacke et al. | |
| 2009/0188380 | A1 * | 7/2009 | Dow et al. | 87/11 |
| 2011/0203446 | A1 * | 8/2011 | Dow et al. | 87/11 |

* cited by examiner

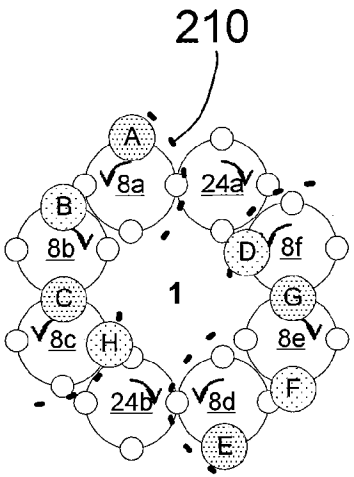
FIG. 22a
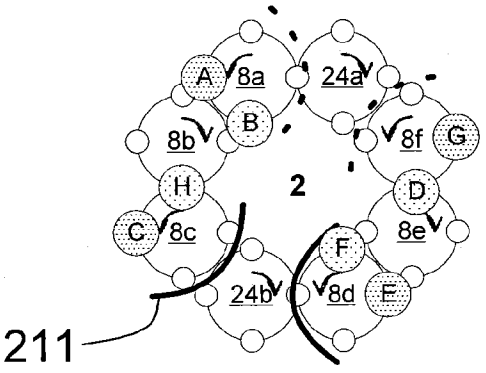
FIG. 22b
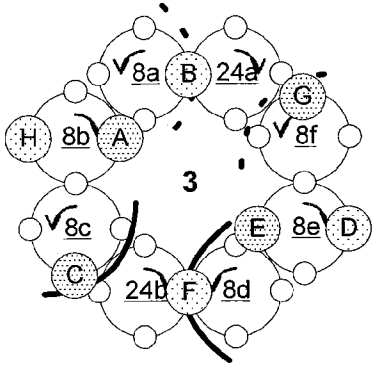
FIG.22c
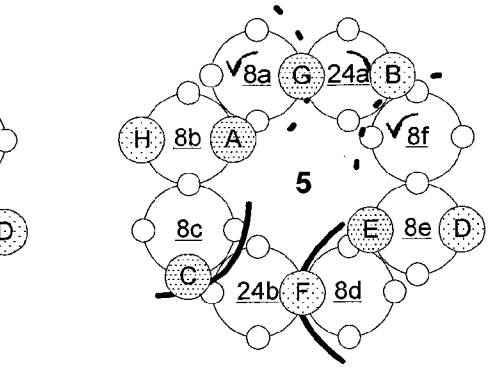
FIG. 22d
FIG.22e
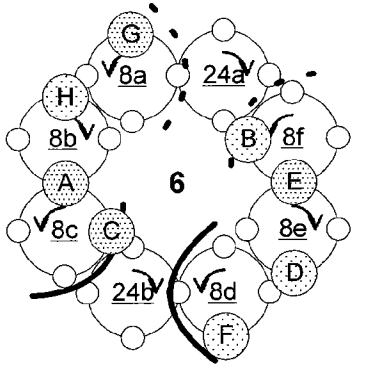
FIG. 22f FIF. 44a

MACHINE FOR ALTERNATING TUBULAR AND FLAT BRAID SECTIONS AND METHOD OF USING THE MACHINE

This application is continuation in part of U.S. patent application Ser. No. 13/034,053, filed Feb. 24, 2011, which is a continuation in part of U.S. patent application Ser. No. 12/348,601, filed Jan. 5, 2009, now U.S. Pat. No. 7,908,956, which claims the benefit of U.S. Provisional Patent Application No. 61/019,694 filed Jan. 8, 2008, and application Ser. No. 13/034,053 claims the benefit of U.S. Provisional Patent Application Nos. 61/368,417, filed Jul. 28, 2010, and 61/413,034, filed Nov. 12, 2010, all of the above applications being expressly incorporated by reference herein in their entireties.

FIELD OF THE INVENTION

The present invention relates to braiding, automatic splitting and rejoining of the braided material and methods.

BACKGROUND

Braided structures are configured in two main ways, tubular braids and flat braids. A conventional tubular braided structure can be accomplished using standard braiding technology that has been in existence for several centuries. The standard tubular braided structure can be braided over material (a core) or left as a hollow tube. As braiding is a highly efficient process and can be operated in clean environments, many medical devices are manufactured using this process such as stents, sutures and catheters.

A typical machine for producing a tubular braid is shown in U.S. Pat. No. 7,237,466, incorporated by reference herein in its entirety, in which FIG. 1 shows a plate 12 having a track comprising two intersecting paths, along which a plurality of carriers 15 are advanced by eight rotating horngears (transfer plates 14). Carriers 15 travel along one of the paths in a clockwise-direction, and carriers travel along the other path in the counter-clockwise direction to form the tubular braid.

Flat braids are created on braiding equipment similar to that used for tubular braids. These braided constructions are typically use in electronics for ground wiring and other high current environments. Sometimes a tubular braid is overbraided onto a flat braid as an insulator. Machines arranged for flat braiding differ from machines arranged for tubular braiding in that flat braiding arrangements cause the yarn carriers to reverse direction at the edge of the braid, instead of continuing in closed curved paths.

Over the years, variations of braiding machines have been developed to produce either a tubular braid or a flat braid, or to switch between the tubular braiding mode and flat braiding mode during operation.

U.S. Pat. No. 2,148,164 to Krippendorf, incorporated by reference herein in its entirety, describes a machine that switches between tubular and flat braiding modes, with a pair of special horngears that pass bobbin carriers back and forth in the tubular braiding mode, or reverse the direction of the bobbin carriers in the flat braiding mode. A retarding mechanism is needed to provide phase and rate matching when the operating mode is switched.

U.S. Pat. No. 6,907,810 to Kim, incorporated by reference herein in its entirety, describes a system that is operable to produce a single tubular braid, or a pair of rectangular braids. It is thus possible to produce a braid having an eye where the single braid bifurcates into two rectangular braids.

Improved methods and apparatus are desired.

SUMMARY OF THE INVENTION

In some embodiments, in a braider having a track for guiding bobbin carriers and horngears. The horngears each have hornplates for forming at least one path, a method comprises the steps of: (a) positioning the bobbin carriers on the horngears in a first flat braiding mode, with the track and horngears configured so that the hornplates cause the bobbin carriers to move along at least one closed path that does not intersect any other one of the at least one closed path; (b) operating the braider in the first flat braiding mode, to form a first flat braid section; (c) positioning the bobbin carriers on the horngears in a second flat braiding mode having a different configuration of non-intersecting closed paths from the first flat braiding mode; (d) operating the braider in the second flat braiding mode, to form a second flat braid section having a different configuration of yarns than the first flat braid section; (e) and automatically switching between the first and second flat braiding modes to form a continuous braid having at least one first flat braid section and at least one second flat braid section.

In some embodiments, in a braider having a track for guiding bobbin carriers and horngears, the horngears each having hornplates for forming at least one path, a method comprises the steps of: (a) positioning the bobbin carriers on the horngears in a first flat braiding mode, with the track and horngears configured so that the hornplates cause the bobbin carriers to move along at least one closed path that does not intersect any other one of the at least one closed path; (b) operating the braider in the first flat braiding mode, to form a first flat braid section; (c) positioning the bobbin carriers on the horngears in a second flat braiding mode having a different configuration of non-intersecting closed paths from the first flat braiding mode; and (d) operating the braider in a second flat braiding mode with the track and horngears configured differently from the first flat braiding mode, including disengaging at least one of the hornplates from rotating with its respective horngear for a part of the operating in the second flat braiding mode, to form a second flat braid section having a different configuration of yarns than the first flat braid section, so that a continuous braid is formed having at least one first flat braid section and at least one second flat braid section.

In some embodiments, a braider comprises a plurality of horngears. The horngears are capable of being arranged for forming at least two closed paths for braiding. Each horngear has a driving gear and a hornplate. Each horngear is configured to be selectably operated in a first mode, in which the hornplate rotates with the driving gear, and in a second mode, in which the driving gear rotates, but the hornplate does not rotate. A plurality of bobbin carriers are positioned on some of the horngears. A track is capable of being configured in: a first flat braiding mode in which the bobbin carriers are arranged on the horngears, so that there is one or more separate closed path that does not intersect another of the one or more separate closed paths, for forming a first flat braid configuration; and a second flat braiding mode for forming a second flat braid configuration different from the first flat braiding configuration. At least one switch is provided for changing the configuration of the track between the first and second flat braiding modes.

In some embodiments, a method is provided for use in a braider having a track for guiding bobbin carriers and 4N horngears, where N is an integer >1. The horngears each have four horns for forming at least two paths. 4N bobbin carriers are positioned on the 4N horngears in a tubular braiding mode with the track and horngears configured to provide two paths intersecting each other. The braider is operated in the tubular braiding mode, to form a tubular braid section. The 4N bobbin carriers are positioned on the 4N horngears in a flat braiding mode, with the track and horngears configured so that there are N separate closed paths that do not intersect each other. The braider is operated in the flat braiding mode, to form a flat braid section. The braider is switched between the tubular braiding mode and flat braiding mode while N of the 4N horngears are free of any contact with any of the 4N bobbin carriers, to form a continuous braid having at least one tubular braid section and at least one flat braid section. A translation speed of each bobbin carrier is maintained substantially constant during the tubular braiding, flat braiding and switching steps.

In some embodiments, a method is provided for using a braider having a track for guiding bobbin carriers and 4N horngears, where N is an integer >1. The horngears each have four horns for forming at least two paths. 4N bobbin carriers are positioned on the 4N horngears in a tubular braiding mode with the track and horngears configured to provide two paths intersecting each other, so that there are 2N carriers on each path, and a number of empty horns between successive pairs of horns on each path having bobbin carriers thereon alternates between two and four. The braider in the tubular braiding mode, to form a tubular braid section. The 4N bobbin carriers are positioned on the 4N horngears in a flat braiding mode. In the flat braiding mode, the track and horngears configured so that there are N separate closed paths that do not intersect each other, each path having three consecutive horngears, with four bobbin carriers on each path, and two empty horns between successive pairs of horns on each path having bobbin carriers thereon. The braider is operated in the flat braiding mode, to form a flat braid section. The braider is switched between the tubular braiding mode and flat braiding mode while N of the 4N horngears are free of any contact with any of the 4N bobbin carriers, to form a continuous braid having at least one tubular braid section and at least one flat braid section.

In some embodiments, a braider comprises 4N horngears, where N is an integer >1, and the horngears each have four horns capable of being arranged for forming at least two closed paths. 4N bobbin carriers are positioned on the 4N horngears. A track is provided, which is capable of being configured in a tubular braiding mode or a flat braiding mode. In the tubular braiding mode, there are two intersecting paths with 2N carriers on each path, and a number of empty horns between successive pairs of horns on each intersecting closed path having bobbin carriers thereon alternates between two and four. In the flat braiding mode, the 4N bobbin carriers are arranged on the 4N horngears, so that there are N separate closed paths, each path having three consecutive horngears, with four bobbin carriers on each path, and two empty horns between successive pairs of horns on each path having bobbin carriers thereon. A switch is provided for switching the track between the tubular braiding mode and flat braiding mode while N of the 4N horngears are free of any contact with any of the 4N bobbin carriers, for forming a continuous braid having at least one tubular braid section and at least one flat braid section.

BRIEF DESCRIPTION OF THE DRAWINGS

FIGS. 22*a* to 22*f* are diagrams showing bridge and carrier states for a braid having a tubular section and a flat section each having eight yarns.

FIGS. 44*a*-44*e* are diagrams showing bridge and carrier states for the five different flat braid configurations shown in FIG. 43.

DETAILED DESCRIPTION

Figure 1B:
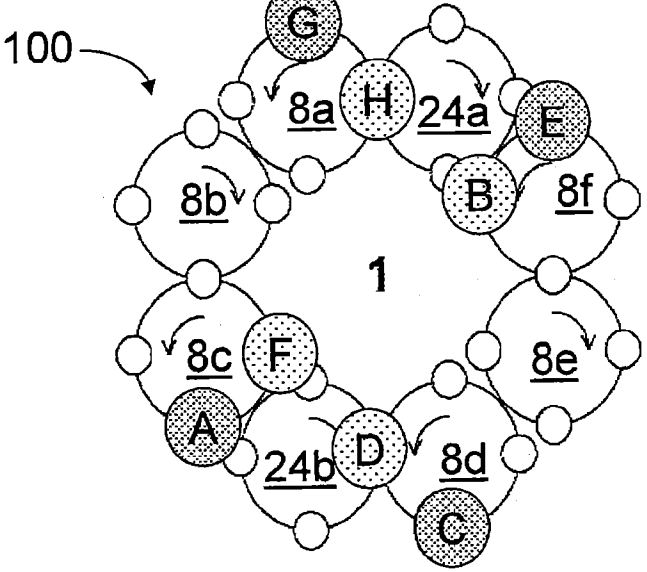
FIGS. 1A to 1C are schematic diagrams showing the positioning of bobbin carriers on an exemplary apparatus.

This description of the exemplary embodiments is intended to be read in connection with the accompanying drawings, which are to be considered part of the entire written description. In the description, relative terms such as "lower," "upper," "horizontal," "vertical,", "above," "below," "up," "down," "top" and "bottom" as well as derivative thereof (e.g., "horizontally," "downwardly," "upwardly," etc.) should be construed to refer to the orientation as then described or as shown in the drawing under discussion. These relative terms are for convenience of description and do not require that the apparatus be constructed or operated in a particular orientation. Terms concerning attachments, coupling and the like, such as "connected" and "interconnected," refer to a relationship wherein structures are secured or attached to one another either directly or indirectly through intervening structures, as well as both movable or rigid attachments or relationships, unless expressly described otherwise.

Figure 16:
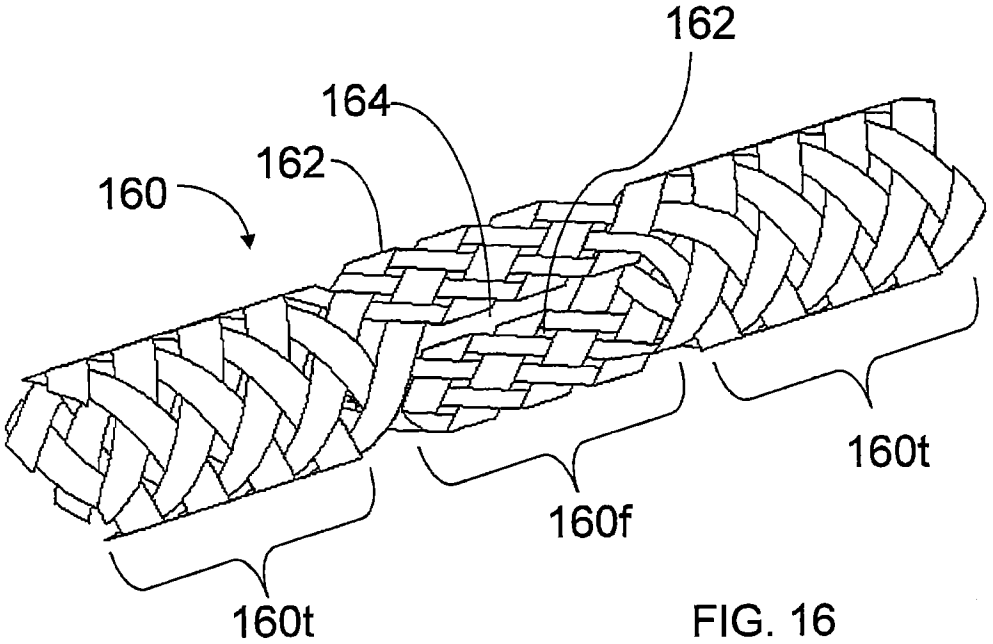
FIG. 16 is an isometric view of a braid formed by the apparatus of FIG. 3.

FIG. 16 is an isometric view of a continuous braid 160 having at least one tubular braid section 160*t* and at least one flat braid section 160*f*. The flat braid section 160*f* has a plurality of flat braids 162 and slots 164 separating the flat braids. Each flat braid 162 is in the form of an open circular arc of slightly less than 360/N degrees, where N is the number of flat braids 162 in the flat braid section 160*f*. The individual strands of yarn run continuously between the tubular and flat braid sections 160*t* and 160*f*. In the tubular braid sections 160*t*, each strand traces out a helical path. In the flat braid sections 160*f*, each strand follows a helical path for slightly less than 360/N degrees, and then the tangential component of its direction vector reverses sign while the longitudinal component remains constant.

Figure 1A:
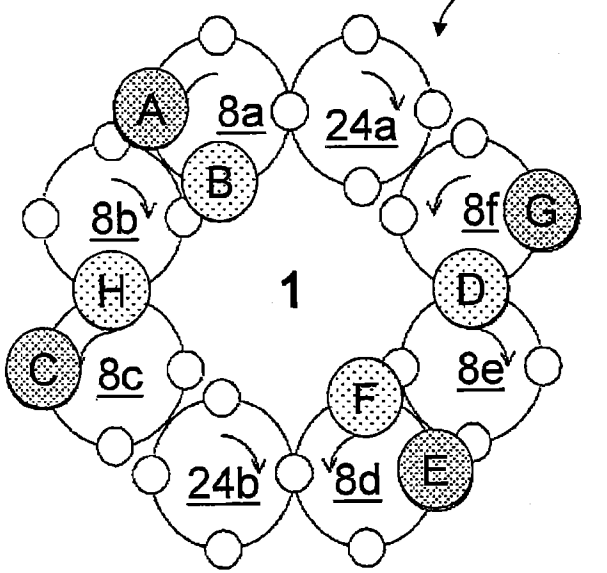
Figure 2B:
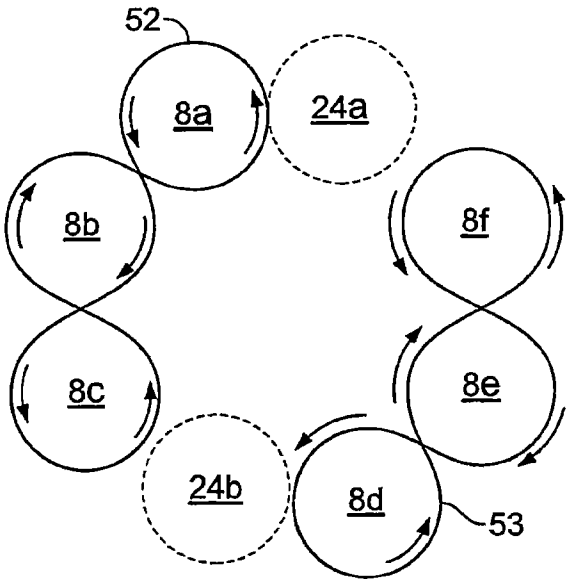
FIG. 2B is a diagram of the paths followed by bobbin carriers in the flat braiding mode.

FIGS. 1A and 1B are schematic diagrams of an exemplary braider 100, capable of forming the braid 160. FIGS. 1A and 1B show the arrangement of bobbin carriers A-H and horngears 8*a*-8*f*, 24*a*-24*b*. System 100 is a 16-end braiding machine of a type with eight carriers A-H used to carry and interlace the yarns around the machine, propelled by eight horngears 8*a*-8*f*, 24*a*, 24*b*. As shown in FIG. 1A, this machine produces a single 8-end tubular braid. Braider 100 is capable of operating in the tubular braiding mode (FIG. 2A), for making a single tubular braid, or in a flat braiding mode (FIG. 2B) for making two 4-end flat braids. Bobbin carriers A-H (FIGS. 1A, 1B) are transported on horngears 8*a*-8*f* in both modes. The bobbin carriers A-H do not interact with the horngears 24*a*-24*b* in the flat braiding mode (FIG. 2B). Thus, FIG. 1A represents possible positions of bobbin carriers A-H in either tubular braiding mode or flat braiding mode. FIG. 1B represents possible positions of bobbin carriers A-H in tubular braiding mode, but not in the flat braiding mode.

Figure 1C:
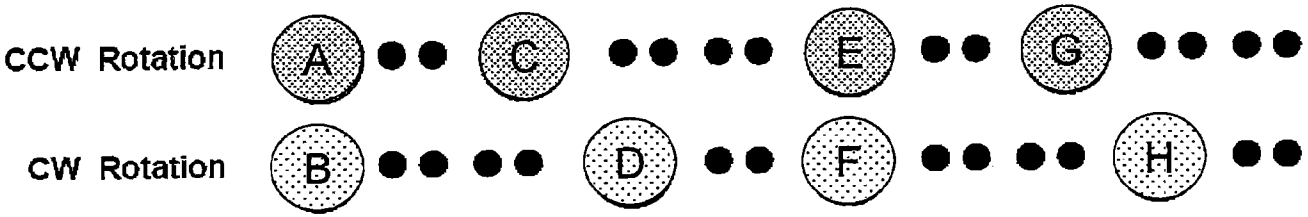
Figure 2A:
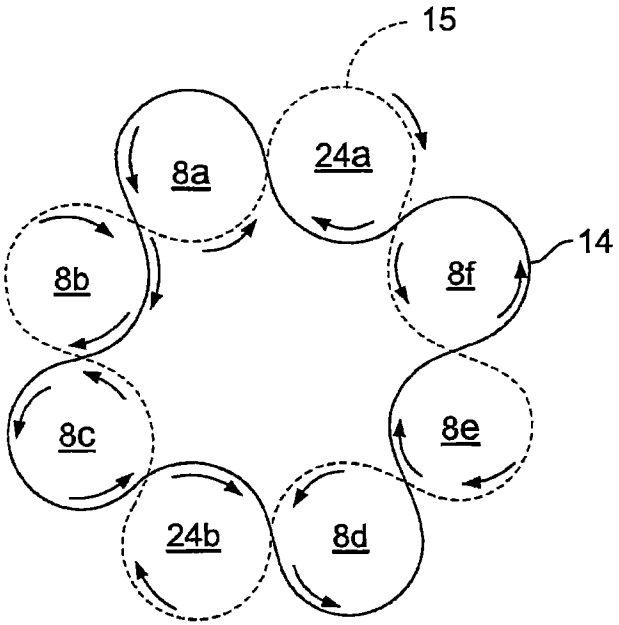
FIG. 2A is a diagram of the paths followed by bobbin carriers in the tubular braiding mode.

FIG. 1C shows how the bobbin carriers A-H are staggered in the two paths while the system operates in the tubular braiding mode (FIGS. 1A, 1B, 2A). Each dot in FIG. 1C represents an empty horn on one of the horngears 8*a*-8*f*, 24*a*-24*b* (i.e, a horn without a carrier on it). With carrier A positioned on the horngear 8*a* adjacent to horngear 24*a* (moving away from horngear 24*a*), and carrier B positioned on the horngear 8*a* moving towards horngear 24*a*, the counter-clockwise path has carrier spacings of 2 (empty horns), 4 (empty horns), 2, 4. The clockwise path has carrier spacings of 4 (empty horns), 2 (empty horns), 4, 2. Staggering the bobbin carriers in the manner shown in FIG. 1C ensures that horngears 24A and 24B are both periodically free from any contact with any of the bobbin carriers A-H at the same time, while the system 100 is in the tubular braiding mode.

The bobbin carrier A is designated a master carrier, and is used for determining correct position for the rest of the bobbin carriers B-H.

Switching between the tubular and flat braiding modes (in either direction) can be performed any time the bobbin carriers are positioned with two carriers interacting with each of the horngears 8*a*, 8*c*, 8*d*, and 8*f*. In this manner, switching can be accomplished without interrupting the operation or speed of the system 100, without changing the rotation speed of the horngears 8*a*-8*f*, 24*a*, 24*b*, and without changing the speed of translation of any of the bobbin carriers 7.

FIG. 2A shows the paths traveled by the bobbin carriers A-H in the tubular braiding mode. Four of the bobbin carriers A, C, E, G, travel in the counter-clockwise direction, as shown by the dashed curve. Four of the bobbin carriers B, D, F, H travel in the clockwise direction, as shown by the solid curve.

At a time when none of the eight bobbin carriers A-H is in contact with any of the horngears 24, the paths are switched, to remove horngears 24A, 24B from the active paths, to switch to the flat braiding mode. The horngears 24A, 24B can continue to rotate, but no bobbin carriers are fed to horngears 24A, 24B until the system is switched back to the tubular braiding mode. The horngears 8*a*, 8*f* adjacent to horngears 24A, and the horngears 8*c* and 8*d* adjacent to horngear 24B reverse the direction of the bobbin carriers that are received by the adjacent horngears 8*a*, 8*f*, 8*c*, 8*d*, to form two separate closed loops, as shown in FIG. 2B. Note that in FIG. 2B, the dashed lines on horngears 24*a*, 24*b* signify that these two horngears do not interact with the carriers A-H, whereas in FIG. 2A, the dashed line indicates a separate path, along which carriers travel in the opposite direction from the path indicated by the solid line.

In the flat braiding mode of FIG. 2B, each path has four bobbin carriers traveling in the same direction, guided by three horngears, with a spacing of two empty horns (270 degrees) between each pair of consecutive carriers. That is, if there is a first carrier positioned at a given location in inertial space, a second carrier will occupy the same position in inertial space when the horngears have rotated 270 degrees. At the moment in time that the second carrier occupies the same location in inertial space, it will not, however, be in contact with the same horn(s).

Although FIGS. 1A and 1B show a system having eight horngears 8*a*-8*f*, 24*a*-24*b* and eight bobbin carriers A-H, the methods described herein can be applied to any configuration with any multiple of four horngears and four bobbin carriers.

A system having 4N horngears and 4N bobbin carriers (for any integer value of N>1) can be operated in a tubular braiding mode for making a single 4N-ended braid, or in a flat braiding mode for making N flat braids, each of the 4-ended type. Regardless of the value of N, every fourth horngear is of a type that can be switched in or out of the active braiding loops. Although exemplary mechanisms are described below for switching the horngears 24*a*, 24*b* in and out of the carrier paths, other switching mechanisms may be used.

For any integer N>1, in the tubular braiding mode, the clockwise path has carriers staggered with spacings of N×{4, 2} empty horns, and the counter-clockwise path has carriers staggered with spacings of N×{2, 4} empty horns.

In other embodiments, the general process can be performed with a braider having only 4 horngears and 4 carriers. That is, N can be any integer greater than 0.

Figure 3:
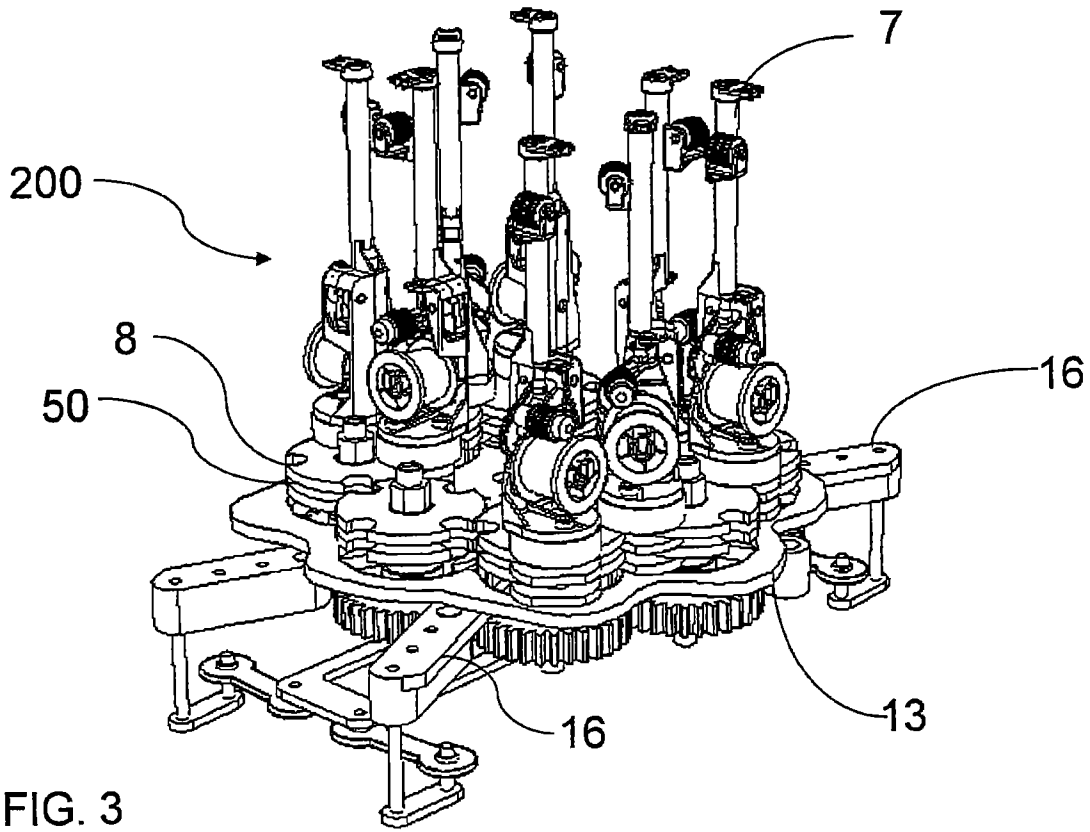
FIG. 3 is an isometric view of an exemplary braider.

FIG. 3. is an isometric view of a 16-end braiding machine 200 of a type with eight carriers 7 used to carry and interlace the yarns around the machine, propelled by eight horngears 8. Each horngear 8 has four horns 50, which engage the carriers 7, moving the carriers along one of the paths, and transferring carriers between horngears 8.

Figure 4:
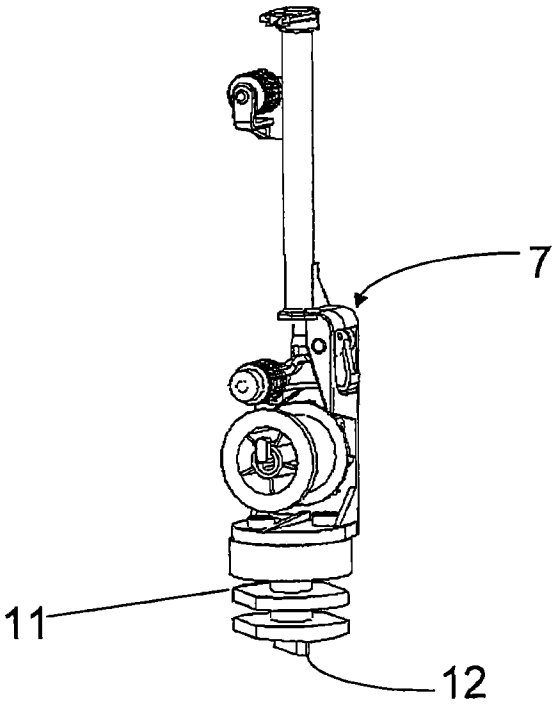
FIG. 4 is an isometric view of a bobbin carrier suitable for use in the braider of FIG. 3.

FIG. 4 shows a yarn carrier 7, suitable for use in the braider 200 of FIG. 3, riding on top of a carrier foot 11 and guided by the carrier foot blade 12. The braider 200 has a drive system for rotating each of the horngears 8 at a constant rotational speed before, during and after switching of the switch.

Figure 5A:
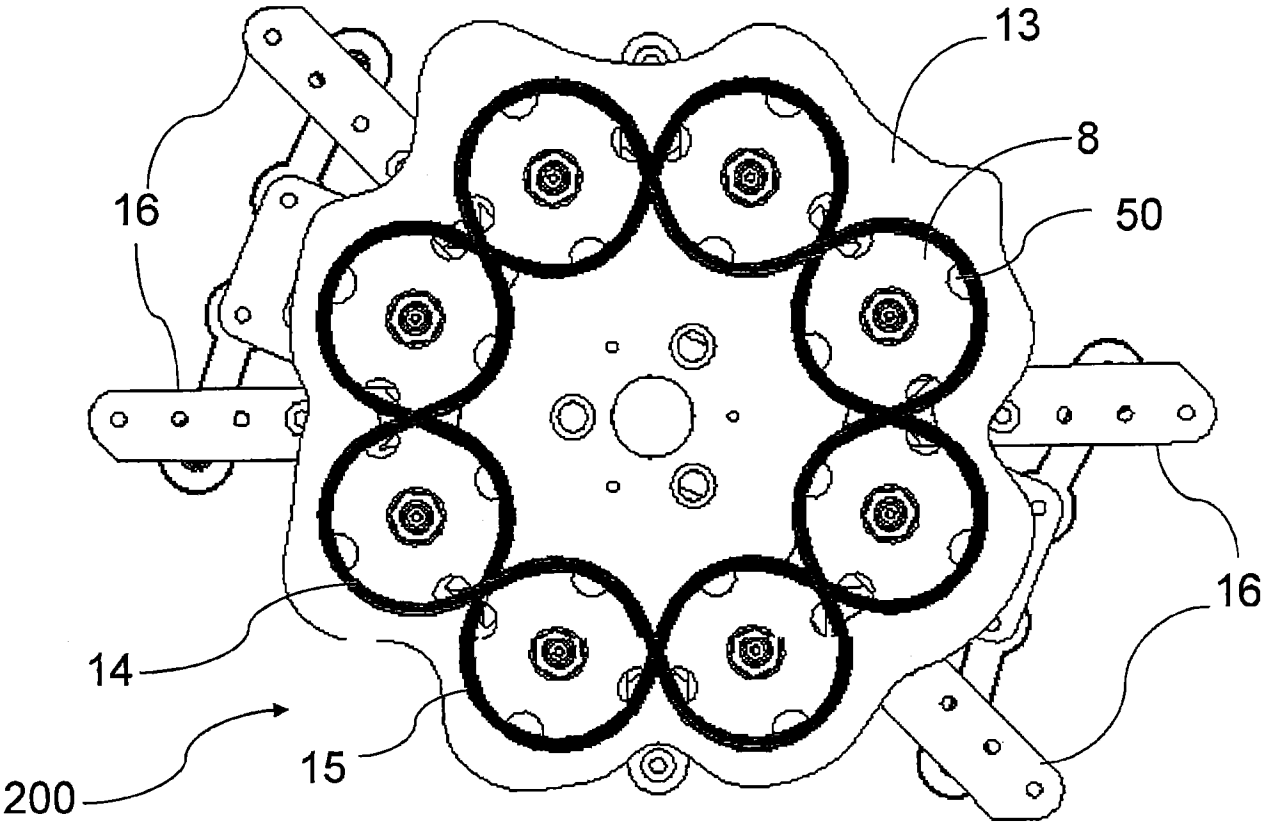
FIG. 5A is a plan view of the track of the braider of FIG. 3 switched to the tubular braiding mode.

FIG. 5A is a top view of the braider with a cut-away outside track 13 for ease of visibility exposing the linkage mechanism 16. In addition, the two intersecting carrier paths for a non-bifurcating braid, 14 and 15 are shown.

Figure 5B:
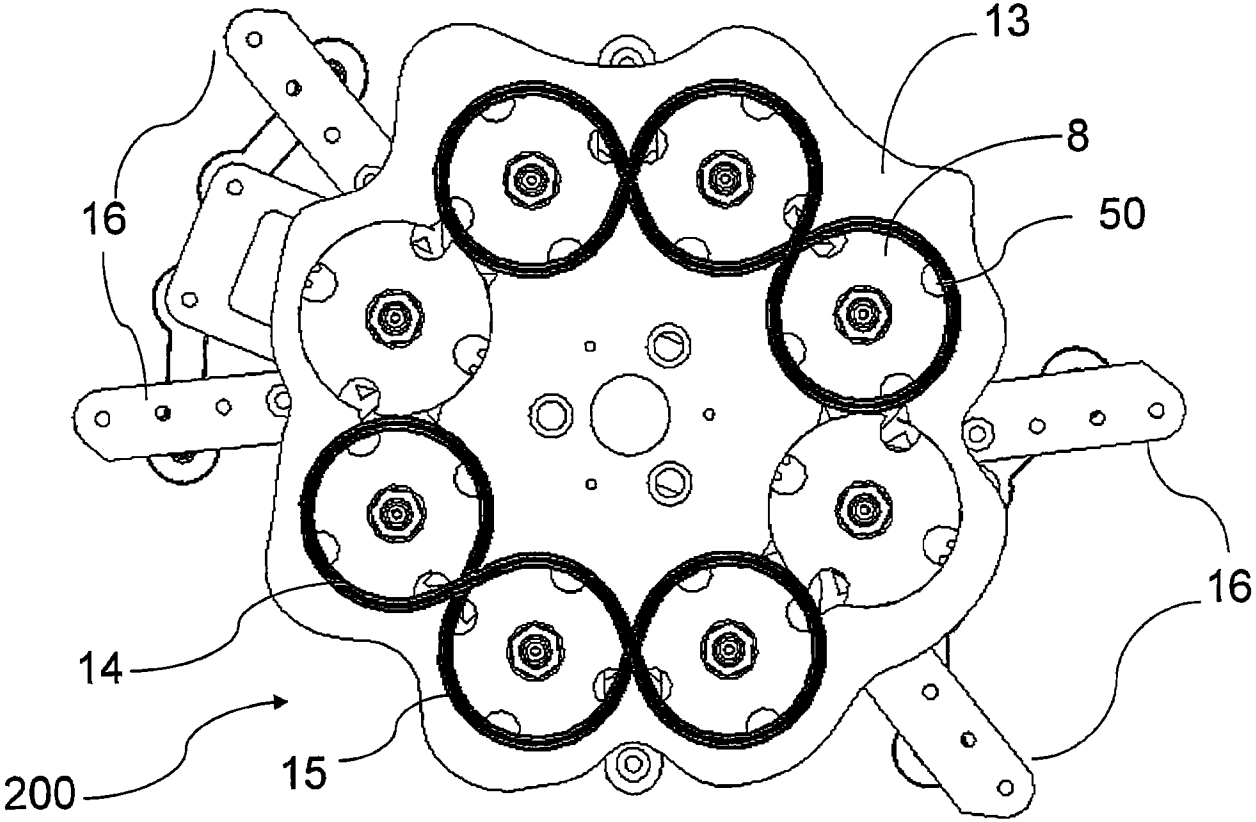
FIG. 5B is a plan view of the track of the braider of FIG. 3 switched to the flat braiding mode.

FIG. 5B shows a top view of the braider with a cut-away outside track 13 for ease of visibility exposing the linkage mechanism 16. In addition, the two separate carrier paths for two bifurcating braids, 17 and 18 are shown.

The braiding machine 200 has a track 14, 15 capable of being configured in either of two different modes at any one time. In the tubular braiding mode, the track includes two intersecting paths 14, 15 with 2N (=4 in FIG. 3) carriers 7 on each path 14, 15, and a number of empty horns between successive pairs of horns on each intersecting closed path having bobbin carriers 7 thereon alternates between two and four.

In the flat braiding mode, the 4N bobbin carriers are arranged on 3N of the 4N horngears, so that there are N separate closed paths 52, 53, each path having three consecutive horngears, with four bobbin carriers on each path, and two empty horns between successive pairs of horns on each path having bobbin carriers 7 thereon. For example, for the apparatus of FIG. 3 in the flat braiding mode, there are eight carriers 7, arranged on six of the eight horngears 8*a*-8*f*, with two separate closed paths, each path having three horngears.

A switch is provided for switching the track 14, 15 between the tubular braiding mode and flat braiding mode while N of the 4N horngears 24*a*, 24*b* are free of any contact with any of the 4N bobbin carriers 7. The track 14, 15 includes a plurality of bridge sections 19 arranged so that every fourth horngear 24*a*, 24*b* is positioned adjacent to and between a respective pair of bridge sections 19, each bridge section switchable by operation of the switch, between a first position (FIG. 10) in which the track connects every fourth horngear to adjacent horngears on either sides thereof, and a second position (FIG. 11) in which the track reverses direction on each side of every fourth horngear.

Figure 10:
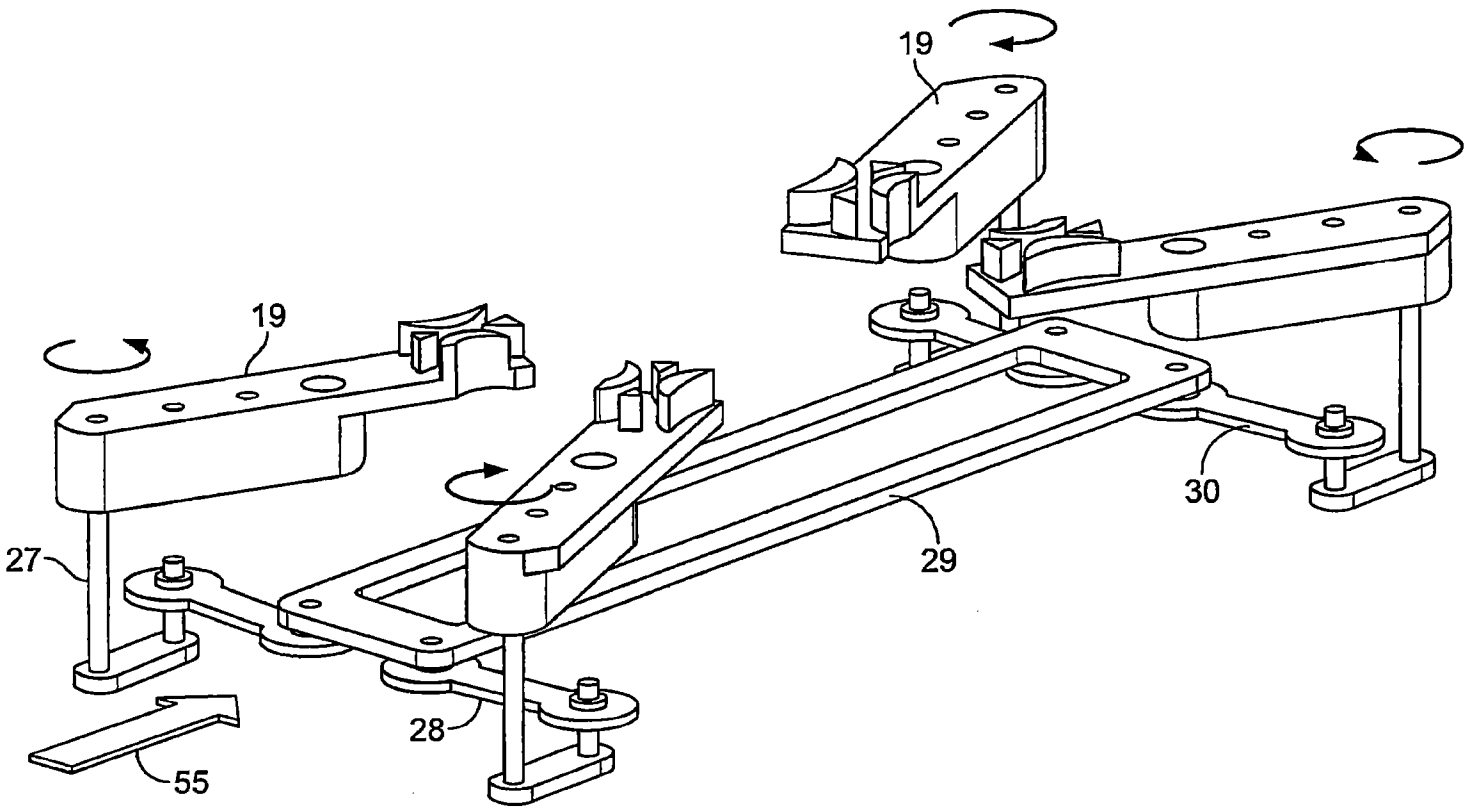
FIG. 10 is an isometric view of the track switching apparatus in the tubular braiding position.
Figure 11:
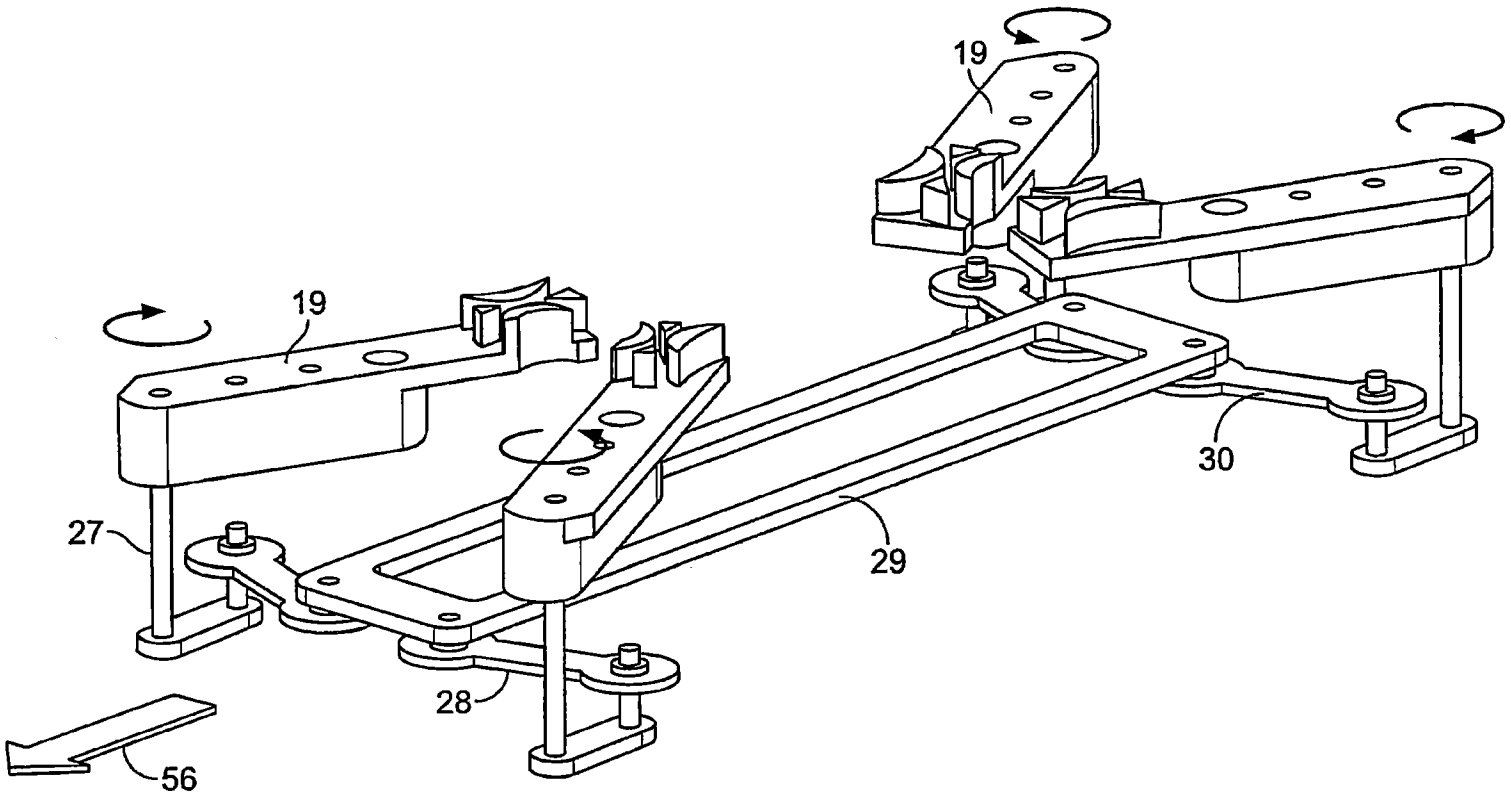
FIG. 11 is an isometric view of the track switching apparatus in the flat braiding position.

An exemplary switching mechanism is best seen in FIGS. 10 and 11, and includes a set of modified bridge assemblies 19. The two or more bridge sections 19 are connected by a linkage 28, 29, 30, so that the two or more bridge sections 19 are switchable between first and second positions by actuation of the linkage.

FIG. 10 shows the linkage used to drive the bridges 19. Drive link 29 moves connecting link 28, which rotates bridge lever 27, which rotates bridge 19. The arrows show the direction of movement for non-bifurcating braiding.

In FIG. 10, the modified bridge assemblies 19 are in the in standard position for tubular braiding, with the tips aligned. In FIG. 11, the modified bridge assemblies 19 are in the in bifurcation position for flat braiding, with the curves aligned. The driving forces 55, 56 shown in FIGS. 10 and 11, respectively, can be applied to drive link 29 by a linear motor, air cylinder, cam, crank, or the like.

FIG. 11 shows the linkage used to drive the bridges 19. Drive link 29 moves connecting link 28, which rotates bridge lever 27, which rotates bridge 19. The arrows show the direction of movement for bifurcated braiding.

Moving the Drive Link in the direction shown in FIG. 10 forces the linkage to rotate around the Fixed Pins causing the ends of the modified bridge assemblies 19 to rotate outward and thus aligning tips. This completes the two paths 14, 15 that encircle the braider 200 as shown in FIG. 5A, by connecting the slots around horngears 24*a*, 24*b* with the slots around the neighboring horngears 8*a*, 8*c*, 8*d*, and 8*f*. Any bobbin carrier 7 that traverses the slots 14, 15 around horngears 24*a* and 24*b* are automatically transferred to the neighboring horngears.

Moving the Drive Link in the direction shown in FIG. 11 forces the linkage to rotate around the Fixed Pins causing the ends of the modified bridge assemblies 19 to rotate inward and thus aligning curves. This reroutes the two paths as shown in FIG. 5B, so that any bobbin carrier that is transferred to horngears 8*a* and 8*c* circle completely around horngears 8*a* and 8*c*, and return to horngear 8*b*, without being transferred to horngears 24*a* or 24*b*. Similarly, any bobbin carrier that is transferred to horngears 8*d* and 8*f* circle completely around horngears 8*d* and 8*f*, and return to horngear 8*e*, without being transferred to horngears 24*a* or 24*b*.

By switching back and forth between the tubular and flat braiding modes, the system 200 forms a succession of respective tubular and flat braid sections. The result is a continuous braid having at least one tubular braid section at a first location along the longitudinal axis and at least one flat braid section at a second location along the longitudinal axis. The continuous braid may have any desired number of tubular and flat braid sections.

Figure 6:
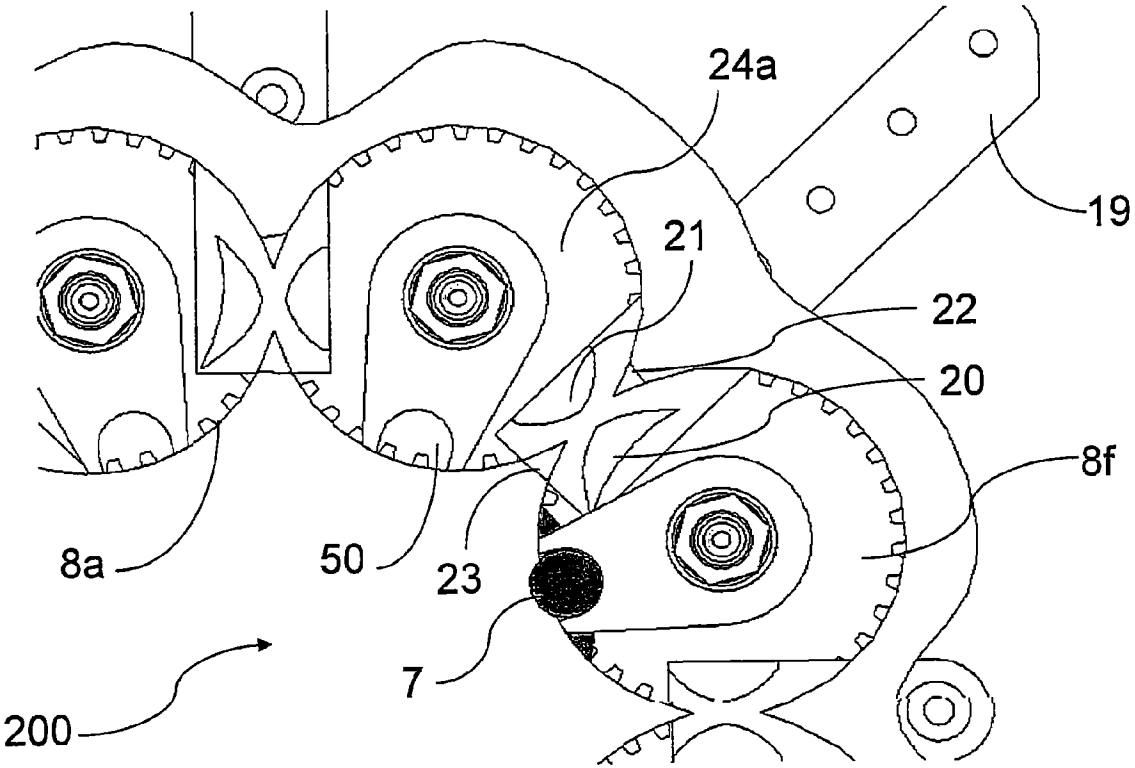
FIGS. 6-8 are plan views of a portion of the track of FIG. 5A, configured to transfer a bobbin carrier between a regular horngear that is used in both tubular and flat braiding modes and a switched horngear that is only used in the tubular braiding mode.
Figure 7:
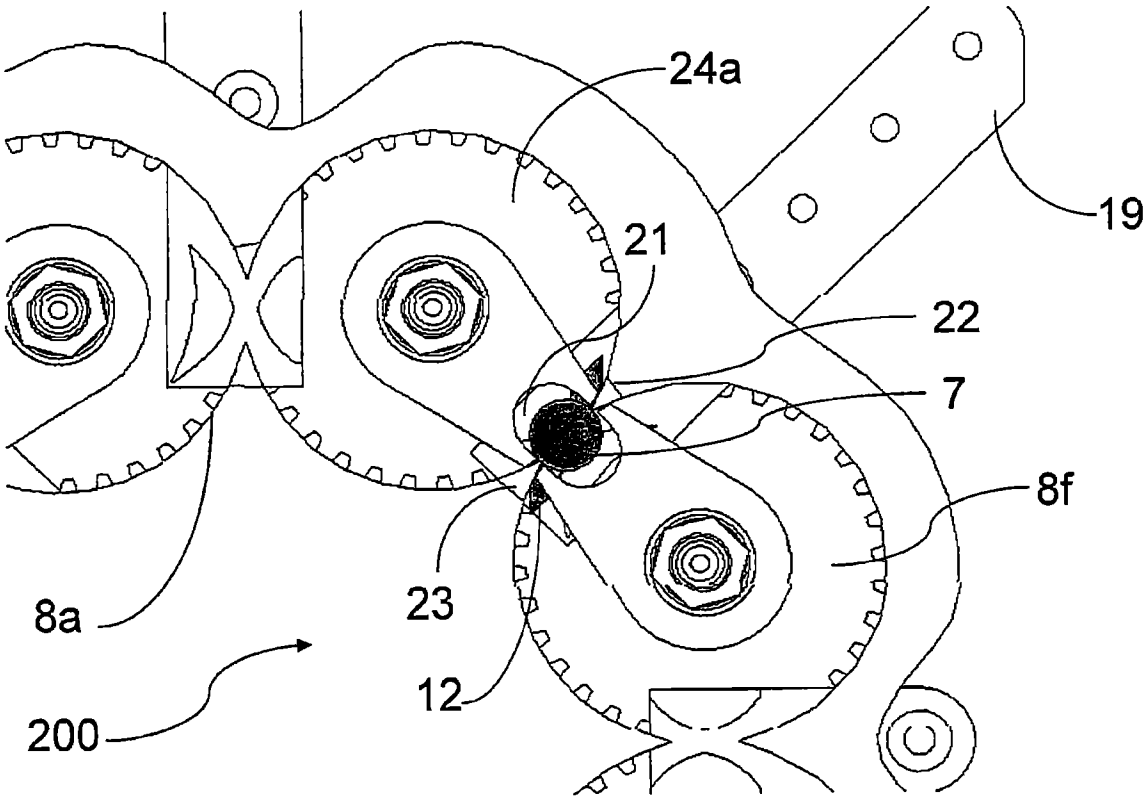
Figure 8:
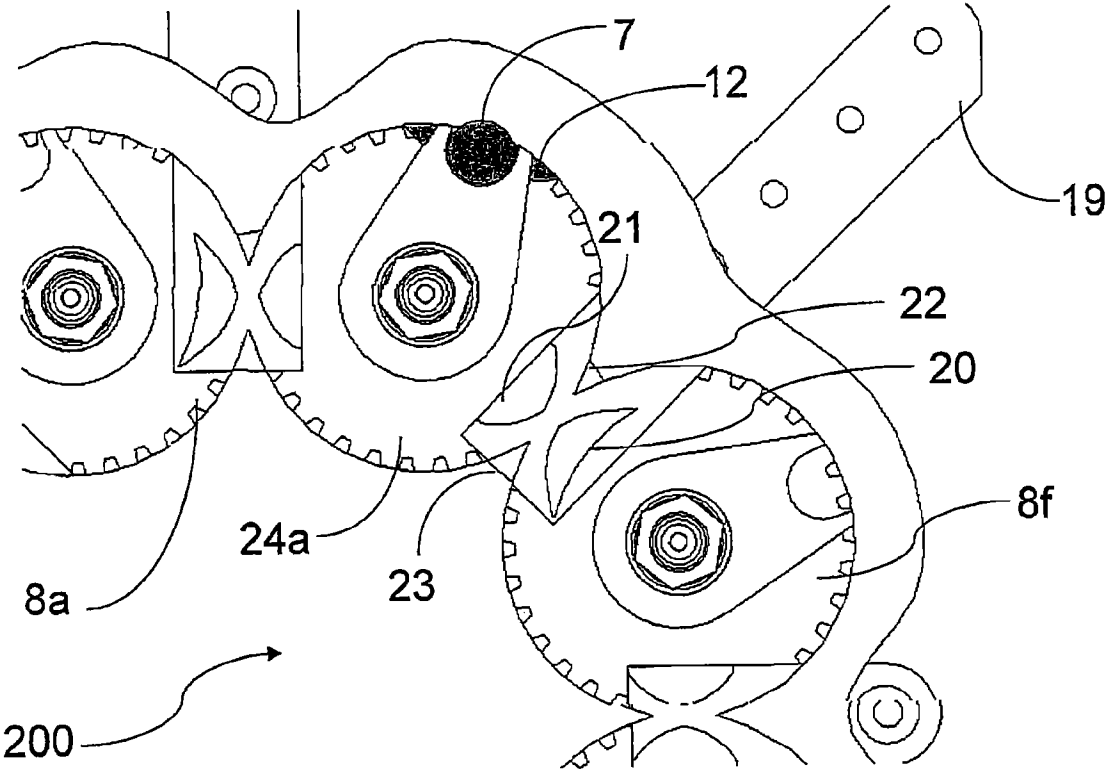

FIGS. 6-8 show details of a transfer of a bobbin carrier 7 from horngear 8*f* to horngear 24*a*, while the switch is in the tubular braiding position. FIG. 6 detail shows the bridge 19 used for switching the carriers in the non-bifurcating position, with its guiding features: bifurcating tip 20, non-bifurcating tip 21 outside tip 22 and inside tip 23. The view of horngears 8*f*, 24*a*, 8*a* have been simplified for visibility by reducing the number of horns shown in the drawing from 4 to 1, but one of ordinary skill understands that the remaining three horns are present. Additionally the drawing of yarn carrier 7 has been simplified for visibility to show the carrier foot 12. As shown, yarn carrier 7 is captured by horngear 8 and is guided by inside track 10 by contacting the carrier foot 12. As horngear 8 rotates, the yarn carrier moves with it and the inside track guides the carrier in a circular path.

FIG. 7 detail shows the horngear 8*f* has rotated to the transfer position. Since horngear 8*f* and horngear 24*a* are coupled together in a 1 to 1 ratio, as horngear 8*f* reaches the transfer position, horngear 24*a* meets it to receive yarn carrier 7. At the same time carrier foot 12 is guided by inside tip 23 and bifurcating tip 20 and then non-bifurcating tip 21 and outside tip 22 forcing yarn carrier 7 into horngear 24*a*.

FIG. 8 detail shows the completion of the transfer of yarn carrier 7 to horngear 24*a* in order for it to continue around non-bifurcating path 15. This process repeats for all eight yarn carriers and the result is the 8-end tubular braid 160.

Figure 9:
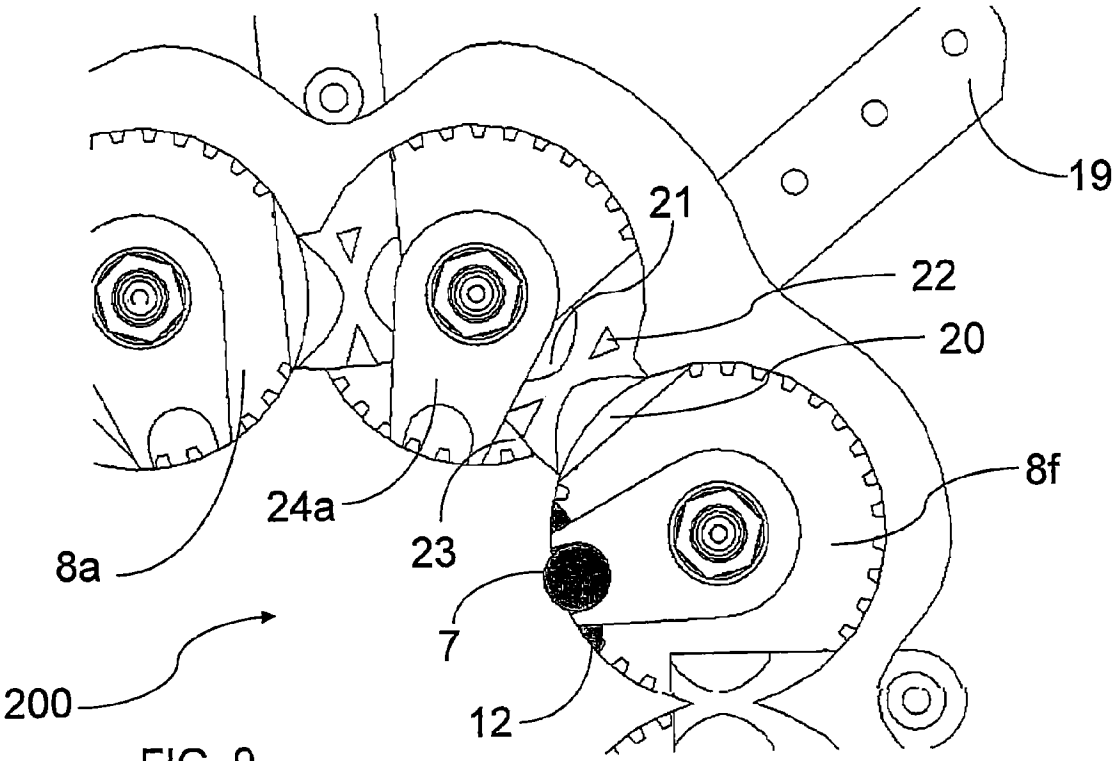
FIG. 9 is a plan view of the portion of the track shown in FIGS. 6-8, after switching the track to the flat braiding mode.

FIG. 9 detail shows the bridge 19 rotated into the bifurcating position. By doing so, outside tip 22 has rotated away from outside track 9 and inside tip 23 has rotated away from inside track 10. Bifurcating tip 20 as rotated so that the curve of the bifurcating tip 20 matches the curves of outside track 9 and inside track 10. Yarn carrier 7 is captured by horngear 8*f* and is guided by inside track 10 by contacting the carrier foot 12. The horngear 8*f* transmits the carrier 7 about 360 degrees, to reverse its direction and transfer the carrier 7 back to horngear 8*e* (shown in FIG. 1A).

When horngear 8*f* has rotated to the transfer position, the carrier foot 12 is guided by the bifurcating tip 20, so no transfer takes place. As horngear 8*f* continues to rotate, yarn carrier 7 continues around the bifurcating path (along horngears 8*d*, 8*e* and 8*f*), for flat braiding. Yarn carrier 7 continues around with horngear 8*f* and guided by outside track 9. As there are 4 locations of movable bridge 19, two 4-end flat braids are formed. When a sufficient length of bifurcated braid is formed, the bridges 19 are rotated back to the non-bifurcating position (shown in FIG. 10), and braiding continues for the 8-end tubular braid.

FIGS. 12-15 show a braider 300 having an alternative mechanical switch arrangement. Rather than moving the intersecting portion of the two paths 14, 15 (as in FIG. 3), a gate 33 is inserted or retracted to redirect the carriers 13. The braider 300 has yarn carriers 31, latch quoits 32, gates 33, standard quoits 34, an inside plate 35, an outside plate 36 and horngears 8 (as in FIG. 3). The horngears 8 drive the yarn carriers 31 around the braider guided by the interlaced tracks 38 and 39.

Figure 12:
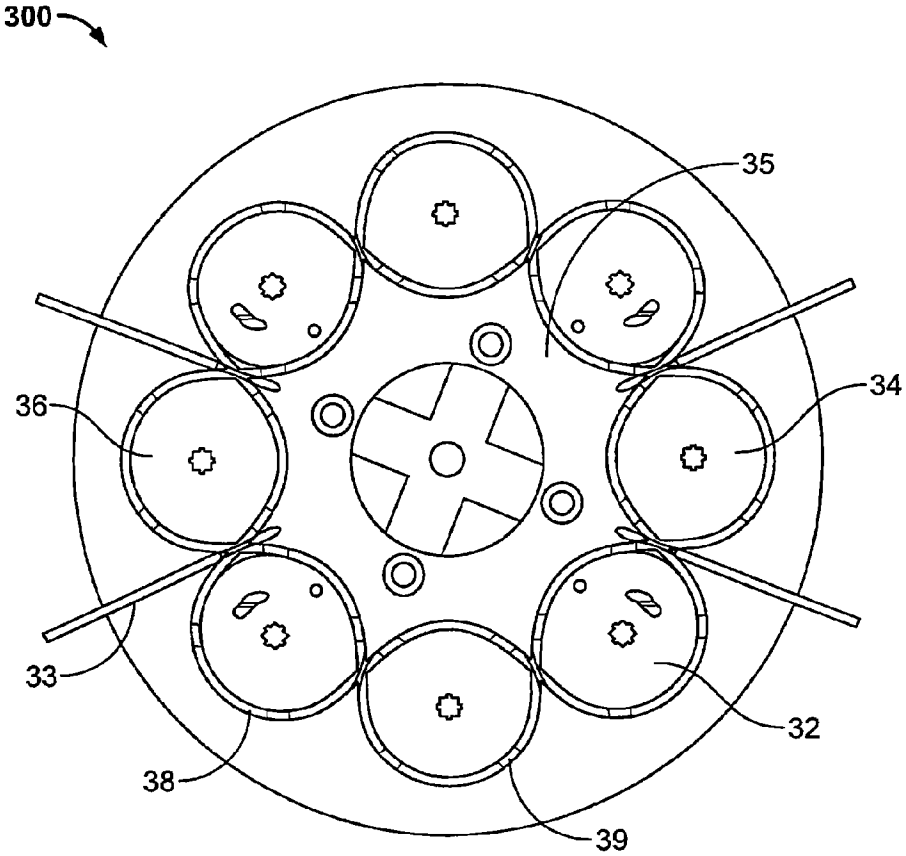
FIG. 12 is a plan view of a variation of the braider, including a different switching mechanism.

The layout and arrangement of the paths 38, 39 and the positions of the bobbin carriers 13 can be the same as discussed above with respect to FIGS. 1A-1C and 2A-2B. FIG. 12 shows the track configuration for the carriers in a non-bifurcating braid. The carriers 31 travel in two different intersecting tracks 38, 39 circulating in opposite directions resulting in the interlacing of the yarns.

Figure 13:
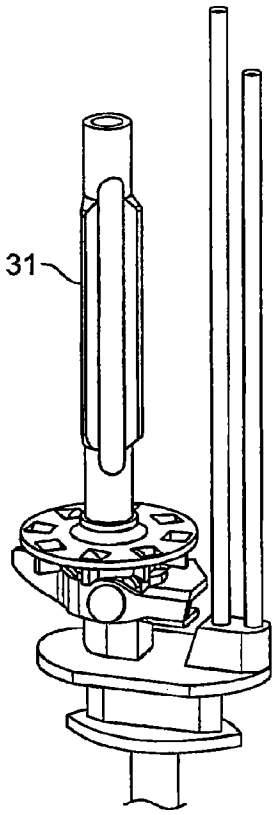
FIG. 13 is an isometric view of a bobbin carrier suitable for use in the braider of FIG. 12.

FIG. 13 shows a yarn carrier 31 for use with braider 300. The carrier 31 has a different foot from the carrier 7 shown in FIG. 4.

Figure 14:
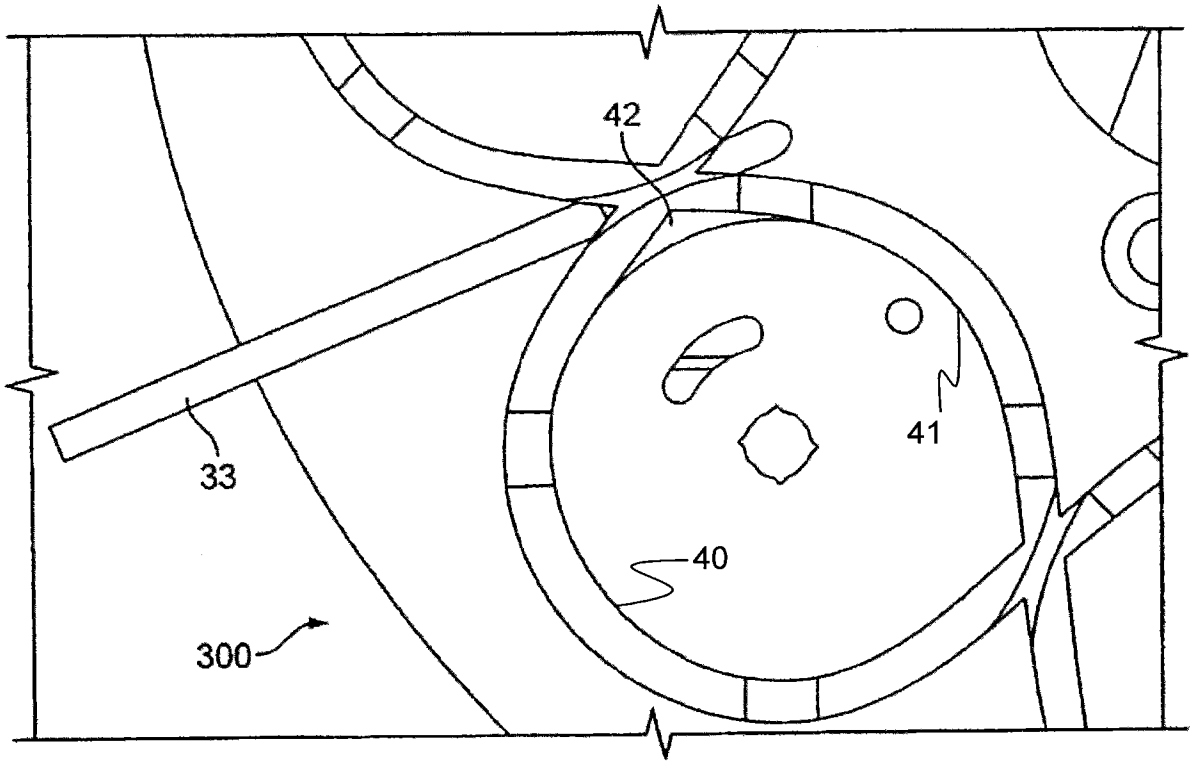
FIG. 14 shows a detail of the braider of FIG. 12, in the tubular braiding position.

FIG. 14 is a detail showing the position of the gate 33 and latch 42. By retracting the gate 33 and injecting the latch 42 the carriers are allowed to cross over the intersecting track.

Figure 15:
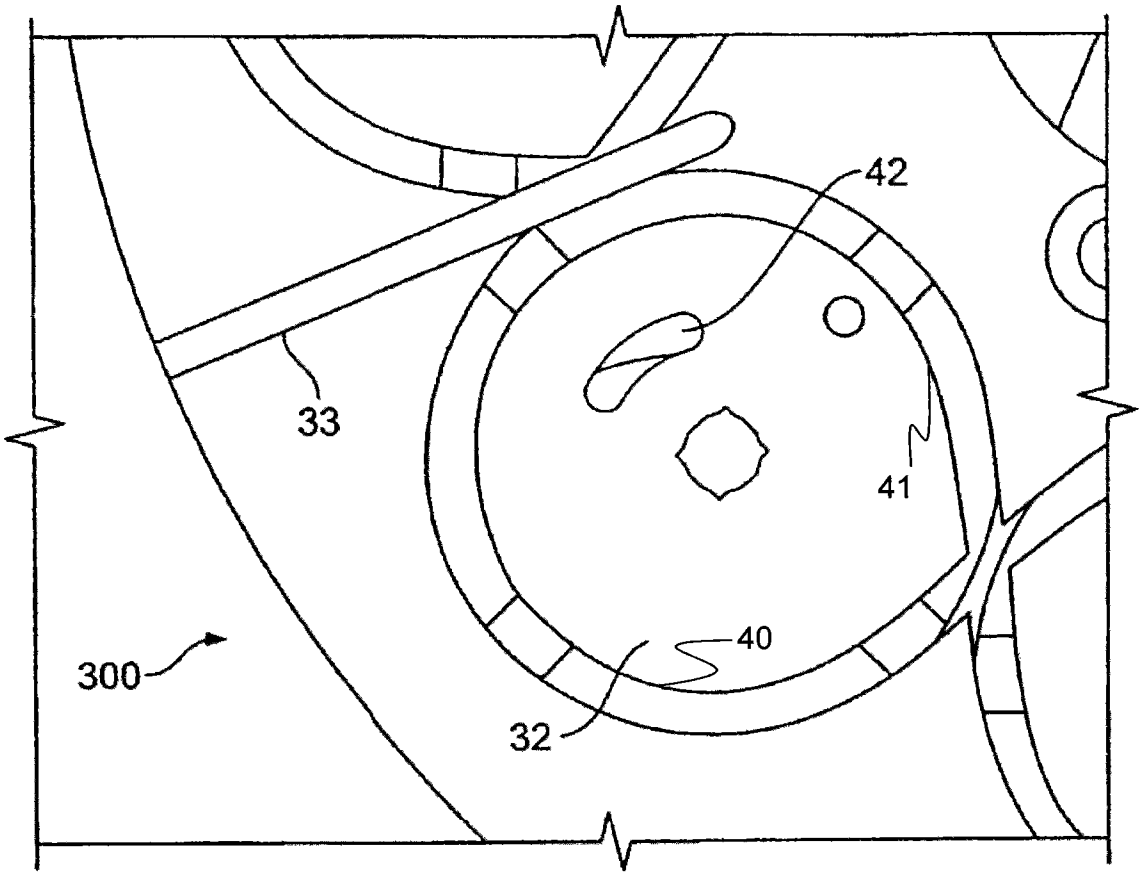
FIG. 15 shows a detail of the braider of FIG. 12, in the flat braiding position.

FIG. 15 detail shows the position of the gate 33 and latch 42. By injecting the gate 33 and retracting the latch 22 into the latch quoit 32 the carriers are forced into the loop tracks 40, 41 creating two separate braids.

Although FIGS. 12-15 do not show an actuator or linkage driving the insertion and retraction of the gates 33, one of ordinary skill can readily adapt any of a variety of mechanical means (e.g., a linear motor(s), air cylinder(s) or the like) to extend and retract the gates 33 to perform switching. A plurality of motors or cylinders may be provided, including one for each gate 33. Alternatively, one or two motors or cylinders may be used, with a linkage elements to cause the gates to move at the same time.

A structure and application of materials is disclosed herein, using braiding technology that can bifurcate from a base construction into more than one braid construction (bifurcation) and recombine at least two bifurcation constructions into one. The apparatus allows the horngear rotation speed and bobbin carrier translation speed to remain constant during tubular braiding, flat braiding and switching between the two modes.

In some embodiments, transitions among any two of the tubular or flat braiding modes is performed without interrupting the operation or speed of the system, without changing the rotation speed of the horngears, and without changing the speed of translation of any of the bobbin carriers. In other embodiments, the braider speed may optionally be reduced or stopped during the transition between braiding modes, but this is not a requirement.

The transition from one state to another (e.g., body braid to flat braid or flat braid to body braid) does not require a parts change. There is no need to swap out parts between the tubular and flat braiding modes. As described herein, the same apparatus can be used for flat braiding with an odd number of active horngears transporting carriers for each flat braid, as well as tubular braiding with an even number of active horngears transporting carriers. The transition between modes is performed automatically, without swapping out parts, or manually adding or removing a carrier to the configuration.

The examples described above use the bifurcation technology and include a flat braid using an even number of carriers divisible by four, thus extending braiding to a contiguous tubular (body) to flat to tubular (body) braid combination. A non-limiting example of an application of the braids produced by the above methods is provided in U.S. Provisional Patent Application No. 61/413,034, filed Nov. 12, 2010, which is incorporated herein by reference in its entirety. A variation of the apparatus is described below, providing additional options for the configuration of the braid it produces. In the examples below, the tubular sections are referred to as "body" and the flat sections are referred to as "arms" for brevity.

Figure 17:
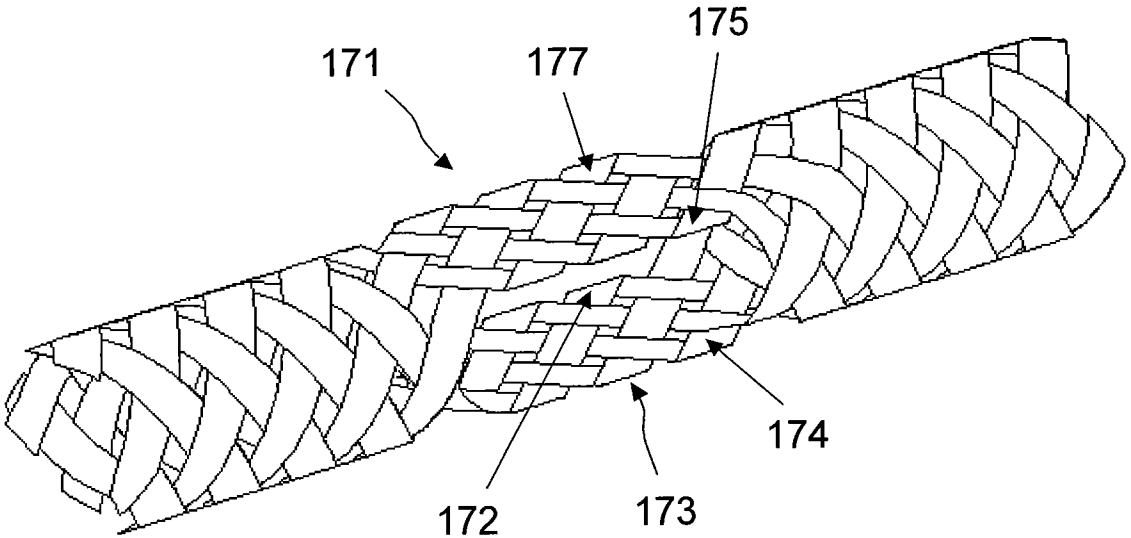
FIG. 17 is an isometric view of a braid formed by an exemplary apparatus.

FIG. 17 is a schematic of a bifurcation configuration with two bifurcation arms, 171 and 173, created by activating two pairs of bifurcation bridges 19. In this configuration the yarns 177 and 175 are at the edges of bifurcation arm 171 and yarns 174 and 172 are at the edges of bifurcation arm 173. This configuration may be provided using the bifurcation bridge configuration shown in FIG. 10, which simultaneously reconfigures the track from one closed loop (FIG. 5A) to form two separate closed loops (FIG. 5B), which do not intersect each other, and to cause a reversal of direction at the ends of each of the separate closed loops.

Although the example of FIG. 17 shows a flat braiding section having two braids with equal numbers of yarns, in other embodiments, the number of flat braids may differ from section to section (e.g., 1, 2 and/or 4 flat braids in a single section). Also, the number of yarns in a flat braid may vary from section to section.

Figure 18:
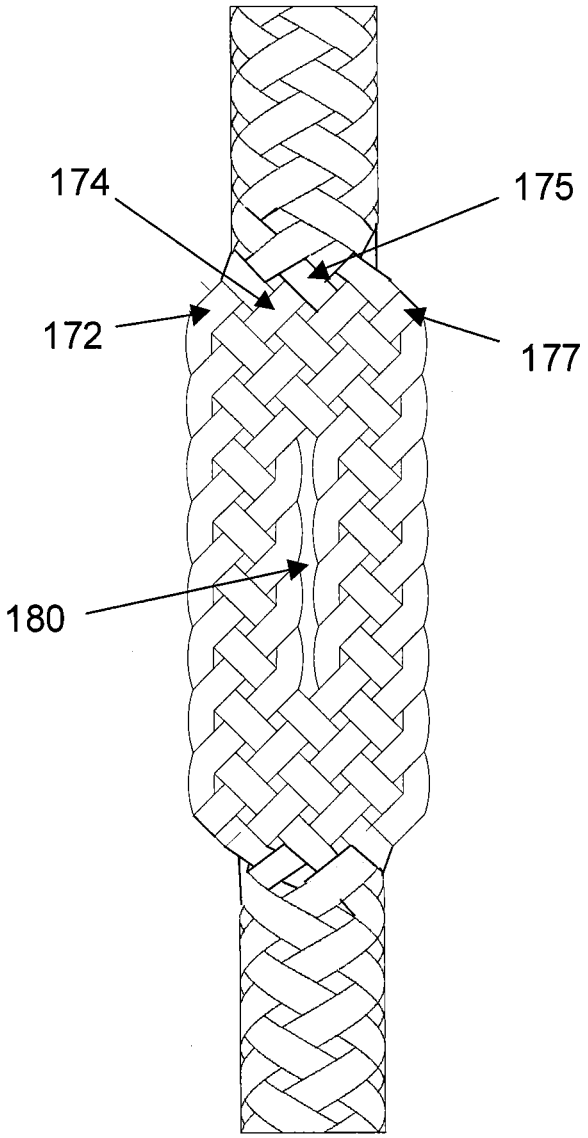
FIG. 18 is a diagram of a braid having the same number of yarns in the flat braided sections as in the tubular body section.
Figure 19:
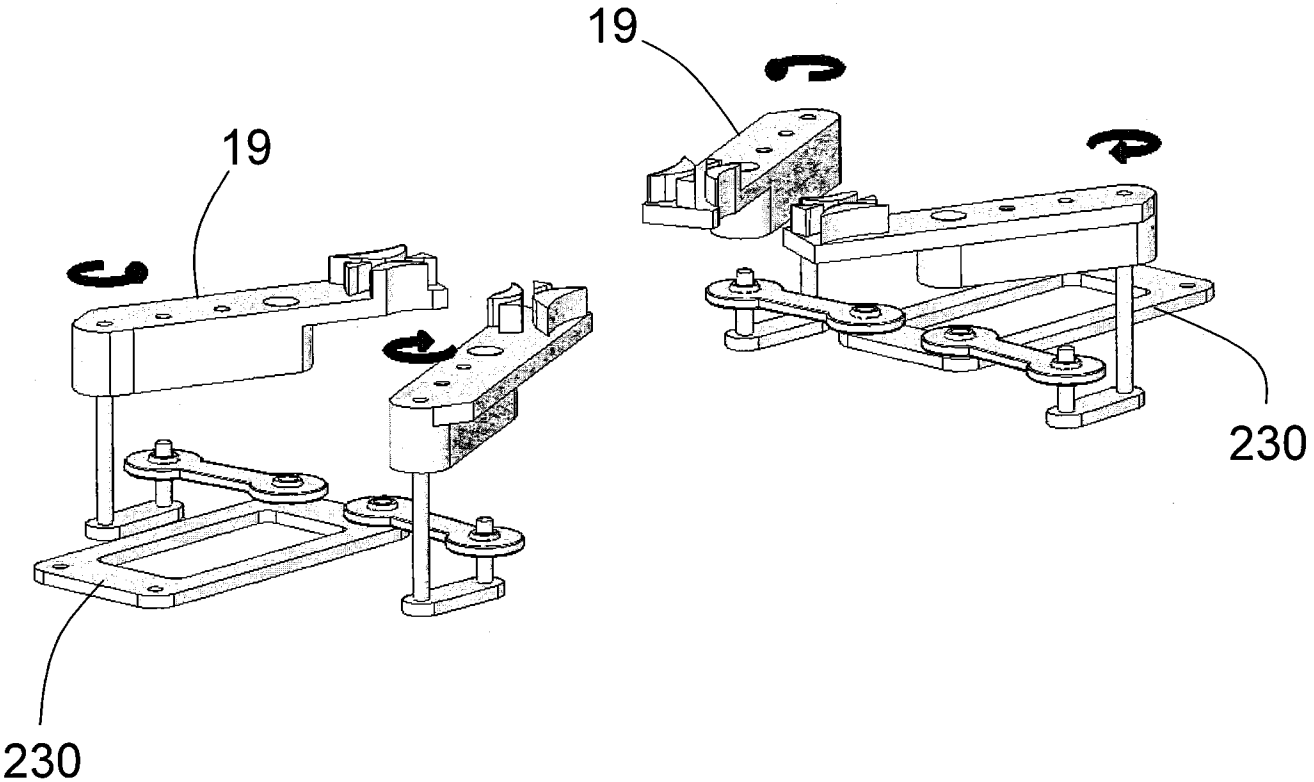
FIG. 19 is a diagram of a bridge apparatus for making the braid of FIG. 18.

FIG. 19 shows a variation of the apparatus, which allows bifurcation mechanisms 16 to be controlled independently of each other, so that zero, one or two bridge sections 19 may be activated. By activating only one pair of bridge sections 19 and interweaving yarns 174 and 175 the edge of bifurcation arm 171 and bifurcation arm 173 are brought together creating a continuous flat braid using the same number of yarns as in the body braid, as shown in FIG. 18. For example, by activating only one pair of bridge sections 19, a single track is formed which encompasses seven of the eight horngears 8*a*-8*f* and 24*a*, with reversal of direction at horngears 8*c* and 8*d* as best seen in FIG. 23*b*. Only horngear 24*b* is removed from the track in this configuration.

Also, in some embodiments, by controlling when the interweaving is operating, a bifurcation in the flat braid 180 can be braided.

Mechanically, in order to execute this process, the bifurcation mechanism as described above with reference to FIGS. 3 and 10 is modified. The bridge activation mechanism is separated so each pair of bridges 19 can be switched independently of the other pair of bridges. Each pair of bridges 19 is configured to automatically remove one respective horngear 24*a* or 24*b* from the track. The one horngear does not transport carriers for the duration of the braiding of a particular section, after which the bridge can automatically return it to the track, to transport carriers while braiding another section of the braid. Also added are mechanisms that are capable of restraining selected hornplates of the horngears from rotating while the gears rotate.

FIG. 19 shows separate bridge drive links 230 that replace the single drive link 29. The driving force for these independent drive links 230 can be applied similar as before such as linear motor, air cylinder, cam, crank or the like. However each is independently activated allowing the capability of selection of bridge pairs to operate during the braiding process. This can be programmed to be any or all pairs of bridges to operate at one time depending on the braid configuration desired. Although FIG. 19 shows two bridge mechanisms, other configurations may have other numbers of bridge mechanisms (e.g., 3, 4, 8 or 16).

Figure 20:
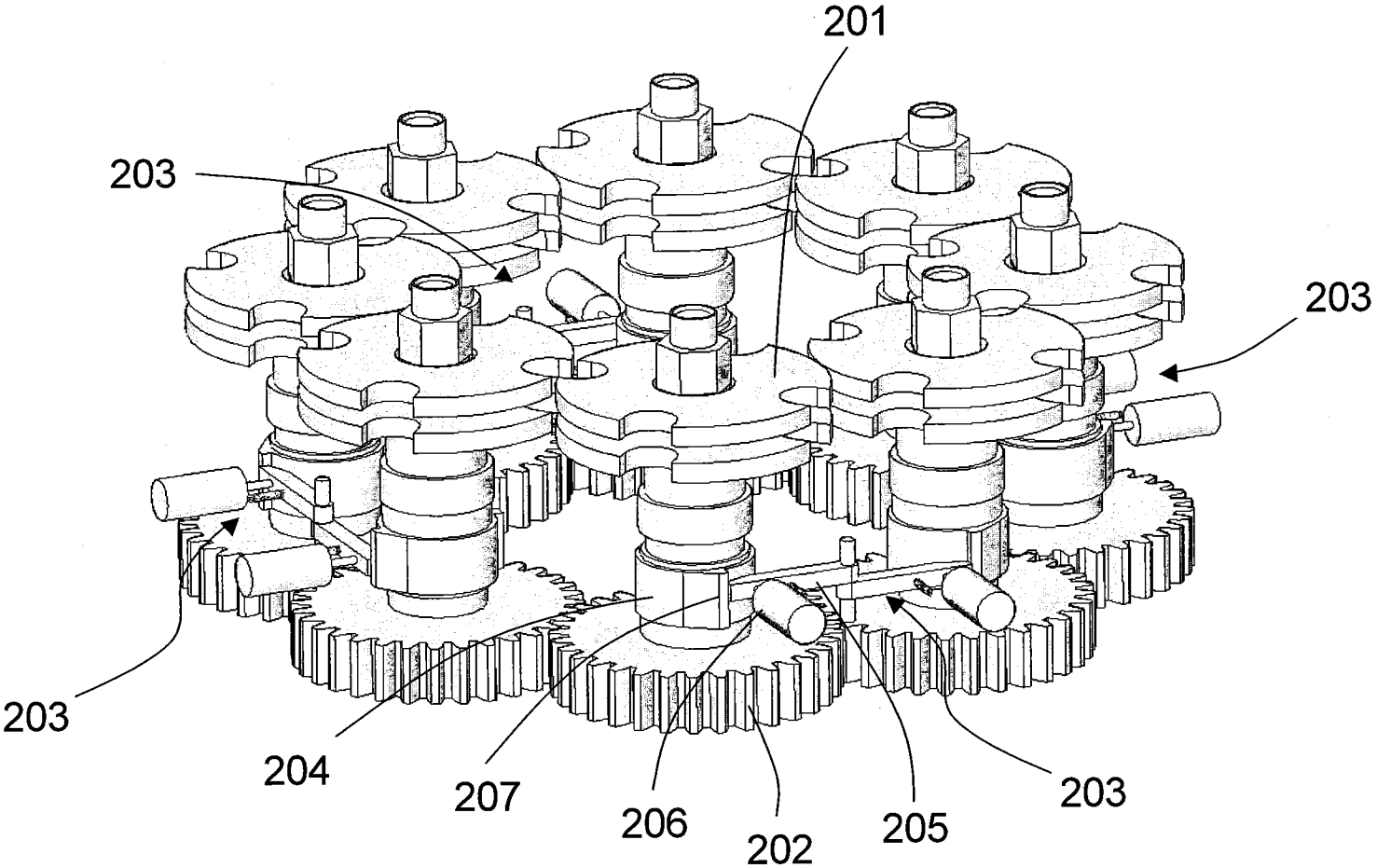
FIG. 20 is a diagram of the horngears of an exemplary braider for making the braid of FIG. 18.

FIG. 20 shows the arrangement of the added mechanisms for hornplate rotation control. Wrap spring clutch/brake mechanisms 204 may be used to separate input drive of the gears 202 from output drive of the hornplates 201. Wrap spring clutch/brake mechanisms 204 use an internal coil spring to link the input, for instance gear 202, to the separate output, for instance hornplate 201. A second internal coil spring acts as a brake to restrain the output from rotating, for instance hornplate 201, when the input, for instance gear 202, is driving. However other mechanisms (e.g., other one-way clutch arrangements) that perform a similar function could be used.

The wrap spring clutch/brake and activation mechanisms 203 are applied to each pair of horngears. For clarity, plates, bridges, drive links are not shown. At a programmed position in the braid cycle, the clutch pawl forcer 206 is activated, pushing the clutch pawl 205 in to engage with the wrap spring clutch/brake mechanism tang 207 restricting the wrap spring clutch/brake mechanisms 204 from rotating. The forcer can be solenoid, air cylinder, linear motor or the like. This action allows the related drive gear 202 to continue to rotate while the related hornplate 201 is held stationary by the internal brake of the clutch/brake mechanism 204. As shown in FIG. 22*d* and FIG. 22*e*, this operation is active for a 180° in order for the carriers B and G to exchange positions. The clutch pawl 205 is then withdrawn, engaging the drive gear 202 with the hornplate 201 allowing the carriers to advance. As each clutch pawl is individually activated, the control as to which ones are activated can be programmed depending on the braid configuration required.

Figure 21:
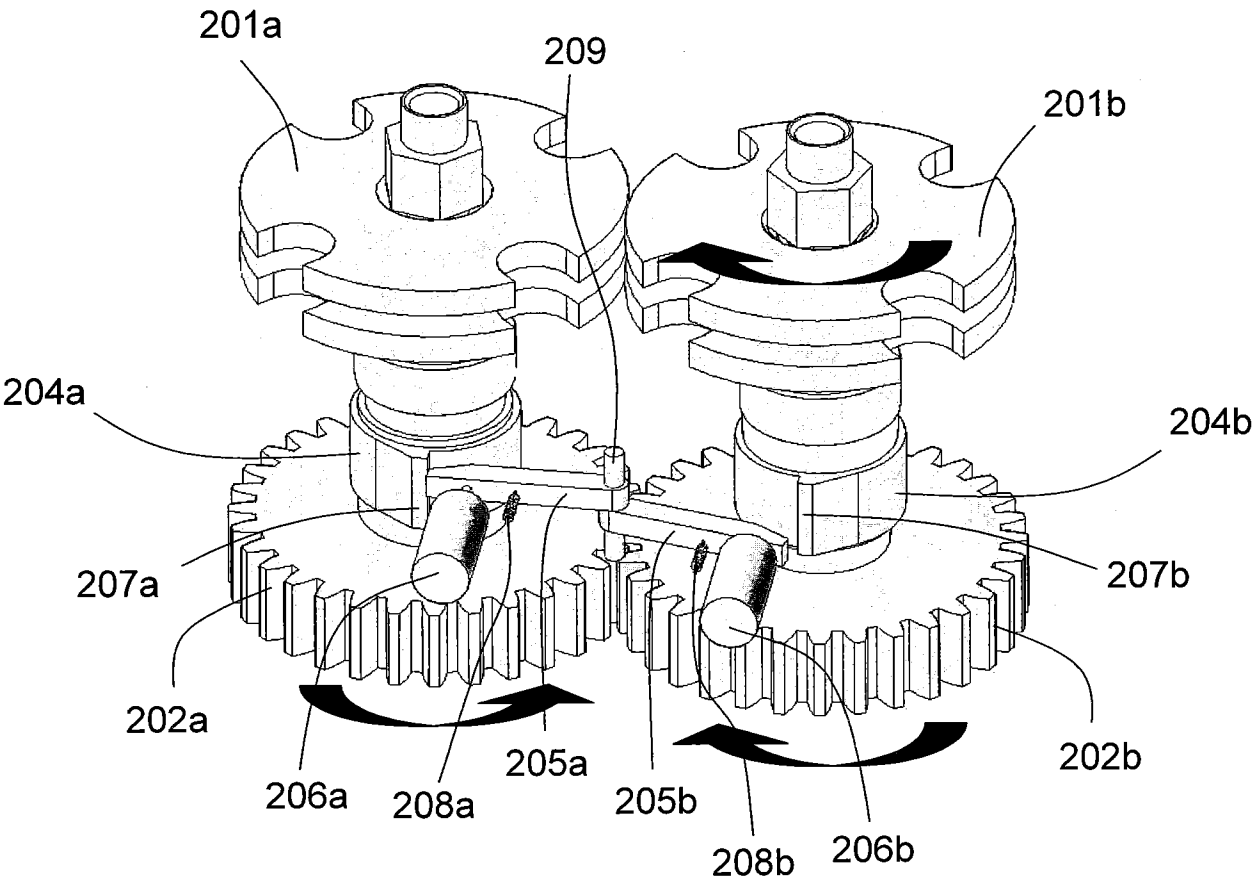
FIG. 21 is a detail diagram showing two of the horngears of FIG. 20 in different operating states from each other.

FIG. 21 shows detail of how the rotation control operates. For clarity, the support structure for the clutch pawl forcer 206, the clutch pawl pin 209 and the clutch pawl return springs 208*a*, 208*b* is not shown. However, the support structure itself can be mounted to the outside track 13. The wrap spring clutch/brake mechanism 204*a* for the hornplate 201*a* and gear 202*a* and wrap spring clutch/brake mechanism 204*b* for the hornplate 201*b* and gear 202*b* are shown. As shown, clutch pawl 205*a* has been activated by clutch pawl forcer 206*a* so the clutch pawl 205*a* has engaged wrap spring clutch/brake tang 207*a* restricting the rotation of the wrap spring clutch/brake mechanism 204*a* and thus disengaging gear 202*a* from hornplate 201*a*. Gear 202*a* can rotate while hornplate 201*a* remains stationary. Also as shown, clutch pawl 205*b* has been deactivated by clutch pawl forcer 206*b* and retracted by spring 208*b* so the clutch pawl 205*b* has disengaged from wrap spring clutch/brake tang 207*b* allowing the rotation of the wrap spring clutch/brake mechanism 204*b* and thus engaging gear 202*b* with hornplate 201*b* allowing hornplate 201*b* to rotate with gear 202*b*.

FIGS. 22*a*-22*f* are schematic diagrams showing how the interweaving of the edges is accomplished. In FIGS. 22*a*-22*f*, the carrier C relates to yarn 172 in FIG. 18, carrier F relates to yarn 177 in FIG. 18, carrier B relates to yarn 175 in FIG. 18, carrier G relates to yarn 174 in FIG. 18.

FIG. 22*a* (Step 1) shows the configuration for body braiding with both of the bifurcation bridges (dotted lines) 210 deactivated. The carriers follow the tracks 14 and 15 shown in FIG. 2A (and FIG. 23*a*).

In FIG. 22*b*, (Step 2), when the bridges are free to operate (i.e., when the horns 24*a*, 24*b* between the pairs of bridge arms 16 are not currently engaging any of the yarn carriers A-G), one set of bifurcation bridges (solid lines) 211 is activated. This removes one of the horns 24*b* from the path followed by the yarn carriers A-G. The carriers follow the track 212 shown in FIG. 23*b*.

FIG. 22*c* (Step 3) shows carriers C and F rotating back for one edge of the flat braid while carriers G and B rotate to a position where the horngears, 8*a*, 24*a* and 8*f* collectively only contain carriers G and B.

In FIGS. 22*d* and 22*e* (Steps 4 and 5, respectively) the wrap spring clutch/brake mechanisms 204 for horngears 8*b*, 8*c*, 24*b*, 8*d*, 8*e* are activated by engaging their associated clutch pawls 205. This stops the rotation of their hornplates 201 from their associated gears 202. Therefore only the hornplates of horngears 8*a*, 24*a* and 8*f* rotate. These horngears 8*a*, 24*a* and 8*f* then rotate by an angle of 180 degrees in this configuration, causing carriers G and B to swap positions, making yarn 174 pass behind yarn 175 and thus interweaving the edge of the bifurcation arms. Thus, the sub-assembly including horngears 8*a*, 24*a* and 8*f* is referred to below as a "swap segment". At the conclusion of step 5 (FIG. 22*e*), the positions of carriers G and B are the reverse of their relative positions in FIG. 22*c*.

In FIG. 22*f* (Step 6), when horngears 8*a*, 24*a* and 8*f* complete the 180 degree rotation, the wrap spring clutch/brake mechanisms 204 for horngears 8*b*, 8*c*, 24*b*, 8*d*, 8*e* are deactivated by disengaging their associated clutch pawls 205. This allows the rotation of their hornplates 201 with their associated gears 202 and brings the carriers into the same relative position as in FIG. 22*a* (Step 1). That is, the locations in inertial space where carriers are located are the same as in FIG. 22*a*, although the specific carrier in each of those positions has changed.

By independently controlling the bifurcation bridges and independently programming the horngears it is possible to create a flat braid with bifurcation 180 as shown in FIG. 18.

Figure 23C:
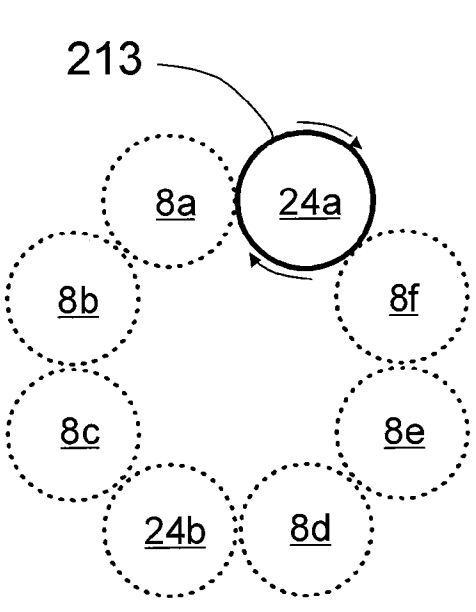
FIGS. 23*a*-23*c* show the track configurations used by the apparatus of FIGS. 22*a*-22*f*.
Figure 23B:
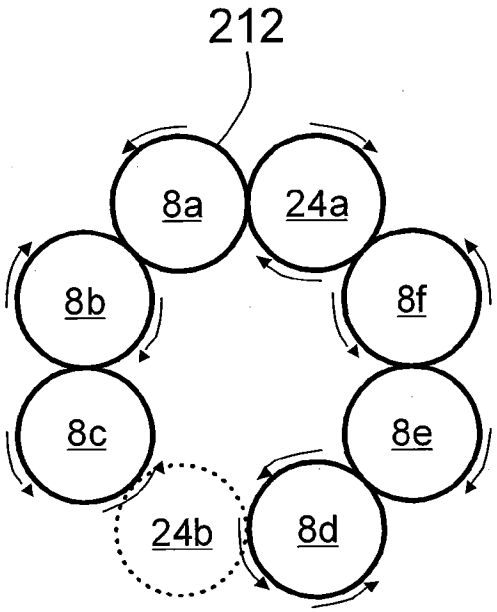
Figure 23A:
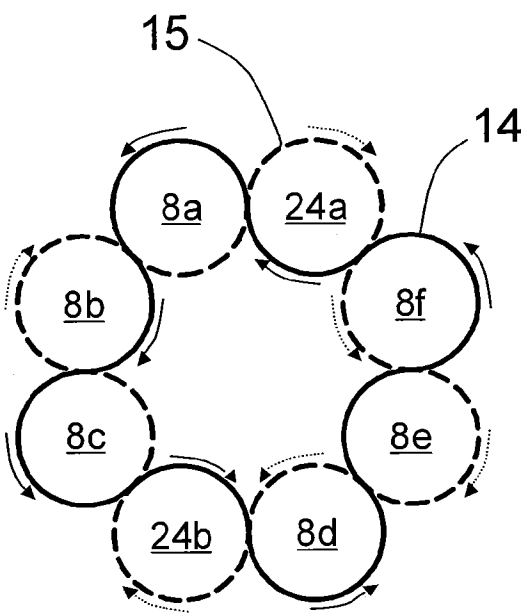

FIGS. 23*a*-23*c* summarize the two different tracks followed by the various carriers in the sequence of FIGS. 22*a*-22*f*. FIG. 23*a* shows the two paths for a body braid, with no bridges or wrap spring clutch/brake mechanisms 204 activated. Path 15 is the clockwise direction path and path 14 is the counterclockwise direction path.

FIG. 23*b* shows the single path 212 for a flat braid. The bifurcation bridges determine which horngears are completely excluded from the path through which the carriers move. In this case, only the bridge pair 211 around horngear 24*b* is activated.

FIG. 23*c* shows the path 213 used to swap the carriers B and G. The wrap spring clutch/brake mechanisms 204 are used to determine for which horngears the respective hornplates are temporarily disengaged from the rotation of their respective gears. In general, the positions of two carriers are swapped while the hornplate on which they are both currently positioned rotates 180 degrees. That one hornplate and the two adjacent hornplates on either side are controlled to rotate (by keeping their wrap spring clutch/brake mechanisms 204 de-activated), while the hornplates of any horngears not involved in a position swap do not rotate. For any horngear not involved in a position swap, the respective wrap spring clutch/brake mechanisms 204 is activated to prevent rotation of the respective hornplates.

Figure 24A:
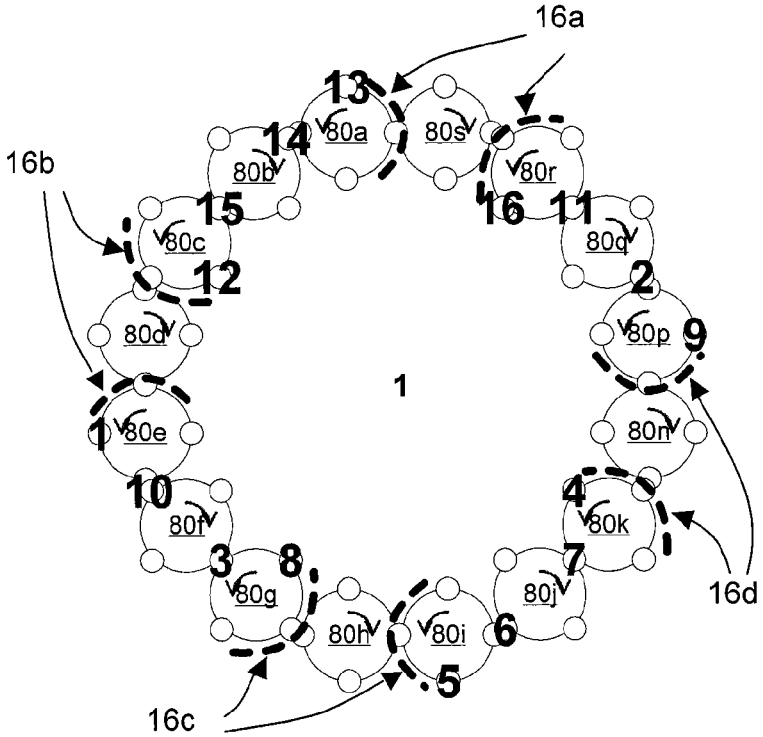
FIGS. 24*a*-24*f* are diagrams showing bridge and carrier states for a braid having a tubular section and a flat section each having 16 yarns.

This process can be extended to as many carriers as desired provided the number of carriers is divisible by 4. FIGS. 24*a*-24*f* show the steps for a 16-end body to flat to body braid using 4 sets of bifurcation bridges 16*a*-16*d*. In FIG. 24*a* (Step 1), none of the bridges 16*a*, 16*b*, 16*c*, 16*d* are active and all of the horngears 80*a*, 80*b*, 80*c*, 80*d*, 80*e*, 80*f*, 80*g*, 80*h*, 80*i*, 80*j*, 80*k*, 80*n*, 80*p*, 80*q*, 80*r*, 80*s* are rotating creating a body braid.

Figure 24B:
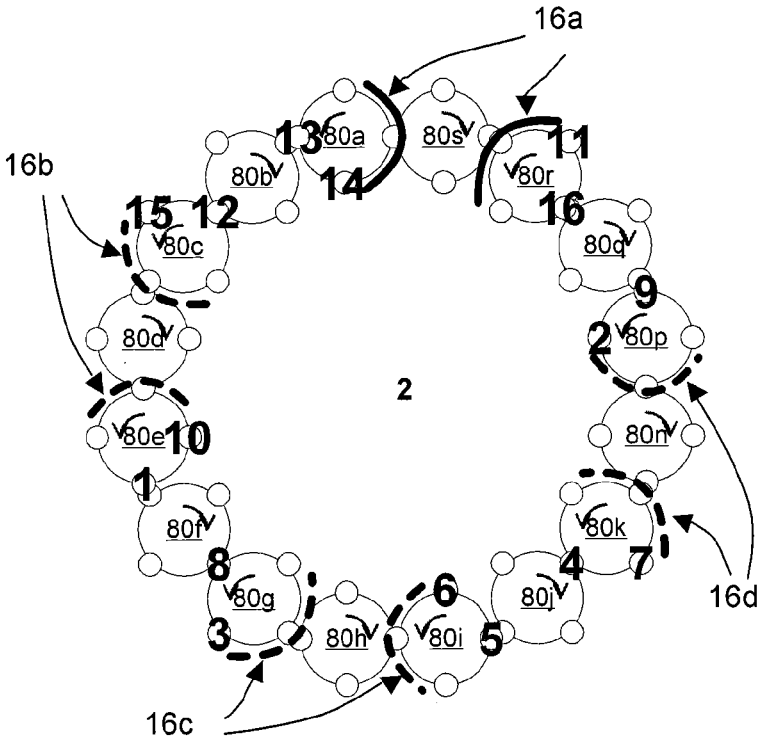
Figure 24C:
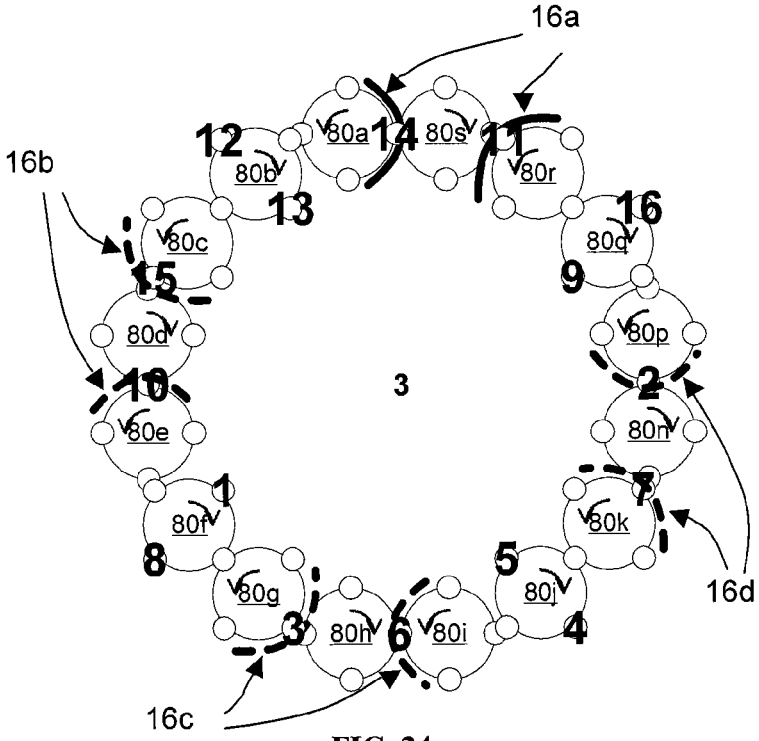

In FIG. 24*b* (Step 2), bridge 16*a* is active and all the horngears are active. In FIG. 24*c* (Step 3), carriers 11 and 14 are being guided by the bridges 16*a* to reverse to form the outside edges of the flat braid.

Figure 24D:
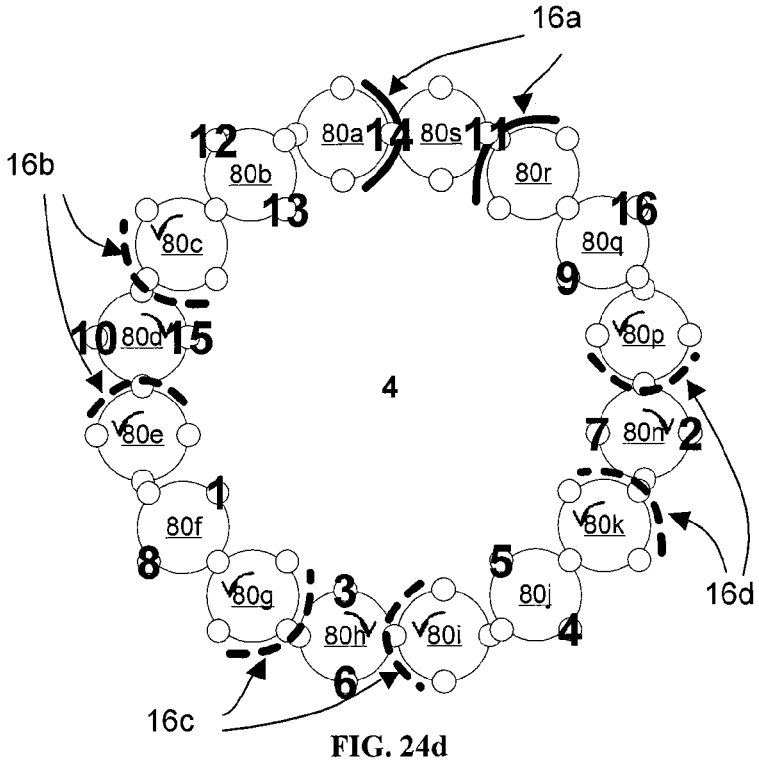
Figure 24E:
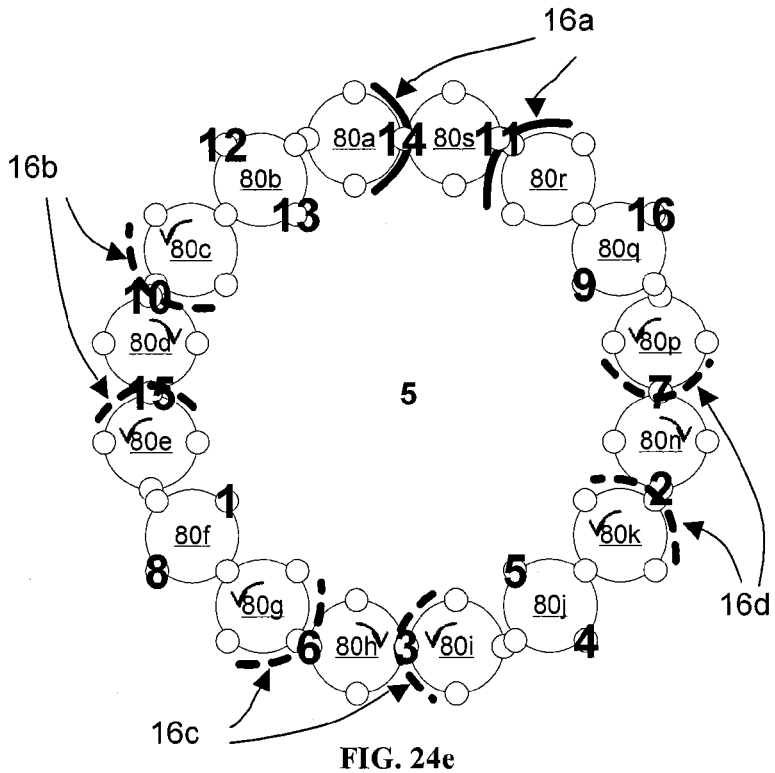

In FIGS. 24*d* and 24*e* (Step 4 and 5), the wrap spring clutch/brake mechanisms 203 for horngears 80*a*, 80*b*, 80*f*, 80*j*, 80*q*, 80*r*, 80*s* are active so that the hornplates of horngears 80*a*, 80*b*, 80*f*, 80*j*, 80*q*, 80*r*, 80*s* are disengaged (do not rotate). Horngears 80*c*, 80*d*, 80*e*, 80*g*, 80*h*, 80*i*, 80*k*, 80*n*, 80*p* continue to rotate making carrier 10 switch positions with carrier 15, carrier 3 switch positions with carrier 6, carrier 2 switch positions with carrier 7.

Figure 24F:
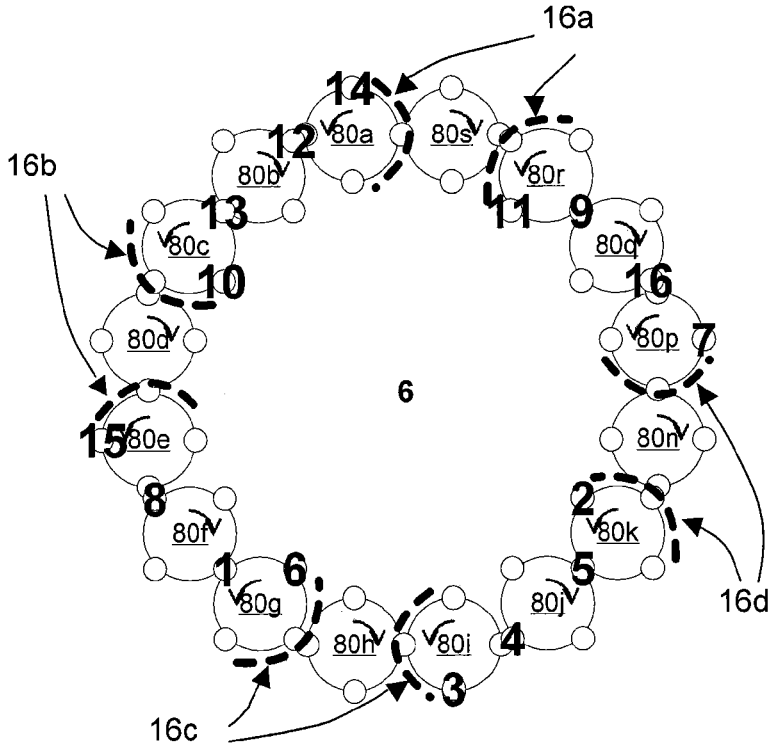

In FIG. 24*f* (Step 6), the wrap spring clutch/brake mechanisms 203 for horngears 80*b*, 80*f*, 80*g*, 80*h*, 80*i*, 80*j*, 80*q* are inactive allowing all the horngears to rotate and all the bridges 16*a*, 16*b*, 16*c*, 16*d* are inactive with the carriers in the same position as Step 1.

Figure 25A:
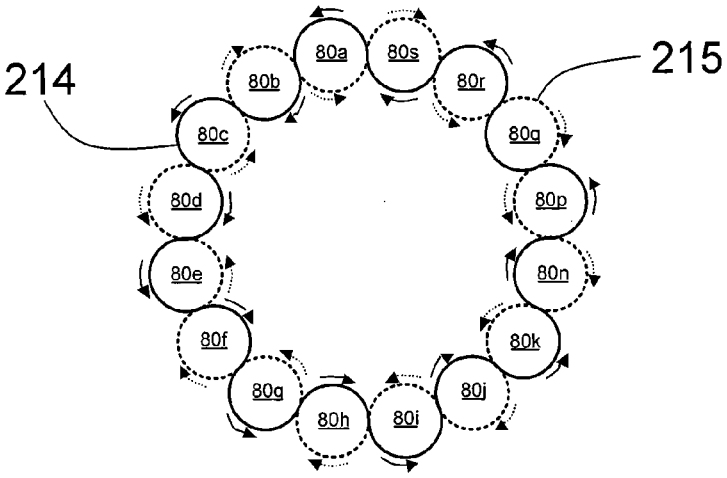
FIGS. 25*a*-25*c* show the track configurations used by the apparatus of FIGS. 24*a*-24*f*.
Figure 25B:
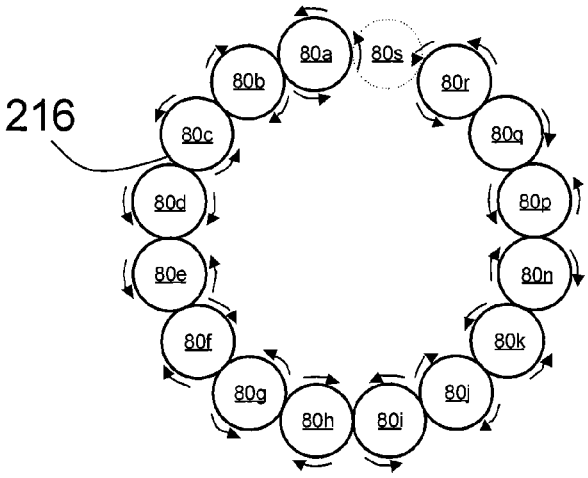
Figure 25C:
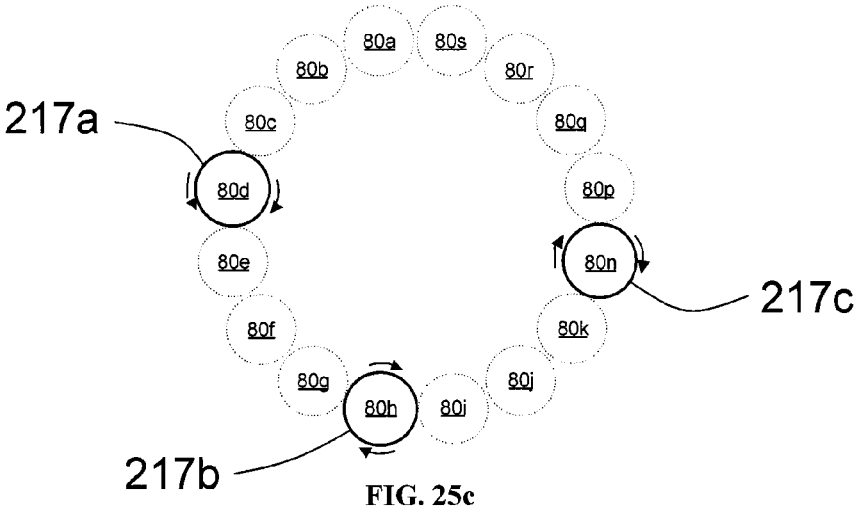

FIG. 25*a* shows the 2 paths for a 16-end body braid. Path 214 is the counterclockwise direction for the carriers and path 215 is the clockwise direction for the carriers. FIG. 25*b* show the path 216 at the start of the 16-end flat braid and FIG. 25*c* shows the 3 paths 217*a*, 217*b*, 217*c* used to swap the carriers.

Figure 26:
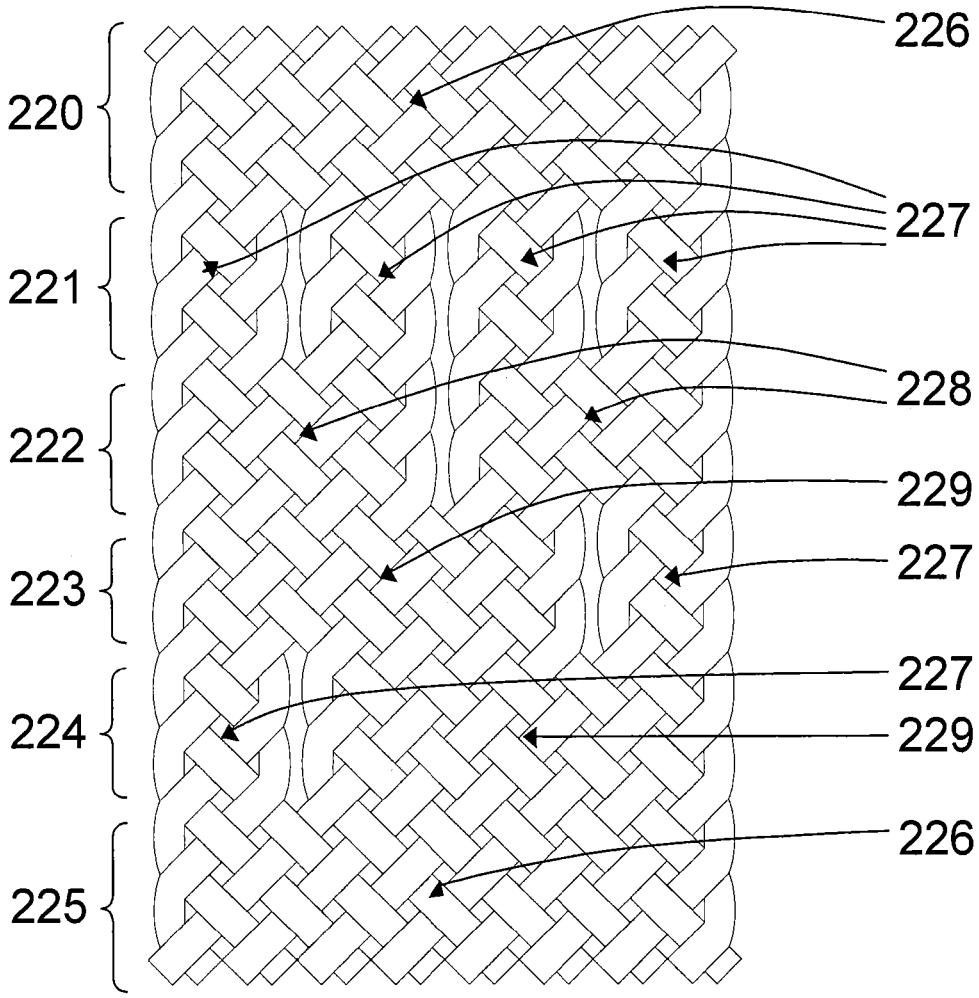
FIG. 26 shows a continuous flat braid having five different flat braid configurations.

By controlling the bridges and the shifting of the horngears with 16 carriers, multiple configurations of grouping of all 4 bifurcation arms can be created. FIG. 26 shows an example of multiple combinations: four equal flat braids, two equal flat braids and two combinations of two unequal flat braids. These can be combined in any or all configurations depending on the specific application.

Figure 27:
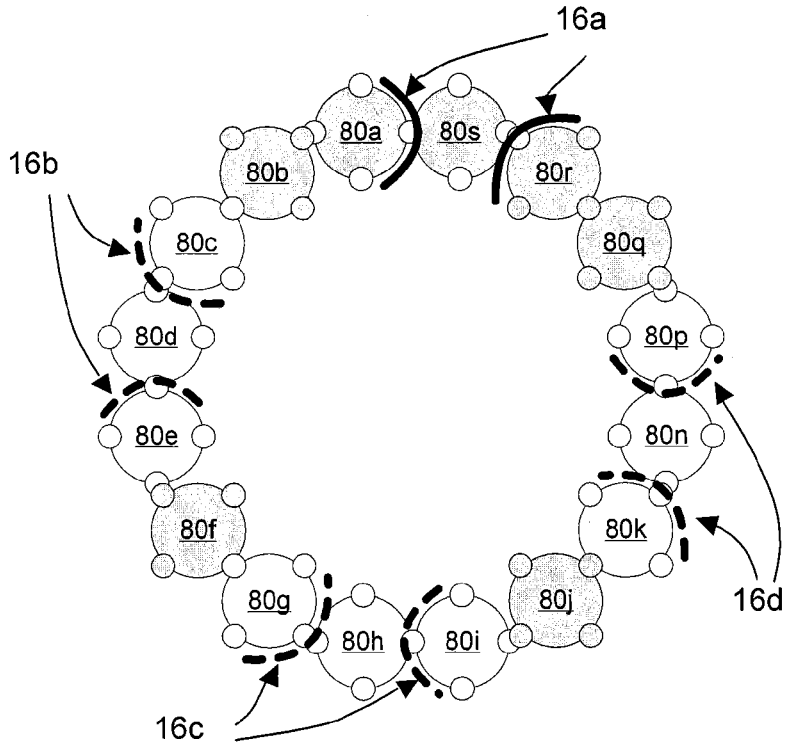
FIGS. 27-31 are diagrams showing bridge and carrier states for the five different flat braid configurations shown in FIG. 26.

Referring to FIG. 26 and FIG. 27, section 220 is a schematic of a 16-end flat braid 226 made by activating bridge 16*a* and horns 80*c*, 80*d*, 80*e*, 80*g*, 80*h*, 80*i*, 80*k*, 80*n*, 80*p*. FIG. 27 shows the configuration of active bridges and thus, by activating only a single bridge 16*a*, a flat braid section having the same number of yarns as the body braid section can be formed. In FIG. 27, the horns of horngears 80*a*, 80*b*, 80*f*, 80*j*, 80*q*, 80*r*, and 80*s* are shaded, indicating that during a position-swap, the wrap spring clutch/brake mechanisms 204 of these horngears are activated, to prevent the hornplates from rotating, while the hornplates of the non-shaded horngears 80*c*, 80*d*, 80*e*, 80*g*, 80*h*, 80*i*, 80*k*, 80*n* and 80*p* rotate 180 degrees to achieve the position swap.

Figure 28:
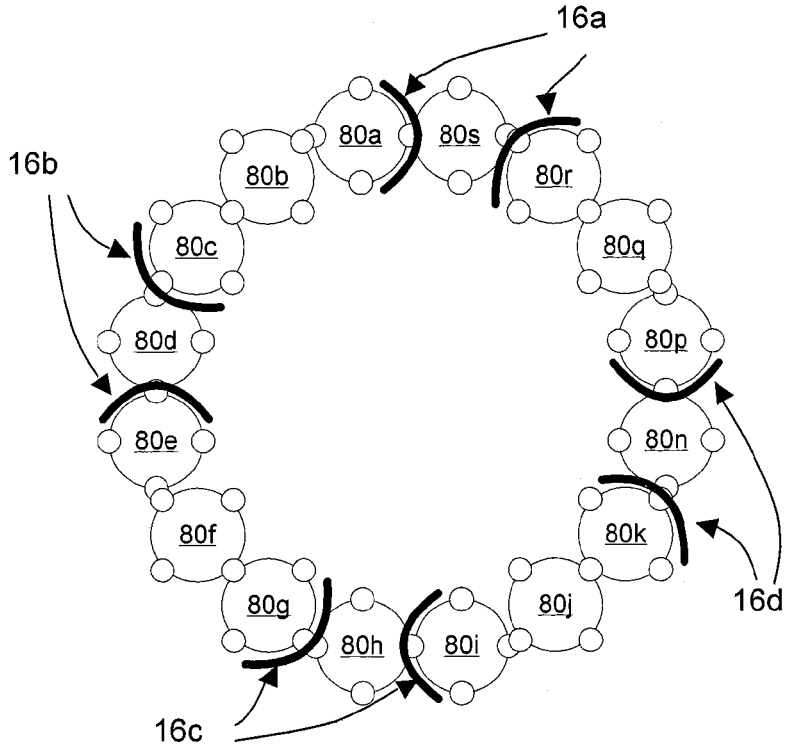

Referring to FIG. 26 and FIG. 28, section 221 is a schematic of four 4-end flat braids 227 made by activating bridges 16*a*, 16*b*, 16*c*, 16*d* and all horns, 80*a*, 80*b*, 80*c*, 80*d*, 80*e*, 80*f*, 80*g*, 80*h*, 80*i*, 80*j*, 80*k*, 80*n*, 80*p*, 80*q*, 80*r*, 80*s*. In FIG. 28, none of the horngears is shaded, indicating that during a position swap, none of the wrap spring clutch/brake mechanisms 204 are activated, and all of the hornplates are engaged to rotate with their respective gears.

Figure 29:
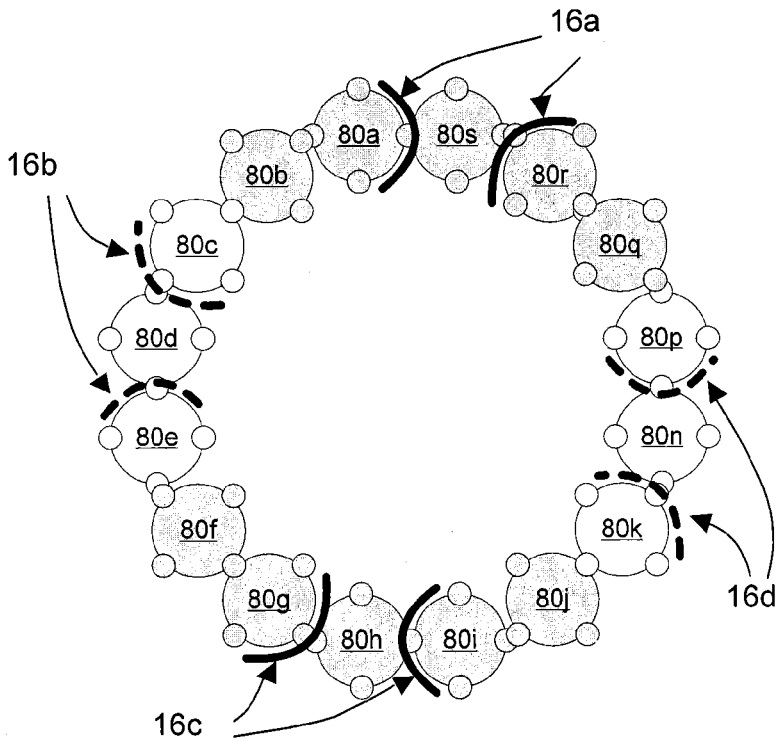

Referring to FIG. 26 and FIG. 29, section 222 is a schematic of two 8-end flat braids 228 made by activating bridges 16*a*, 16*c* and horns 80*c*, 80*d*, 80*e*, 80*k*, 80*n*, 80*p*. In FIG. 29, the hornplates of horngears 80*a*, 80*b*, 80*f*, 80*g*, 80*h*, 80*i*, 80*j*, 80*q*, 80*r* and 80*s* are shaded, indicating that during a position-swap, the wrap spring clutch/brake mechanisms 204 of these horngears are activated, to prevent the hornplates from rotating, while the hornplates of the non-shaded horngears 80*c*, 80*d*, 80*e*, 80*k*, 80*n* and 80*p* rotate 180 degrees to achieve the position swap.

Figure 30:
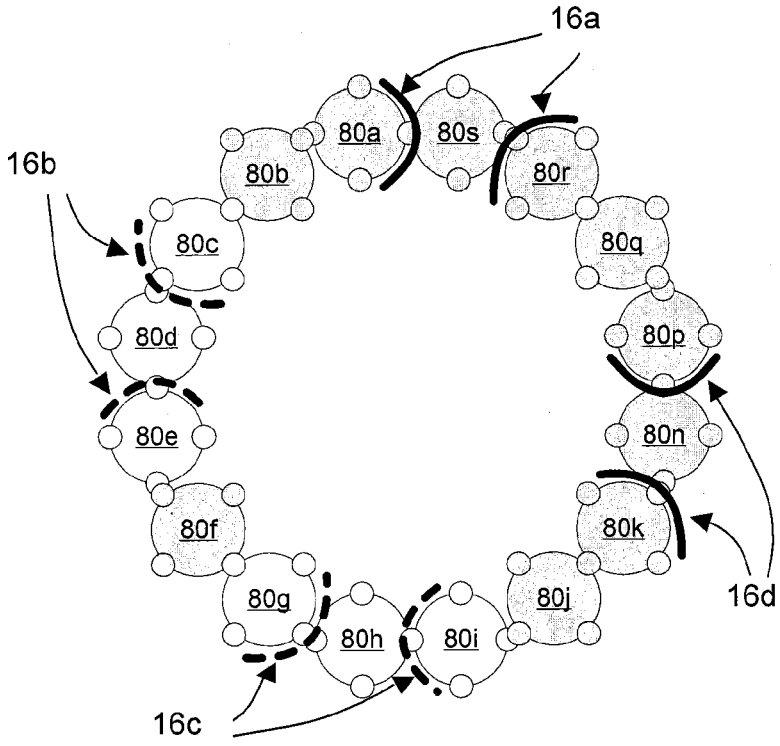

Referring to FIG. 26 and FIG. 30, section 223 is a schematic of one 12-end flat braid 229 and one 4-end flat braid 227 made by activating bridges 16*a*, 16*d* and horns 80*c*, 80*d*, 80*e*, 80*g*, 80*h*, 80*i*. In FIG. 30, the hornplates of horngears 80*a*, 80*b*, 80*f*, 80*g*, 80*h*, 80*i*, 80*j*, 80*q*, 80*r*, and 80*s* are shaded, indicating that during a position-swap, the wrap spring clutch/brake mechanisms 204 of these horngears are activated, to prevent the hornplates from rotating, while the hornplates of the non-shaded horngears 80*c*, 80*d*, 80*e*, 80*k*, 80*n* and 80*p* rotate 180 degrees to achieve the position swap.

Figure 31:
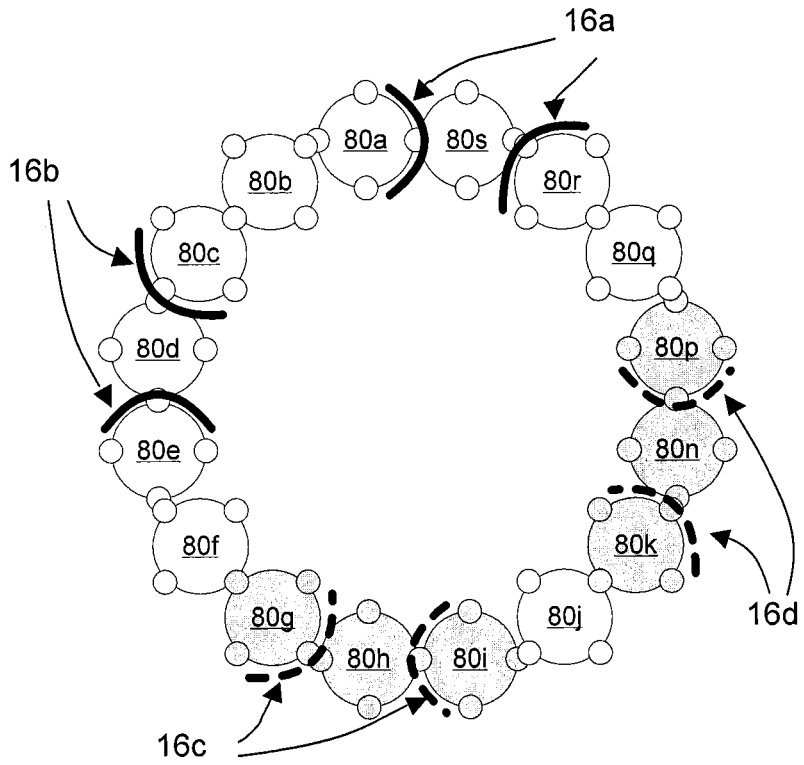

Referring to FIG. 26 and FIG. 31, section 224 is a schematic of one 4-end flat braid 227 and one 12-end flat braid 229 made by activating bridges 16*a*, 16*b* and horns 80*g*, 80*h*, 80*i*, 80*k*, 80*n*, 80*p*. In FIG. 31, the hornplates of horngears 80*a*, 80*b*, 80*f*, 80*j*, 80*k*, 80*n*, 80*p*, 80*q*, 80*r*, and 80*s* are shaded, indicating that during a position-swap, the wrap spring clutch/brake mechanisms 204 of these horngears are activated, to prevent the hornplates from rotating, while the hornplates of the non-shaded horngears 80*c*, 80*d*, 80*e*, 80*g*, 80*h*, and 80*i*, rotate 180 degrees to achieve the position swap.

Referring again to FIG. 26 and FIG. 27, section 225 is a schematic of a 16-end flat braid 226 made by activating bridge 16*a* and allowing hornplates 80*c*, 80*d*, 80*e*, 80*g*, 80*h*, 80*i*, 80*k*, 80*n*, and 80*p* to rotate 180 degrees during a position swap (while activating the wrap spring clutch/brake mechanisms of horngears 80*a*, 80*b*, 80*f*, 80*j*, 80*q*, 80*r*, and 80*s* to stop rotation of their respective hornplates). Thus, the same configuration of rotating and stationary hornplates is used as described above regarding formation of section 220.

Thus, the same apparatus is capable of braiding a section having two or more flat braids with unequal numbers of yarns. Such a section can be formed in a continuous braid, adjacent to a tubular (body) braid section or adjacent to another flat braid section having a different configuration of flat braids with equal or unequal number of yarns. In some embodiments, all of these transitions are made without interrupting the operation or speed of the system, without changing the rotation speed of the horngears, without changing the speed of translation of any of the bobbin carriers, and without a parts change. There is no need to interrupt braiding or swap out parts between the tubular and flat braiding modes, or between two different flat braiding modes.

Figure 32:
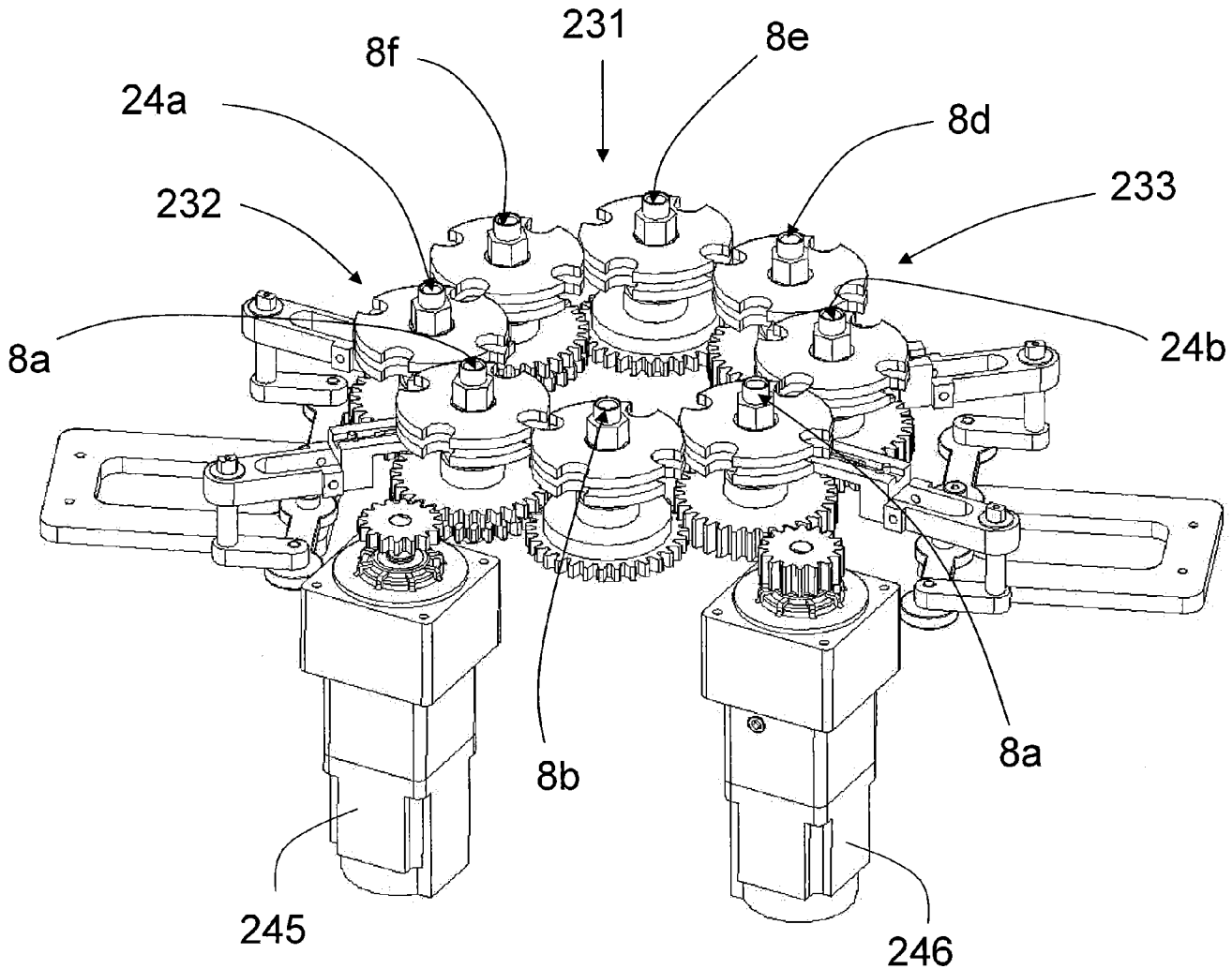
FIG. 32 is a diagram of a servomotor driven 8 horngear bifurcation braiding mechanism.

In another embodiment of the hornplate rotation control, FIG. 32 shows individual servomotors 245 and 246 used to rotate specific segments of the gear train. Specifically servomotor 245 is used rotate the horngears in swap segment 232 and servomotor 246 is used to rotate the horngears in the return segment 233. The details of these structures are described below. For clarity the horn plate and horngear units are labeled to show the correspondence between these units and the schematics of rotations in FIGS. 36 and 37.

Figure 33:
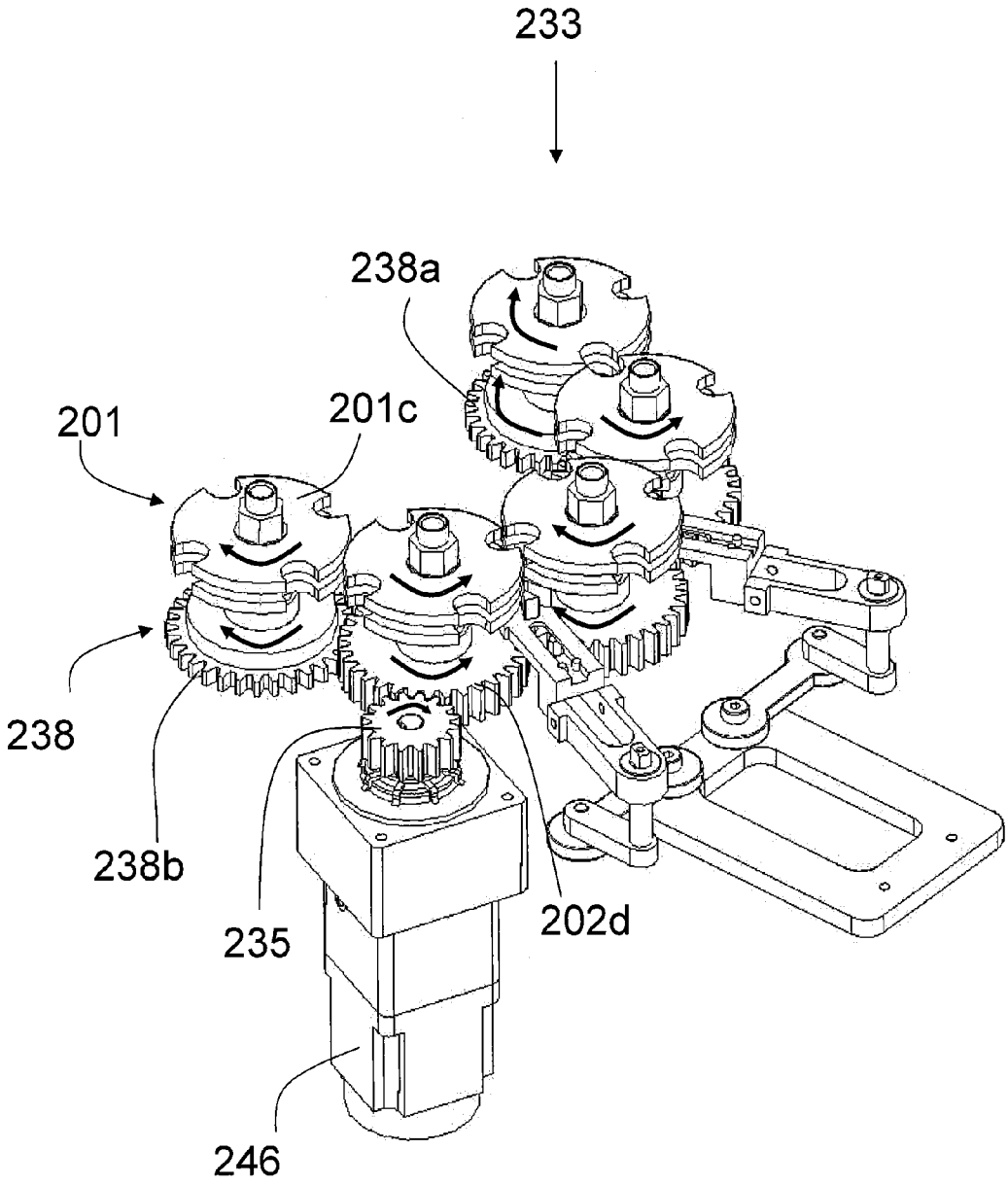
FIG. 33 is a diagram of a servomotor driven return segment for an 8 horngear bifurcation braiding mechanism.
Figure 34:
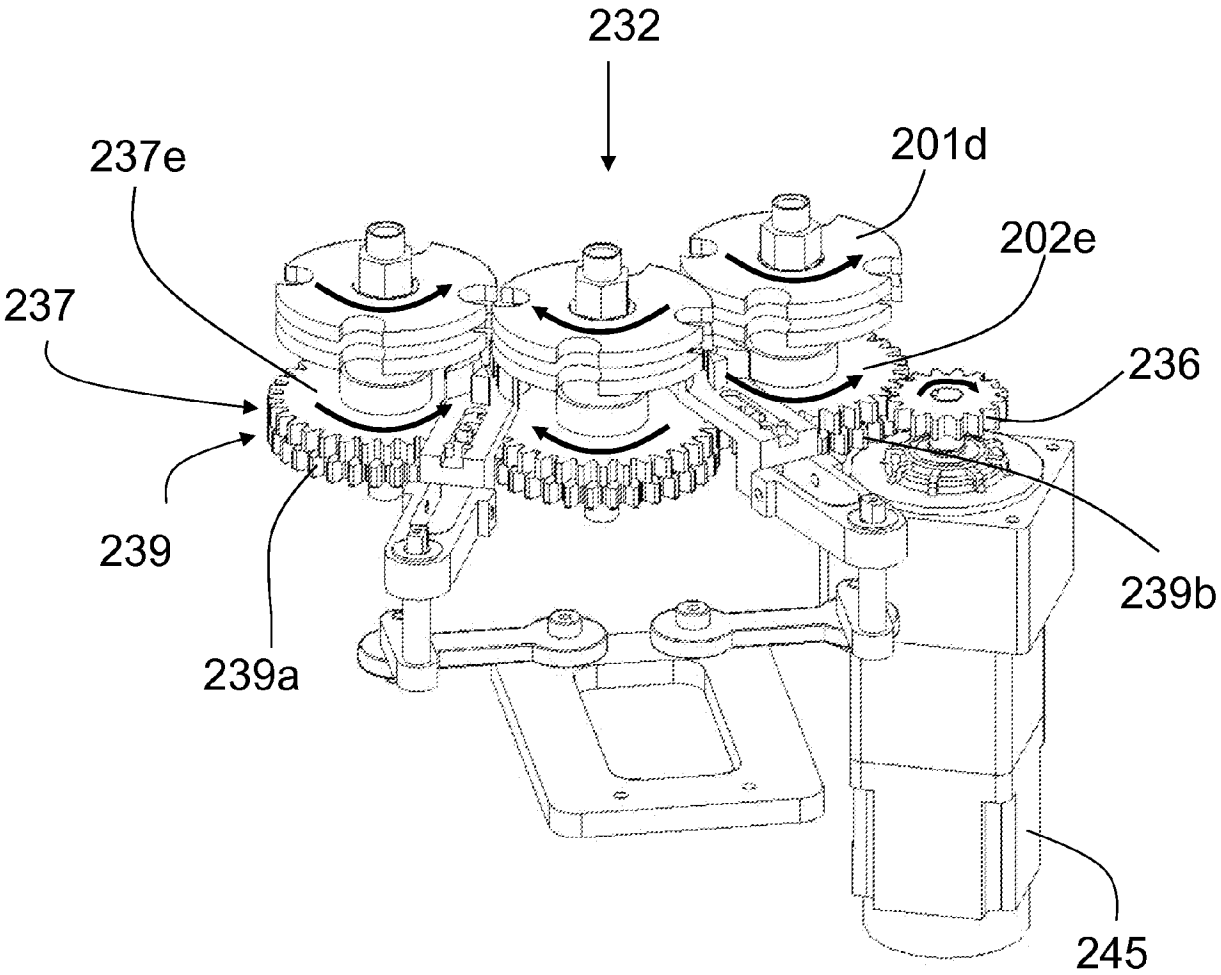
FIG. 34 is a diagram of a servomotor driven swap segment for an 8 horngear bifurcation braiding mechanism.

FIG. 33 shows the detail of return segment 233. Servomotor 246 drives pinion 235 which in turn, in this case, rotates gear 202*d* and, as gear 202*d* is part of gear train 238, rotates all gears at the same time in the illustrated direction. Pinion 235 can be positioned to turn any of the gears in FIG. 33, as long as it rotates the gear train so that hornplate 201*c* rotates in the opposite direction from hornplate 201*d* (FIG. 34). Thus, the direction of rotation of pinion 235 depends on which gear is directly driven by pinion 235. As each of the horn plates 201*c*, 201*d* are directly attached to the gears 238*b*, 237*d*, respectively, the horn plates rotate with the gears and are synchronized with each other.

Figure 35:
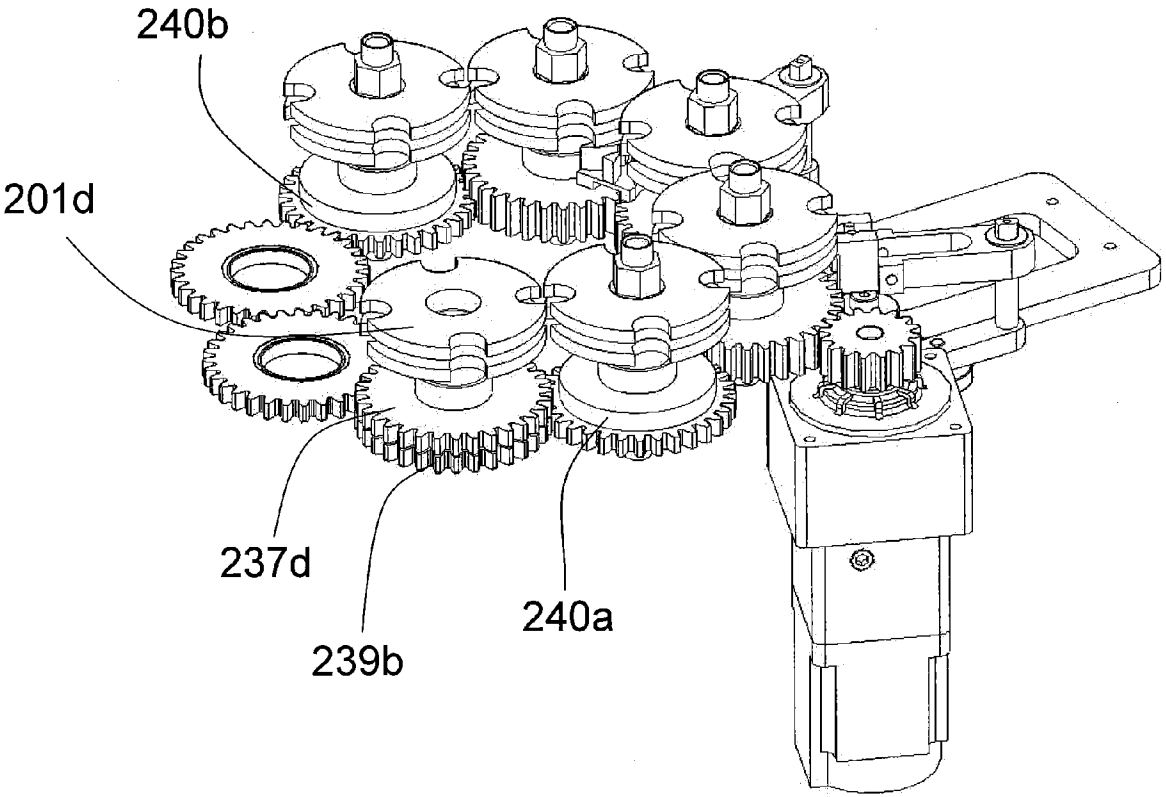
FIG. 35 is an expanded diagram of a servomotor driven return segment for an 8 horngear bifurcation braiding mechanism.

FIG. 34 shows the detail of swap segment 232. Servomotor 245 drives pinion 236 which in turn, rotates gear 202*e*. As described above with respect to pinion 235, it is not important which gear pinion 236 turns, as long as its direction of rotation is selected to rotate the gear train, so that hornplate 201*d* rotates in the opposite direction from hornplate 201*c* (FIG. 33). As each of the horn plates are directly attached to the gears, the horn plates rotate with the gears and are synchronized with each other. Gear train 239 comprises a set of idler gears. Gear 239*a* meshes with gear 238*a* (FIG. 33) and gear 239*b* meshes with gear 238*b* (FIG. 33). This idler gear train is separate from gear train 237 (FIG. 34) which allows swap segment 232 to rotate independently from return segment 233 (FIG. 33) when desired. For clarity, to indicate the separation between the idler gear train 239 and horngear train 237, FIG. 34 shows the gear trains not aligned. However in some embodiments, the gears are aligned as shown in FIG. 35. In the 8 horngear system these idler gears are not necessary but they can be used in other embodiments of the system, see FIG. 40, for example. Therefore, in some embodiments, for ease of manufacture, all the swap segments are constructed the same as each other.

FIG. 35 shows the full return segment 233 gear train 238. To show the relationship between swap segment 232 and return segment 233, FIG. 35 also includes idler gear 239*b* and horn plate 201*d*, but gear 239*b* and horn plate 201*d* are understood to be part of the swap segment 232 of FIG. 34, and not part of the return segment 233. Relief 240*a* in horn gear 238*b* allows horn gear 237*d* (FIG. 34) to rotate without interference. Additionally relief 240*b* allows horngear 237*e* (FIG. 34) to rotate with out interference. Therefore with reliefs 240*a* and 240*b*, swap segment 232 is free to rotate separately from the rotation of return segment 233 when desired. The sequence in FIG. 36*a*-36*i* shows when this separate rotation is used.

FIGS. 36*a*-36*i* are schematic diagrams showing how the interweaving of the edges is accomplished. In FIGS. 36*a*-36*i*, the carrier C relates to yarn 172 (shown in FIG. 18), carrier F relates to yarn 177 (FIG. 18), carrier B relates to yarn 175 (FIG. 18), and carrier G relates to yarn 174 (FIG. 18).

Figure 36A:
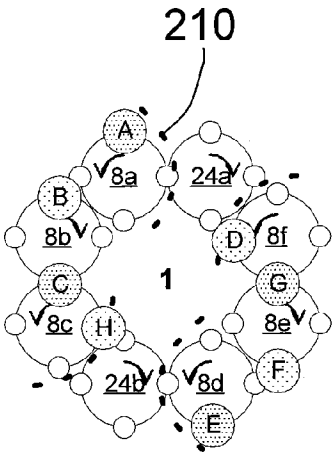
FIGS. 36*a*-36*i* are diagrams showing bridge and carrier states for a braid having a tubular section and a flat section each having eight yarns.

FIG. 36*a* (Step 1) shows the configuration for body braiding with both of the bifurcation bridges (dotted lines) 210 deactivated. The carriers A-H follow the tracks 14 and 15 shown in FIG. 2A (and FIG. 23*a*).

Figure 36B:
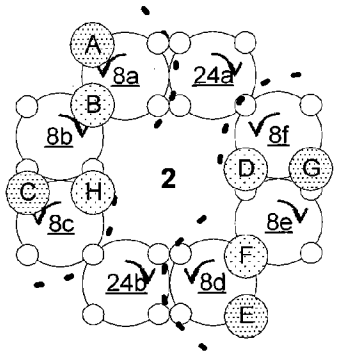

FIG. 36*b* (Step 2) shows the configuration for body braiding with both of the bifurcation bridges (dotted lines) 210 deactivated. The hornplates 8*a*-8*d*, 24*a*, 24*b* are rotated half way between the positions as shown in FIG. 22*a* and FIG. 22*b*.

Figure 36C:
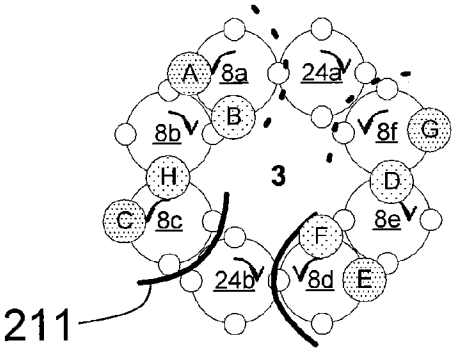

In FIG. 36*c*, (Step 3), when the bridges are free to operate (i.e., when the horns 24*a*, 24*b* between the pairs of bridge arms 16 are not currently engaging any of the yarn carriers A-G), one set of bifurcation bridges (solid lines) 211 is activated. This removes one of the horns 24*b* from the path followed by the yarn carriers A-G. The carriers follow the track 212 shown in FIG. 23*b*.

Figure 36D:
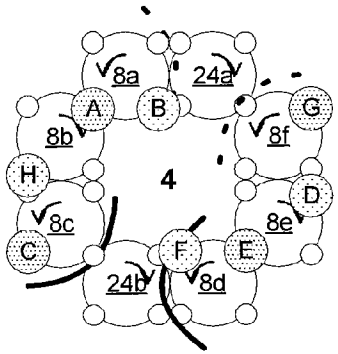

FIG. 36*d* (Step 4) shows carriers C and F beginning the rotation back for one edge of the flat braid while carriers G and B start to rotate to a position where the horngears, 8*a*, 24*a* and 8*f* collectively will only contain carriers G and B.

Figure 36E:
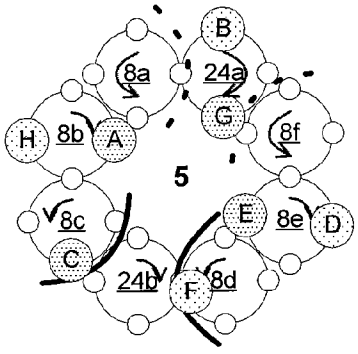

FIG. 36*e* (Step 5) shows carriers C and F rotating back for one edge of the flat braid while carriers G and B rotate to a position where the horngears, 8*a*, 24*a* and 8*f* collectively only contain carriers G and B. Carrier A has rotated to a position such that horngear 8*a* is just free to rotate without touching carrier A. As horngears 8*a*, 24*a* and 8*f* are controlled by servomotor 236*a* as part of swap segment 232 and horngears 8*b*, 8*c*, 24*b*, 8*d* and 8*e* are controlled by servomotor 236*b* as part of return segment 232, they can rotate at different speeds from each other. FIG. 36*e* shows horngears 8*a*, 24*a* and 8*f* have rotated further than horngears 8*b*, 8*c*, 24*b*, 8*d* and 8*e*.

Figure 36F:
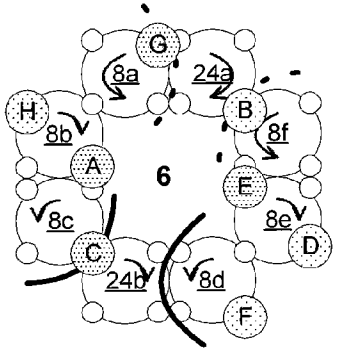

FIG. 36*f* (Step 6) shows horngears 8*a*, 24*a* and 8*f* continue to rotate faster than horngears 8*b*, 8*c*, 24*b*, 8*d* and 8*e* to a position resynchronized with horngears 8*b*, 8*c*, 24*b*, 8*d* and 8*e*. This increased rotation makes yarn 174 pass behind yarn 175, thus interweaving the edge of the bifurcation arms. For an 8 horngear system as shown, the amount of rotation for horngears 8*a*, 24*a* and 8*f* is approximately 269° at the same time horngears 8*b*, 8*c*, 24*b*, 8*d* and 8*e* rotate approximately 89°.

Figure 36I:
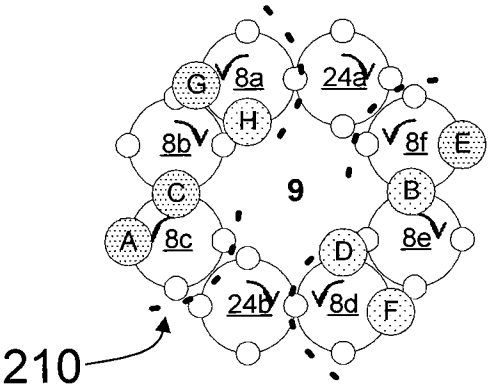
Figure 36H:
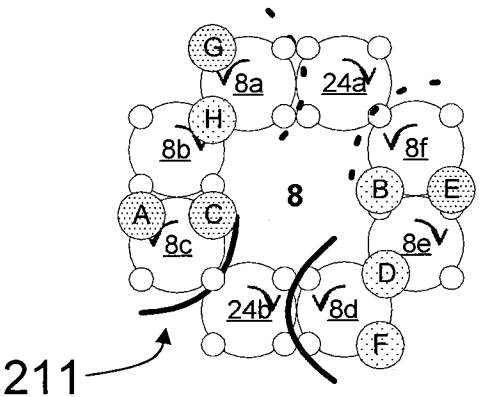
Figure 36G:
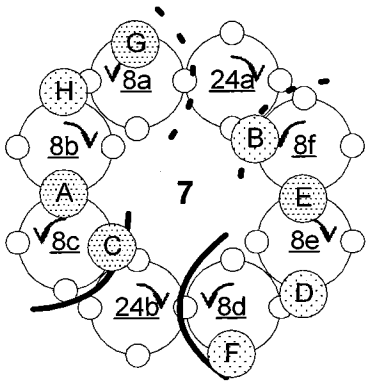

FIG. 36*g* (Step 7) shows horngears 8*a*, 24*a* and 8*f* now rotating at the same speed as horngears 8*b*, 8*c*, 24*b*, 8*d* and 8*e* bringing the carriers into the same relative position as in FIG. 36*a* (Step 1).

FIG. 36*h* (Step 8) shows horngears 8*a*, 24*a*, 8*f*, 8*b*, 8*c*, 24*b*, 8*d* and 8*e* continuing to rotate at the same speed moving the carriers clear of the bifurcation bridges (solid lines) 211.

FIG. 36*i* (Step 9) shows the bifurcation bridges (dotted lines) 210 deactivated.

By independently controlling the bifurcation bridges and independently programming the horngears the apparatus is able to create a flat braid with bifurcation 180 as shown in FIG. 18.

Figure 37C:
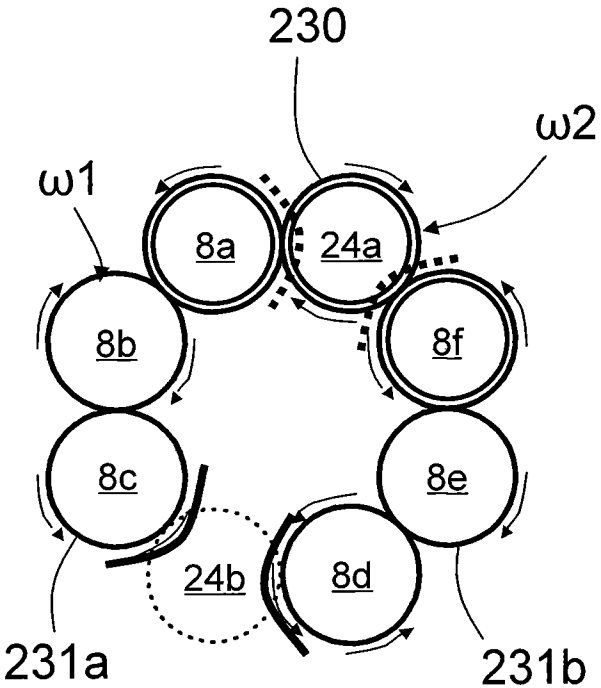
FIGS. 37*a*-37*c* show the track configurations used by the apparatus of FIGS. 36*a*-36*i*.
Figure 37B:
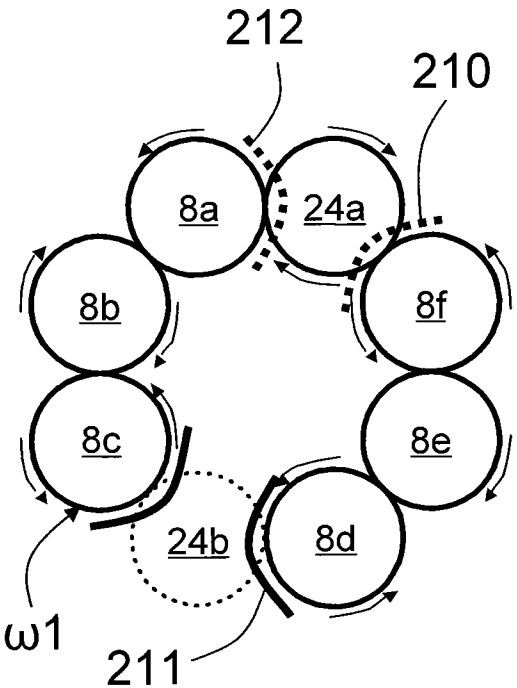
Figure 37A:
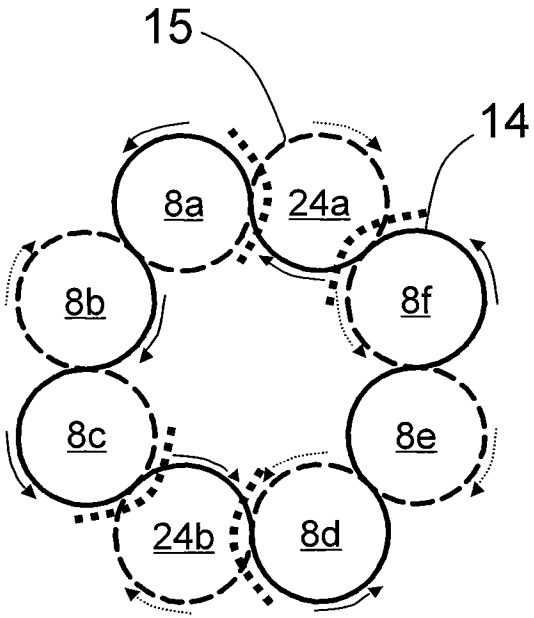

FIGS. 37*a*-37*c* summarize the tracks followed by the various carriers in the sequence of FIGS. 36*a*-36*i*. FIG. 37*a* shows the two paths for a body braid, with no bridges activated. Path 15 is the clockwise direction path and path 14 is the counterclockwise direction path.

FIG. 37*b* shows the single path 212 for a flat braid. The bifurcation bridges determine which horngears are completely excluded from the path through which the carriers move. In this case, only the bridge pair 211 around horngear 24*b* is activated. The horngears 8*a*, 8*b*, 8*c*, 24*b*, 8*d*, 8*e*, 8*f*, 24*a* all rotate at the same rate ω1.

FIG. 37*c* shows the path 230 used to swap carriers while paths 231*a* and 231*b* are used to continue the motion of the remaining carriers. As the rotation of horngears 8*a*, 24*a* and 8*f* are controlled by servomotor (such as servomotor 246 of FIG. 32) and the rotation of horngears 8*b*, 8*c*, 24*b*, 8*d* and 8*e* are controlled by servomotor (such as servomotor 245*a*-*c* of FIG. 32), the rate of rotation of the carriers in path 230, ω2 can be different than the than the rate of rotation of the carriers in paths 231*a* and 231*b*, ω1. During the swap motion, horngears 8*a*, 24*a* and 8*f* rotate at a rate of ω2 for approximately 269° while horngears 8*b*, 8*c*, 24*b*, 8*d* and 8*e*, rotate at a rate ω1 for approximately 89°. This allows the carriers in path 230 to exchange positions in the same amount of time as the carriers in paths 231*a* and 231*b* complete their motion and thus interweaving the edge of the bifurcation arms.

Figure 38:
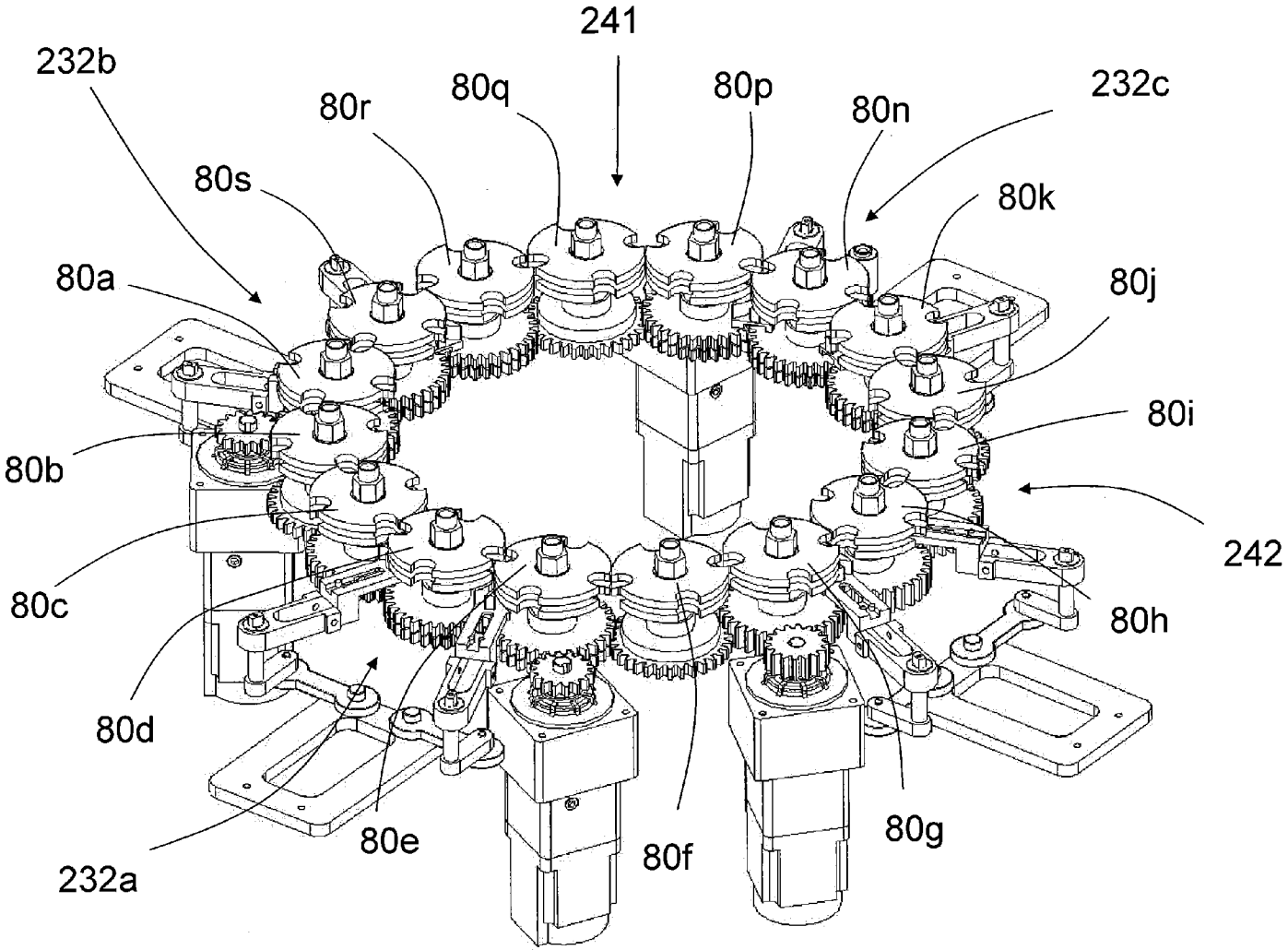
FIG. 38 is a diagram of a servomotor driven 16 horngear bifurcation braiding mechanism.

This process can be extended to as many carriers as desired, provided the number of carriers is divisible by 4. FIG. 38 shows a 16-end system 241 for body and bifurcation braids. It is comprised of three swap segments 232*a*, 232*b* and 232*c*, and one return segment 242. For clarity the horn plate and horngear units 80*a*-80*k*, 80*n*, and 80*p*-80*s* are labeled to show the correspondence between these units and the schematics of rotations in FIG. 41*a*-41*i*.

Figure 39:
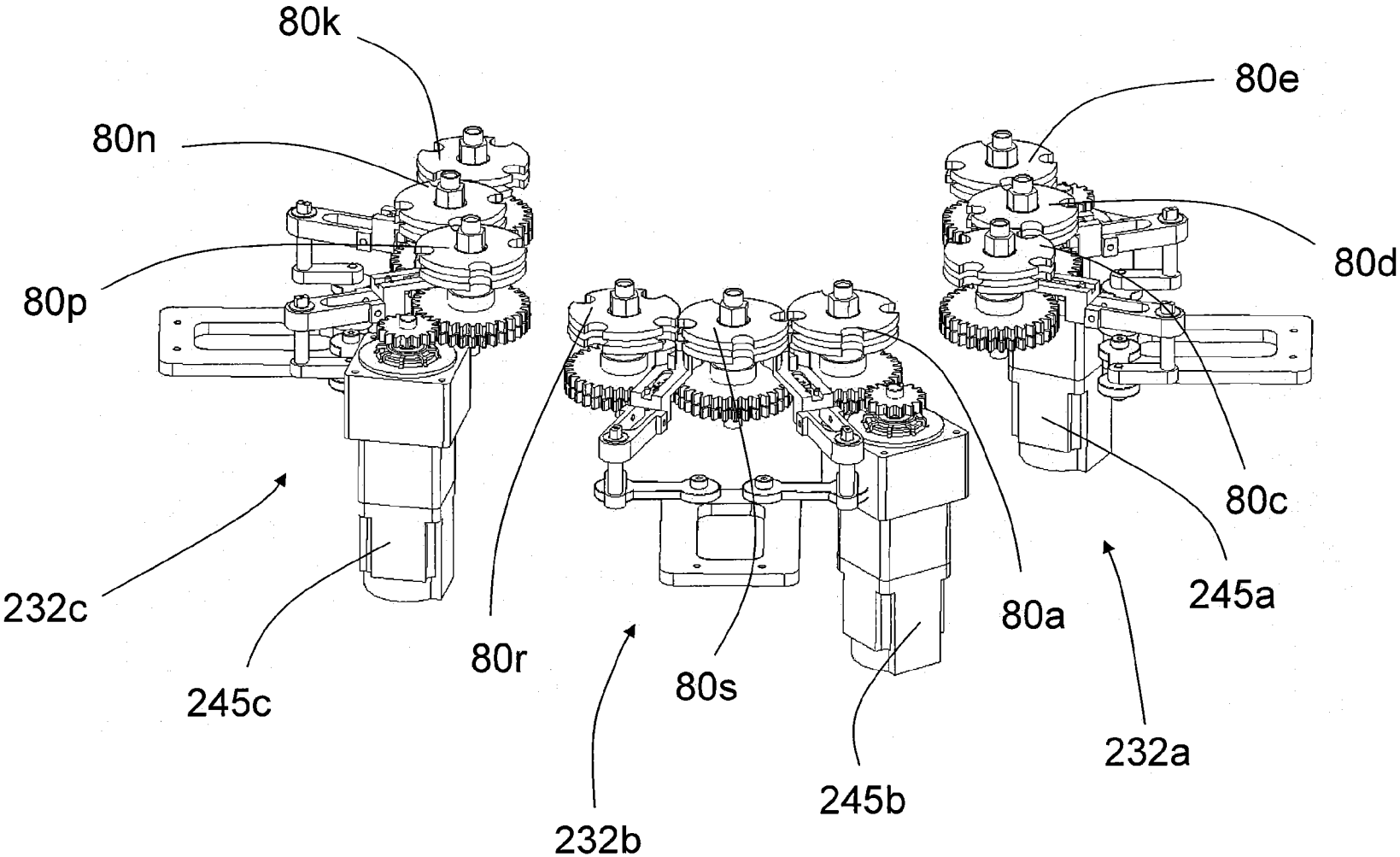
FIG. 39 is a diagram of servomotor driven swap segments for a 16 horngear bifurcation braiding mechanism.

FIG. 39 shows the arrangement of the three swap segments 232*a*, 232*b* and 232*c*. These swap segments are constructed and operate the same way as the swap segment 232 shown in FIG. 34

Figure 40:
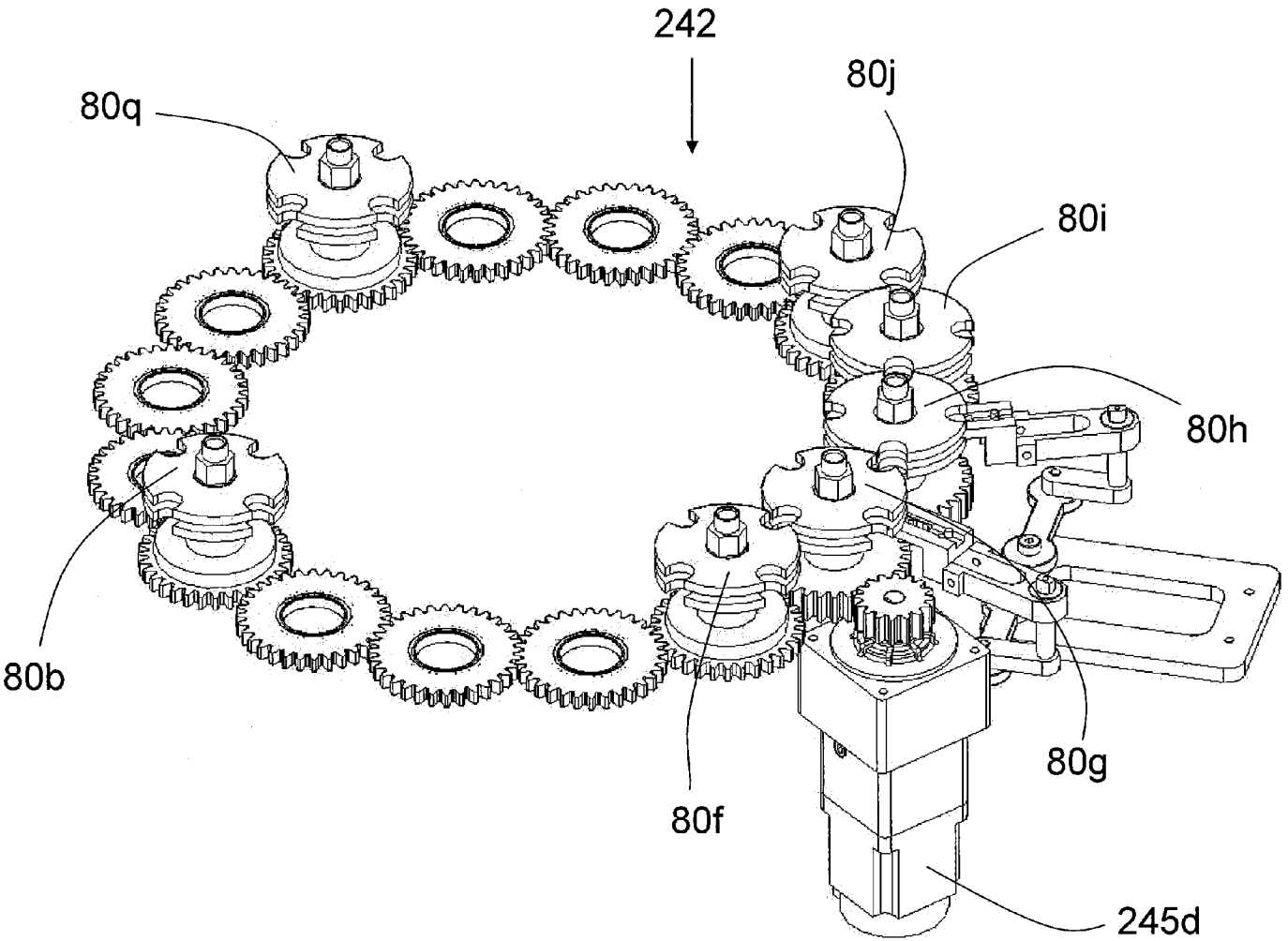
FIG. 40 is a diagram of a servomotor driven return segment for a 16 horngear bifurcation braiding mechanism.

FIG. 40 shows the arrangement of the return segment 242. In this configuration the idler gears are used to rotate the horngears 80*b* and 80*q* as these horngears always rotate at the same rate as horngears 80*f*, 80*g*, 80*i* and 80*j*.

FIGS. 41*a*-41*i* show the steps for a 16-end body to flat to body braid using 4 sets of bifurcation bridges 16*a*-16*d*. In FIG. 24*a* (Step 1), none of the bridges 16*a*, 16*b*, 16*c*, 16*d* are active and all of the horngears 80*a*, 80*b*, 80*c*, 80*d*, 80*e*, 80*f*, 80*g*, 80*h*, 80*i*, 80*j*, 80*k*, 80*n*, 80*p*, 80*q*, 80*r*, 80*s* are rotating creating a body braid.

Figure 41A:
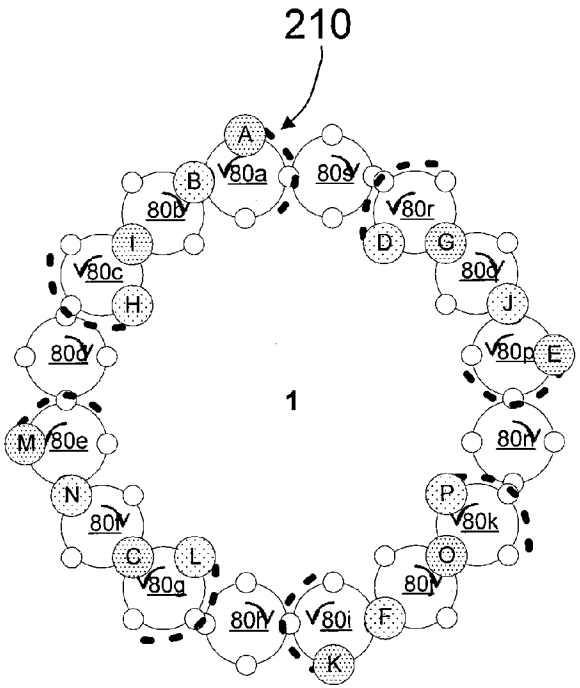
FIGS. 41*a*-41*i* are diagrams showing bridge and carrier states for a braid having a tubular section and a flat section each having sixteen yarns.

FIGS. 41*a*-41*i* show the steps for a 16-end body to flat to body braid using 4 sets of bifurcation bridges. In FIG. 41*a* (Step 1), none of the bridges are active and all of the horngears 80*a*, 80*b*, 80*c*, 80*d*, 80*e*, 80*f*, 80*g*, 80*h*, 80*i*, 80*j*, 80*k*, 80*n*, 80*p*, 80*q*, 80*r*, 80*s* are rotating creating a body braid. Relating FIGS. 41*a*-41*i* to flat braid section 254 in FIG. 43, the carrier N relates to yarn 248, the carrier I relates to yarn 249, the carrier B relates to yarn 250, the carrier G relates to yarn 251, the carrier J relates to yarn 252, the carrier O relates to yarn 253.

Figure 41B:
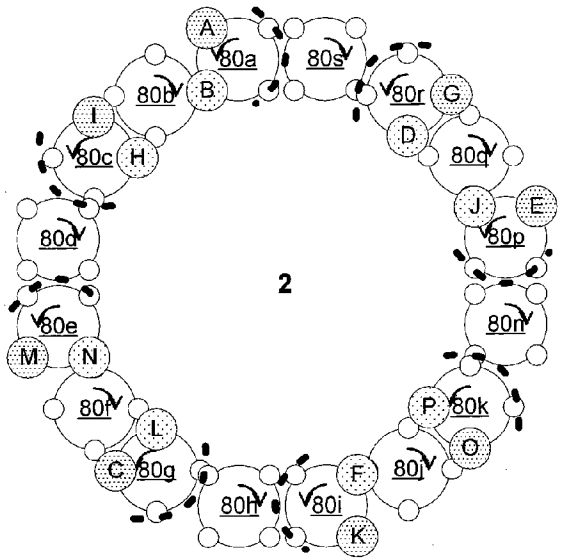

FIG. 41*b* (Step 2) shows the configuration for body braiding with all of the bifurcation bridges (dotted lines) 210 deactivated. The hornplates are rotated half way between the positions as shown in FIG. 24*a* and FIG. 24*b*.

Figure 41C:
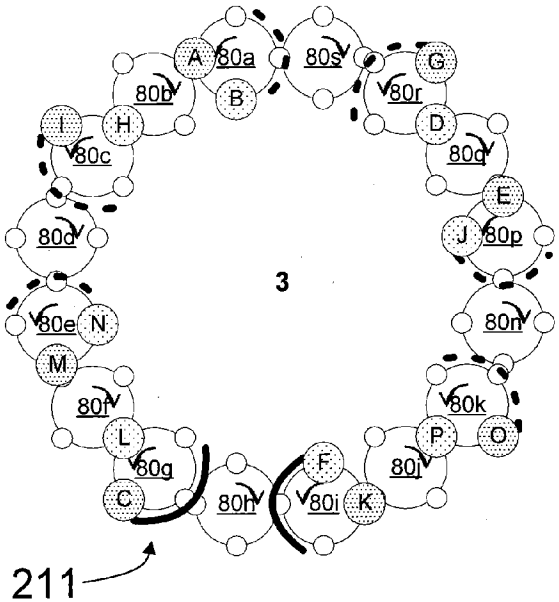

In FIG. 41*c*, (Step 3), when the bridges are free to operate (i.e., when the horns 80*d*, 80*h*, 80*n*, 80*s* between the pairs of bridge arms 16 are not currently engaging any of the yarn carriers A-P), one set of bifurcation bridges (solid lines) 211 is activated. This removes one of the horns 80*h* from the path followed by the yarn carriers A-P. The carriers follow the track 243 shown in FIG. 42*b*.

Figure 41F:
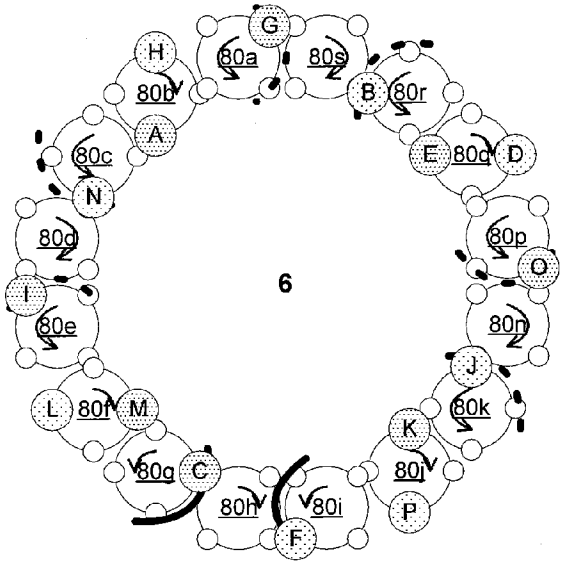
Figure 41E:
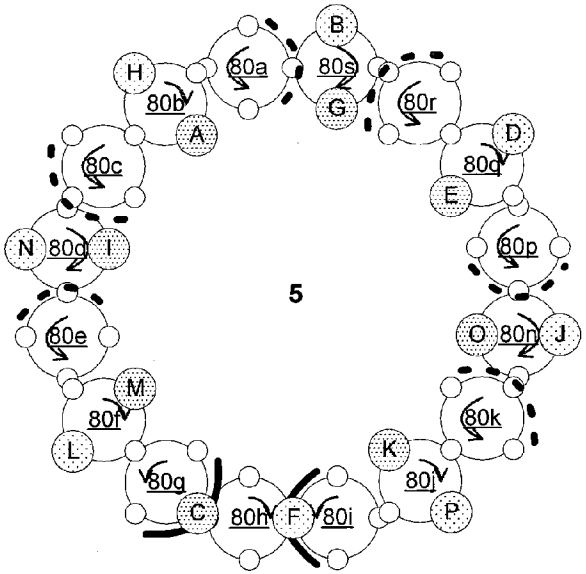
Figure 41D:
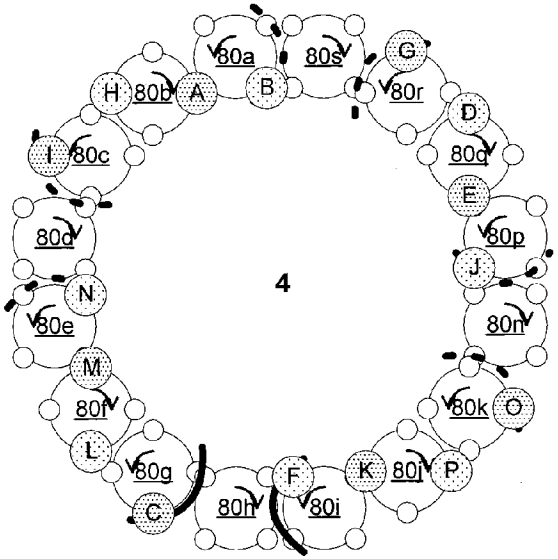

FIG. 41*d* (Step 4) shows carriers C and F beginning the rotation back for one edge of the flat braid while carriers N, I start to rotate to a position where the horngears 80*c*, 80*d*, 80*e* collectively will only contain carriers N, I, carriers B, G start to rotate to a position where the horngears 80*a*, 80*s*, 80*r* collectively will only contain carriers B, G, and carriers J, O start to rotate to a position where the horngears 80*k*, 80*n*, 80*p* collectively will only contain carriers J, O.

FIG. 41*e* (Step 5) shows carriers C and F rotating back for one edge of the flat braid. Carriers N, I rotate to a position where the horngears 80*c*, 80*d*, 80*e* collectively only contain carriers N, I and carrier M has rotated to a position such that horngear 80*e* is just free to rotate without touching carrier M. Carriers B, G rotate to a position where the horngears 80*a*, 80*s*, 80*r* collectively only contain carriers B, G and carrier A has rotated to a position such that horngear 80*a* is just free to rotate without touching carrier A. Carriers J, O rotate to a position where the horngears 80*k*, 80*n*, 80*p* collectively only contain carriers J, O and carrier E has rotated to a position such that horngear 80*p* is just free to rotate without touching carrier E.

FIG. 41*e* shows horngears 80*c*, 80*d*, 80*e* and 80*a*, 80*s*, 80*r* and 80*k*, 80*n*, 80*p* have rotated further than horngears 80*f*, 80*g*, 80*h*, 80*i*, 80*j*. FIG. 39 shows horngears 80*e*, 80*d*, 80*c* controlled by servomotor 245*a* as part of swap segment 232*a*, horngears 80*a*, 80*s*, 80*r* controlled by servomotor 245*b* as part of swap segment 232*b*, horngears 80*p*, 80*n*, 80*k* controlled by servomotor 245*c* as part of swap segment 232 and FIG. 40 shows horngears 80*f*, 80*g*, 80*h*, 80*i*, 80*j*, 80*g*, 80*b* controlled by servomotor 245*d* as part of return segment 242. As these segments are independently controlled they can rotate at a different rates.

FIG. 41*f* (Step 6) shows horngears 80*e*, 80*d*, 80*c*, 80*a*, 80*s*, 80*r*, 80*p*, 80*n*, 80*k*, continue to rotate faster than horngears 80*f*, 80*g*, 80*h*, 80*i*, 80*j*, 80*g*, 80*b* to a position resynchronized with horngears 80*f*, 80*g*, 80*h*, 80*i*, 80*j*, 80*g*, 80*b*. This increased rotation makes yarn 249 pass behind yarn 248, yarn 251 pass behind yarn 250, yarn 253 pass behind yarn 252 (FIG. 43) and thus interweaving the edge of the bifurcation arms. For a 16 horngear system as shown, the amount of rotation for horngears 80*e*, 80*d*, 80*c*, 80*a*, 80*s*, 80*r*, 80*p*, 80*n*, 80*k* is approximately 291° at the same time horngears 80*f*, 80*g*, 80*h*, 80*i*, 80*j*, 80*g*, 80*b* rotate approximately 111°.

Figure 41I:
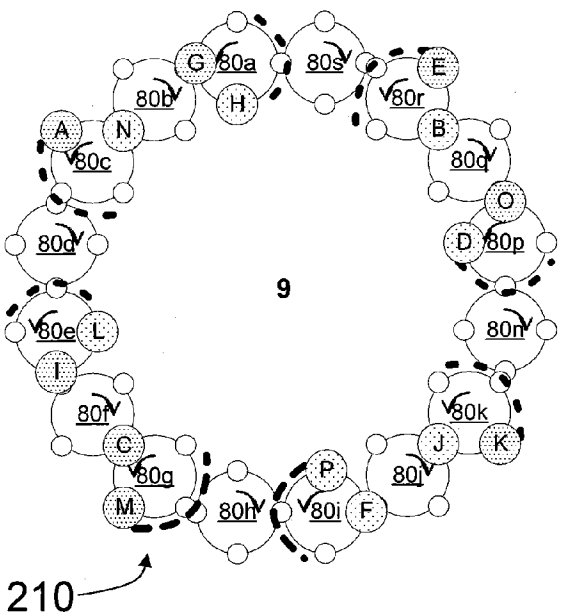
Figure 41H:
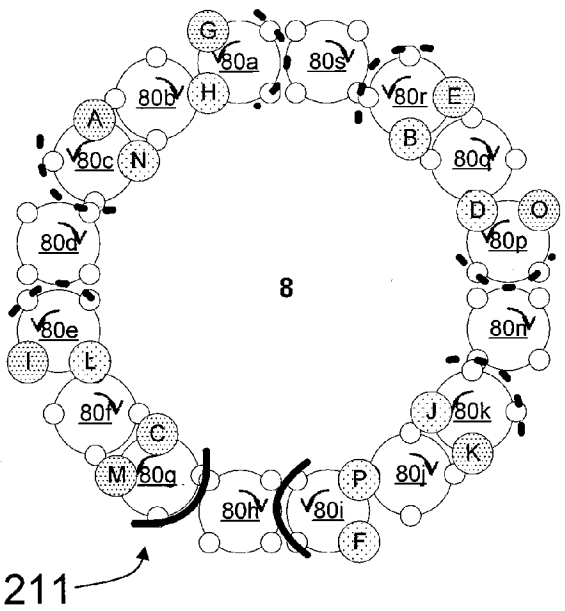
Figure 41G:
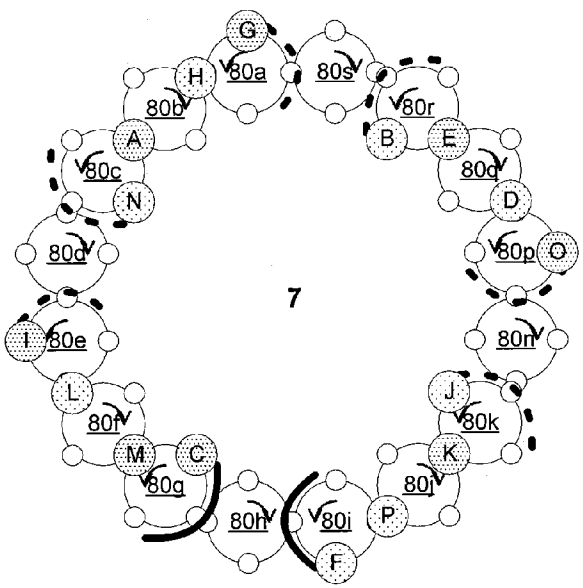

FIG. 41*g* (Step 7) shows horngears 80*e*, 80*d*, 80*c*, 80*a*, 80*s*, 80*r*, 80*p*, 80*n*, 80*k* now rotating at the same speed as horngears 80*f*, 80*g*, 80*h*, 80*i*, 80*j*, 80*g*, 80*b* bringing the carriers into the same relative position as in FIG. 41*a* (Step 1).

FIG. 41*h* (Step 8) shows horngears 80*a*, 80*b*, 80*c*, 80*d*, 80*e*, 80*f*, 80*g*, 80*h*, 80*i*, 80*j*, 80*k*, 80*n*, 80*p*, 80*q*, 80*r*, 80*s* continuing to rotate at the same speed moving the carriers clear of the bifurcation bridges (solid lines) 211.

FIG. 41*i* (Step 9) shows the bifurcation bridges (dotted lines) 210 deactivated.

Figure 43:
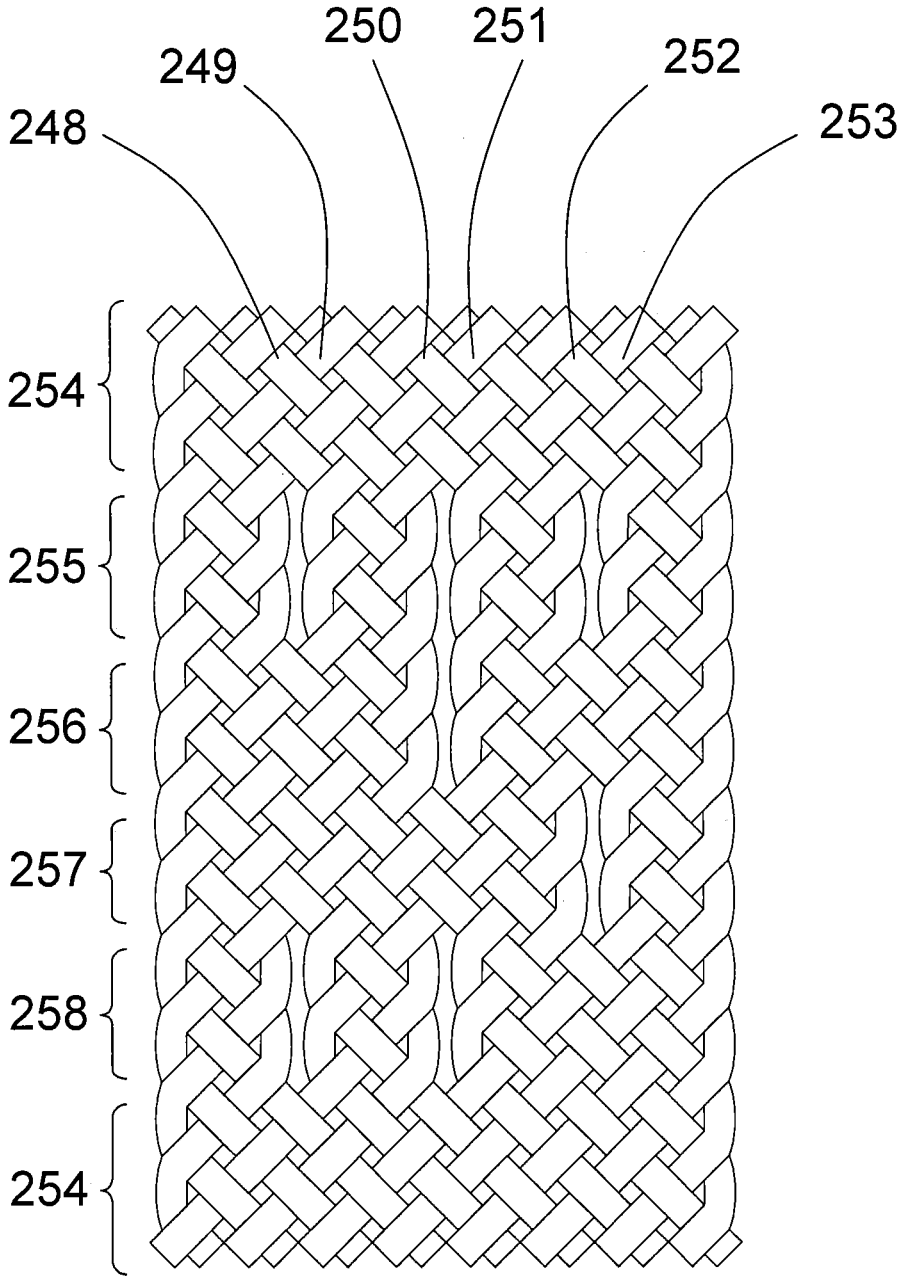
FIG. 43 shows a continuous flat braid having five different flat braid configurations.

By independently controlling the bifurcation bridges and independently programming the horngears it is possible to create a flat braid with bifurcations 255, 256, 257, 258 as shown in FIG. 43.

Figure 42A:
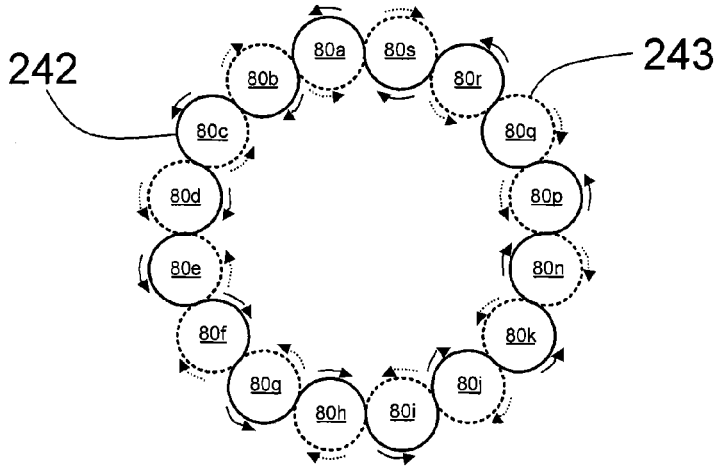
FIGS. 42*a*-42*c* show the track configurations used by the apparatus of FIGS. 41*a*-41*i*.
Figure 42B:
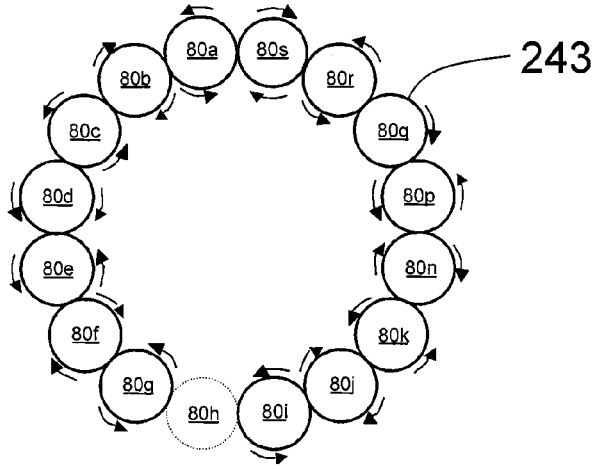
Figure 42C:
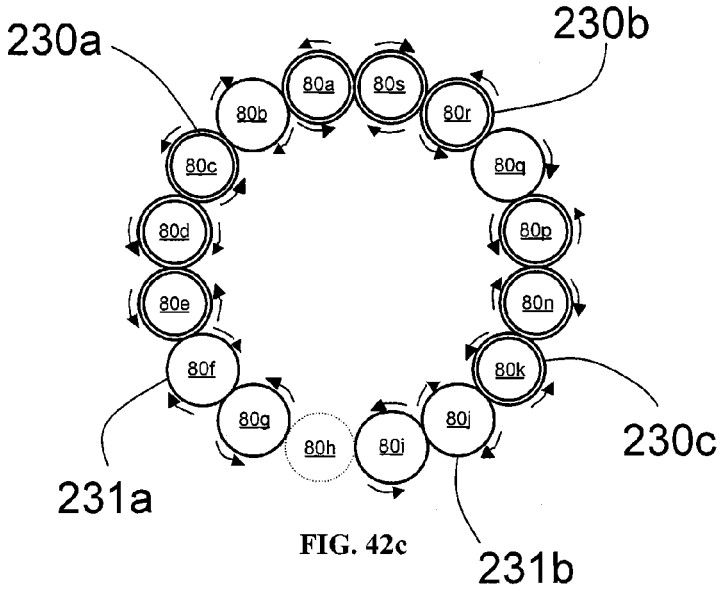

FIGS. 42*a*-42*c* summarize the tracks followed by the various carriers in the sequence of FIGS. 41*a*-41*i*. FIG. 42*a* shows the two paths for a body braid, with no bridges activated. Path 242 (solid line) is the clockwise direction path and path 243 (dotted line) is the counterclockwise direction path.

FIG. 42*b* shows the single path 244 for a flat braid. The bifurcation bridges determine which horngears are completely excluded from the path through which the carriers move. In this case, only the bridge pair 211 around horngear 80*h* is activated (FIG. 41*c*).

FIG. 42*c* shows the paths 230*a*, 230*b*, 230*c* used to swap carriers while paths 231*a* and 231*b* are used to continue the motion of the remaining carriers.

Figure 44B:
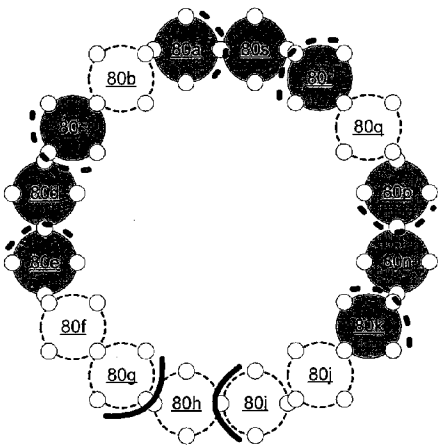
Figure 44B:
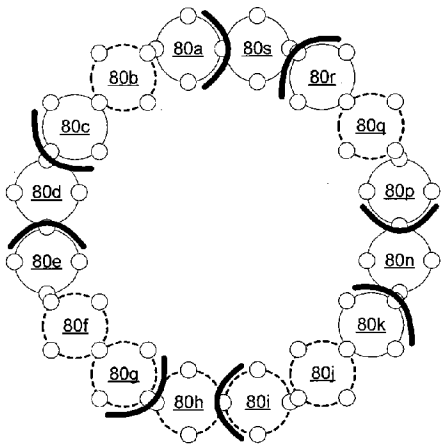
Figure 44C:
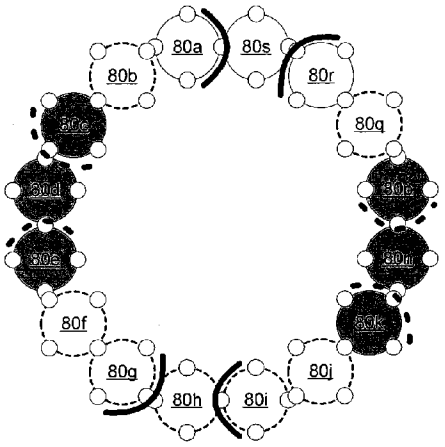
Figure 44D:
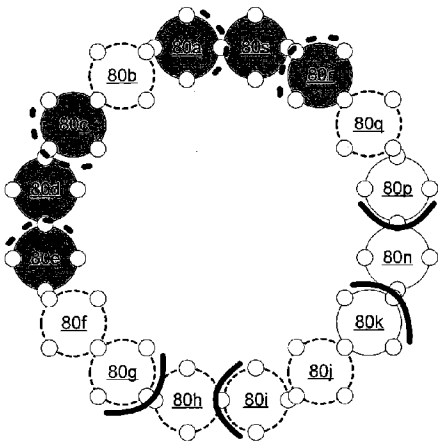
Figure 44E:
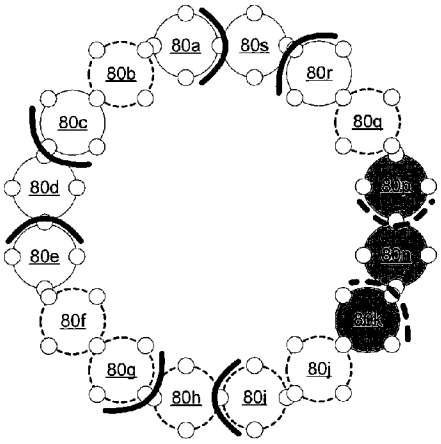

With independent control of each of the swap segments 232*a*, 232*b*, 232*c*, return segment 242 and the bifurcation gates 16 a variety of flat bifurcated braids can be created. FIG. 43 shows non-limiting examples of different combinations of bifurcated flat braids that the apparatus is capable of forming with a 16-end bifurcation mechanism. Relating FIG. 43 to FIG. 44*a*-44*e*, FIG. 44*a* is the configuration to braid a single 16-end flat braid 254. FIG. 44*b* is the configuration to braid four 4-end flat braids 255. FIG. 44*c* is the configuration to braid two 8-end flat braids 256. FIG. 44*d* is the configuration to braid one 12-end and one 4-end flat braids 257. FIG. 44*e* is the configuration to braid two 4-end and one 8-end flat braids 258.

Although the invention has been described in terms of exemplary embodiments, it is not limited thereto. Rather, the appended claims should be construed broadly, to include other variants and embodiments of the invention, which may be made by those skilled in the art without departing from the scope and range of equivalents of the invention.

What is claimed is:

1. In a braider for guiding bobbin carriers and horngears, the horngears each having hornplates for forming at least one path, a method comprising the steps of:

(a) positioning the bobbin carriers on the horngears in a first flat braiding mode, with the horngears configured so that the hornplates cause the bobbin carriers to move along at least one closed path that does not intersect any other one of the at least one closed path;

(b) rotating a first subset of the horngears of the braider in the first flat braiding mode using at least two independently operable servomotors, to form a first flat braid section;

(c) positioning the bobbin carriers on the horngears in a second flat braiding mode having a different configuration of non-intersecting closed paths from the first flat braiding mode;

(d) rotating a second subset of the horngears of the braider in the second flat braiding mode using the at least two independently operable servomotors, to form a second flat braid section having a different configuration of yarns than the first flat braid section; and (e) switching between the first and second flat braiding modes to form a continuous braid having at least one first flat braid section and at least one second flat braid section.

2. The method of claim 1, further comprising:

positioning 4N bobbin carriers on 4N horngears, where N is an integer greater than 0, said bobbin carriers and horngears positioned in a tubular braiding mode with the track and horngears configured to provide two paths intersecting each other;

operating the braider in the tubular braiding mode, to form a continuous tubular braid section in the continuous braid.

3. The method of claim 1, further comprising:

switching among a tubular braiding mode and the first and second flat braiding modes to form a continuous braid having at least one tubular section, at least one first flat braid section and at least one second flat braid section, while maintaining a translation speed of each moving bobbin carrier substantially constant.

4. The method of claim 3, wherein a same number of continuous yarns is included in the tubular braid section and one of the first and second flat braid sections.

5. The method of claim 1, wherein each horngear further comprises a gear, the method further comprising:

rotating one of the hornplates by rotating a respective horngear with which that hornplate is engaged;

disengaging that one hornplate from the gear of its respective horngear; and continuing to rotate the gear of the respective horngear, without rotating the one hornplate and without moving a respective bobbin carrier on that one hornplate.

6. The method of claim 5, further comprising reconfiguring the track to change a number of hornplates along the track, wherein the reconfiguring is controlled independently of the disengaging.

7. The method of claim 5, wherein each horngear has the respective hornplate thereof coupled to the respective gear thereof by a respective unidirectional clutch mechanism, and the unidirectional clutch mechanisms are configured to be engaged or disengaged independently of each other.

8. The method of claim 5, further comprising:

actuating a bifurcation bridge to reconfigure the track to change a number of hornplates along the track, wherein the actuating is performed independently of the disengaging.

9. The method of claim 5, wherein the continuing step includes rotating the gear of the respective horngear corresponding to the one hornplate through an angle of 180 degrees without rotating the one hornplate, the method further comprising:

re-engaging the one hornplate with the gear of its respective horngear when the gear has rotated through 180 degrees.

10. The method of claim 1; further comprising (f) maintaining a translation speed of each moving bobbin carrier substantially constant during steps (b), (d) and (e).

11. In a braider having a track for guiding bobbin carriers and horngears, the horngears each having hornplates for forming at least one path, a method comprising the steps of:

(a) positioning the bobbin carriers on the horngears in a first flat braiding mode, with the track and horngears configured so that the hornplates cause the bobbin carriers to move along at least one closed path that does not intersect any other one of the at least one closed path;

(b) operating the braider in the first flat braiding mode, to form a first flat braid section;

(c) swapping positions of two of the bobbin carriers on one of the horngears rotating at a first speed, while at least one other one of the horngears is rotating at a second speed different from the first speed;

(d) operating the braider in a second flat braiding mode with the track and horngears configured differently from the first flat braiding mode, including disengaging at least one of the hornplates from rotating with its respective horngear for a part of the operating in the second flat braiding mode, to form a second flat braid section having a different configuration of yarns than the first flat braid section, so that a continuous braid is formed having at least one first flat braid section and at least one second flat braid section.

12. The method of claim 11, wherein step (d) includes:

rotating the at least one of the hornplates by rotating a respective horngear with which that hornplate is engaged;

disengaging that one hornplate from its respective horngear; and continuing to rotate the respective horngear at a substantially constant speed, without rotating the at least one hornplate and without moving a respective bobbin carrier on the at least one hornplate.

13. The method of claim 12, further comprising reconfiguring the track to change a number of hornplates along the track, wherein the reconfiguring is controlled independently of the disengaging.

14. The method of claim 12, wherein each hornplate is coupled to the respective horngear thereof by a respective unidirectional clutch mechanism, and the unidirectional clutch mechanisms are configured to be engaged or disengaged independently of each other.

15. The method of claim 14, further comprising:

actuating a bifurcation bridge to reconfigure the track to change a number of hornplates along the track, wherein the actuating is performed independently of the disengaging.

16. A braider comprising:

a plurality of horngears, the horngears capable of being arranged in first and second subsets for forming at least first and second closed paths for braiding, respectively, each horngear having a driving gear and a hornplate, first and second independently controllable servomotors for driving a horngear of the first subset and a horngear of the second subset at first and second speeds, respectively;

a plurality of bobbin carriers positioned on some of the horngears, the braider capable of being configured in:

a first flat braiding mode in which the bobbin carriers are arranged on the horngears, so that there is one or more separate closed path that does not intersect another of the one or more separate closed paths, for forming a first flat braid configuration; and a second flat braiding mode for forming a second flat braid configuration different from the first flat braiding configuration.

17. The braider of claim 16, wherein each horngear has a respective clutch mechanism for selectively disengaging the respective hornplate of that horngear from the respective gear of that horngear.

18. The braider of claim 17, wherein the clutch mechanisms of each horngear are operable independently of the clutch mechanism of each other horngear.

19. The braider of claim 16, wherein each horngear has a respective wrap spring clutch and a respective clutch pawl for selectively disengaging the respective hornplate of that horngear from the respective gear of that horngear.

20. The braider of claim 16, wherein the at least one switch includes at least two switches that are capable of being operated independently of each other.

21. The braider of claim 20, wherein:

each horngear has a respective clutch mechanism for selectively disengaging the respective hornplate of that horngear from the respective gear of that horngear, the clutch mechanisms of each horngear are operable independently of the clutch mechanism of each other horngear, and independently of each of the at least two switches.

22. The method of claim 1, wherein step (e) includes swapping positions of two of the bobbin carriers on one of the horngears rotating at a first speed, while at least one other one of the horngears is rotating at a second speed different from the first speed.

23. A braider comprising:

a plurality of horngears, the horngears capable of being arranged in first and second subsets for forming one or more closed paths for braiding, each horngear having a driving gear and a hornplate, first and second independently operable servomotors for independently driving a horngear of the first subset and a horngear of the second subset, respectively, a plurality of bobbin carriers positioned on some of the horngears, the braider capable of being configured in:

a first flat braiding configuration in which the bobbin carriers are arranged on some of the horngears, in one or more separate closed paths that do not intersect another of the one or more separate closed paths, for forming a first flat braid configuration; and a second flat braiding configuration wherein at least one of the horngears swaps bobbin carriers between first and second closed paths, for forming a second flat braid configuration different from the first flat braid configuration.

* * * * *